US012687378B2

(12) United States Patent
Rastegar et al.

(10) Patent No.: US 12,687,378 B2
(45) Date of Patent: Jul. 21, 2026

(54) ACTUATION MECHANISM FOR ACTUATING A DEVICE AND METHOD FOR ACTUATING A DEVICE

(71) Applicant: Omnitek Partners LLC, Ronkonkoma, NY (US)

(72) Inventors: Jahangir S. Rastegar, Stony Brook, NY (US); Jacques Fischer, Sound Beach, NY (US)

(73) Assignee: OMNITEK PARTNERS LLC, Ronkonkoma, NY (US)

( * ) Notice: Subject to any disclaimer, the term of this patent is extended or adjusted under 35 U.S.C. 154(b) by 0 days.

(21) Appl. No.: 18/822,721

(22) Filed: Sep. 3, 2024

(65) Prior Publication Data

US 2025/0052552 A1 Feb. 13, 2025

Related U.S. Application Data

(60) Division of application No. 17/878,701, filed on Aug. 1, 2022, now Pat. No. 12,085,376, which is a continuation of application No. 16/730,512, filed on Dec. 30, 2019, now Pat. No. 11,402,189.

(60) Provisional application No. 62/862,646, filed on Jun. 17, 2019, provisional application No. 62/786,461, filed on Dec. 30, 2018.

(51) Int. Cl.
*F42C 15/24* (2006.01)

(52) U.S. Cl.
CPC ..... *F42C 15/24* (2013.01)

(58) Field of Classification Search
CPC ..... F42C 15/16; F42C 15/18; F42C 15/184; F42C 15/188; F42C 15/192; F42C 15/24; F42C 15/25; F42C 15/34
USPC ..... 102/222, 231, 237, 247
See application file for complete search history.

(56) References Cited

U.S. PATENT DOCUMENTS 2,925,778 A * 2/1960 Von Nemeth ..... F42C 15/00 102/248
3,402,666 A * 9/1968 Bolster ..... F42C 15/24 102/253
4,896,607 A * 1/1990 Hall ..... F42C 15/188 102/379
7,530,312 B1 * 5/2009 Roesler ..... F42C 15/24 102/233

FOREIGN PATENT DOCUMENTS

BE 1005559 A3 * 10/1993 ..... F42C 15/18

* cited by examiner

*Primary Examiner* — Bret Hayes

(57) ABSTRACT

An actuating mechanism including: a base having a helically shaped passage; a movable mass having a helically shaped projection, a first surface of the helically shaped projection mating with a corresponding second surface of the helically shaped passage; and a spring biasing the first surface against the second surface when the base is not being accelerated. Wherein the helically shaped passage, the helically shaped projection and the spring are configured to maintain the helically shaped projection in a first portion of the helically shaped passage upon the base experiencing a first acceleration profile having a first magnitude and a first duration and allow the mass to move to a second portion of the helically shaped passage upon the base experiencing a second acceleration profile having a second acceleration lower than the first acceleration and a second duration greater than the first duration.

3 Claims, 44 Drawing Sheets

ACTUATION MECHANISM FOR ACTUATING A DEVICE AND METHOD FOR ACTUATING A DEVICE

CROSS-REFERENCE TO RELATED APPLICATIONS

This application is a Divisional application of U.S. application Ser. No. 17/878,701 filed on Sep. 10, 2024, which is a Continuation application of U.S. patent application Ser. No. 16/730,512, filed on Dec. 30, 2019, which claims the benefit of U.S. Provisional Applications 62/786,461 filed on Dec. 30, 2018 and 62/862,646 filed on Jun. 17, 2019, the contents of each of which are incorporated herein by reference.

BACKGROUND

1. Field of the Invention

The present disclosure relates generally to actuation mechanisms, and more particularly to actuation devices for actuating mechanical inertial igniters and electrical impulse switches.

2. Prior Art

Reserve batteries of the electrochemical type are well known in the art for a variety of uses where storage time before use is extremely long. Reserve batteries are in use in applications such as batteries for gun-fired munitions including guided and smart mortars, fusing mines, missiles, and many other military and commercial applications. The electrochemical reserve-type batteries can in general be divided into two different basic types.

The first type includes the so-called thermal batteries, which are to operate at high temperatures. Unlike liquid reserve batteries, in thermal batteries the electrolyte is already in the cells and therefore does not require a release and distribution mechanism such as spinning. The electrolyte is dry, solid and non-conductive, thereby leaving the battery in a non-operational and inert condition. These batteries incorporate pyrotechnic heat sources to melt the electrolyte just prior to use in order to make them electrically conductive and thereby making the battery active. The most common internal pyrotechnic is a blend of Fe and $KClO_4$. Thermal batteries utilize a molten salt to serve as the electrolyte upon activation. The electrolytes are usually mixtures of alkali-halide salts and are used with the Li(Si)/$FeS_2$ or Li(Si)/$CoS_2$ couples. Some batteries also employ anodes of Li(Al) in place of the Li(Si) anodes. Insulation and internal heat sinks are used to maintain the electrolyte in its molten and conductive condition during the time of use.

Thermal batteries have long been used in munitions and other similar applications to provide a relatively large amount of power during a relatively short period of time, mainly during the munitions flight. Thermal batteries have high power density and can provide a large amount of power as long as the electrolyte of the thermal battery stays liquid, thereby conductive. The process of manufacturing thermal batteries is highly labor intensive and requires relatively expensive facilities. Fabrication usually involves costly batch processes, including pressing electrodes and electrolytes into rigid wafers, and assembling batteries by hand. The batteries are encased in a hermetically-sealed metal container that is usually cylindrical in shape.

The second type includes the so-called liquid reserve batteries in which the electrodes are fully assembled for cooperation, but the liquid electrolyte is held in reserve in a separate container until the batteries are desired to be activated. In these types of batteries, by keeping the electrolyte separated from the battery cell, the shelf life of the batteries is essentially unlimited. The battery is activated by transferring the electrolyte from its container to the battery electrode compartment (hereinafter referred to as the "battery cell").

A typical liquid reserve battery is kept inert during storage by keeping the aqueous electrolyte separate in a glass or metal ampoule or in a separate compartment inside the battery case. The electrolyte compartment may also be separated from the electrode compartment by a membrane or the like. Prior to use, the battery is activated by breaking the ampoule or puncturing the membrane allowing the electrolyte to flood the electrodes. The breaking of the ampoule or the puncturing of the membrane is achieved either mechanically using certain mechanisms usually activated by the firing setback acceleration or by the initiation of certain pyrotechnic material. In these batteries, the projectile spin or a wicking action is generally used to transport the electrolyte into the battery cells.

Reserve batteries are inactive and inert when manufactured and become active and begin to produce power only when they are activated. Reserve batteries have the advantage of very long shelf life of up to 20 years that is required for munitions applications.

Thermal batteries generally use some type of initiation device (igniter) to provide a controlled pyrotechnic reaction to produce output gas, flame or hot particles to ignite the heating elements of the thermal battery. There are currently two distinct classes of igniters that are available for use in thermal batteries. The first class of igniter operates based on electrical energy. Such electrical igniters, however, require electrical energy, thereby requiring an onboard battery or other power sources with related shelf life and/or complexity and volume requirements to operate and initiate the thermal battery. The second class of igniters, commonly called "inertial igniters," operate based on the firing acceleration. The inertial igniters do not require onboard batteries for their operation and are thereby often used in munitions applications such as in gun-fired munitions and mortars.

Inertial igniters are also used to activate liquid reserve batteries through the rupture of the electrolyte storage container or membrane separating it from the battery core. The inertial igniter mechanisms may also be used to directly rupture the electrolyte storage container or membrane.

Inertial igniters used in munitions must be capable of activating only when subjected to the prescribed setback acceleration levels and durations and not when subjected to any of the so-called no-fire conditions such as accidental drops or transportation vibration or the like. This means that safety in terms of prevention of accidental ignition is one of the main concerns in inertial igniters.

In recent years, new improved chemistries and manufacturing processes have been developed that promise the development of lower cost and higher performance thermal and liquid reserve batteries that could be produced in various shapes and sizes, including their small and miniaturized versions.

Mechanical inertial igniters have been developed for many munitions applications in which the munitions are subjected to relatively high firing setback accelerations of generally over 1,000 Gs with long enough duration that provides enough time for the inertial igniter to activate the igniter pyrotechnic material, which may consist of a primer or an appropriate pyrotechnic material that is directly applied to the inertial igniter as described in previous art (for example, U.S. Pat. Nos. 9,160,009, 8,550,001, 8,931,413, 7,832,335 and 7,437,995, the contents of which are hereby incorporated by reference).

In some munitions applications, however, the setback acceleration duration is not long enough for inertial igniters without preloaded springs to either activate or to provide the required percussion impact to initiate the pyrotechnic material of the device (such as a percussion primer or directly applied pyrotechnic materials).

In some other munitions applications, the setback acceleration level is not high enough and/or the striker mass of the inertial igniter cannot be made large enough due to the inertial igniter size limitations and/or the striker mass cannot be provided with long enough travel path due to the inertial igniter height limitations so that the striker mass cannot gain enough speed to impact the percussion primer or the directly applied pyrotechnic material with the required mechanical energy to initiate them.

For such applications, the mechanical inertial igniter must be provided with a source of mechanical energy to accelerate the striker element of the inertial igniter to gain enough kinetic energy to initiate the provided percussion primer or the directly applied pyrotechnic material of the device.

Inertia-based igniters must provide two basic functions. The first function is to provide the capability to differentiate the aforementioned accidental events such as drops over hard surfaces or transportation vibration or the like, i.e., all no-fire events, from the prescribed firing setback acceleration (all-fire) event. In inertial igniters, this function is performed by keeping the device striker fixed to the device structure during all aforementioned no-fire events until the prescribed firing setback acceleration event is detected. At which time, the device striker is released. The second function of an inertia-based igniter is to provide the means of accelerating the device striker to the kinetic energy level that is needed to initiate the device pyrotechnic material as it (hammer element) strikes an "anvil" over which the pyrotechnic material is provided. In general, the striker is provided with a relatively sharp point which strikes the pyrotechnic material covering a raised surface over the anvil, thereby allowing a relatively thin pyrotechnic layer to be pinched to achieve a reliable ignition mechanism. In many applications, percussion primers are directly mounted on the anvil side of the device and the required initiation pin is machined or attached to the striker to impact and initiate the primer. In either design, exit holes are provided on the inertial igniter to allow the reserve battery activating flames and sparks to exit.

Two basic methods are currently available for accelerating the device striker to the aforementioned needed velocity (kinetic energy) level. The first method is based on allowing the setback acceleration to accelerate the striker mass following its release. This method requires the setback acceleration to have long enough duration to allow for the time that it takes for the striker mass to be released and for the striker mass to be accelerated to the required velocity before pyrotechnic impact. As a result, this method is applicable to larger caliber and mortar munitions in which the setback acceleration duration is relatively long and in the order of several milliseconds, sometimes even longer than 10-15 milliseconds. This method is also suitable for impact induced initiations in which the impact induced decelerations have relatively long duration.

The second method relies on potential energy stored in a spring (elastic) element, which is then released upon the detection of the prescribed all-fire conditions. This method is suitable for use in munitions that are subjected to very short setback accelerations, such as those of the order of 1-2 milliseconds or when the setback acceleration level is low and space constraints do now allow the use of relatively large striker mass or where the height limitations of the available space for the inertial igniter do not provide enough travel distance for the inertial igniter striker to gain the required velocity and thereby kinetic energy to initiate the pyrotechnic material.

Inertia-based igniters must therefore comprise two components so that together they provide the aforementioned mechanical safety, the capability to differentiate the prescribed all-fire condition from all aforementioned no-fire conditions and to provide the required striking action to achieve ignition of the pyrotechnic elements. The function of the safety system is to keep the striker element in a relatively fixed position until the prescribed all-fire condition (or the prescribed impact induced deceleration event) is detected, at which time the striker element is to be released, allowing it to accelerate toward its target under the influence of the remaining portion of the setback acceleration or the potential energy stored in its spring (elastic) element of the device. The ignition itself may take place as a result of striker impact, or simply contact or proximity. For example, the striker may be akin to a firing pin and the target akin to a standard percussion cap primer. Alternately, the striker-target pair may bring together one or more chemical compounds whose combination with or without impact will set off a reaction resulting in the desired ignition.

A schematic of a cross-section of a conventional thermal battery and inertial igniter assembly is shown in FIG. 1. In thermal battery applications, the inertial igniter 10 (as assembled in a housing) is generally positioned above (in the direction of the acceleration) the thermal battery housing 11 as shown in FIG. 1. Upon ignition, the igniter initiates the thermal battery pyrotechnics positioned inside the thermal battery through a provided access 12. The total volume that the thermal battery assembly 16 occupies within munitions is determined by the diameter 17 of the thermal battery housing 11 (assuming it is cylindrical) and the total height 15 of the thermal battery assembly 16. The height 14 of the thermal battery for a given battery diameter 17 is generally determined by the amount of energy that it has to produce over the required period of time. For a given thermal battery height 14, the height 13 of the inertial igniter 10 would therefore determine the total height 15 of the thermal battery assembly 16. To reduce the total space that the thermal battery assembly 16 occupies within a munitions housing (usually determined by the total height 15 of the thermal battery), it is therefore important to reduce the height of the inertial igniter 10. This is particularly important for small thermal batteries since in such cases and with currently available inertial igniters, the height of the inertial igniter portion 13 is a significant portion of the thermal battery height 15.

A design of an inertial igniter for satisfying the safety (no initiation) requirement when dropped from heights of up to 7 feet (up to 2,000 G impact deceleration with a duration of up to 0.5 msec) is described below using one such embodiment disclosed in the aforementioned patents. An isometric cross-sectional view of this embodiment 200 of the inertia igniter is shown in FIG. 2. The full isometric view of the inertial igniter 200 is shown in FIG. 3. The inertial igniter 200 is constructed with igniter body 201, consisting of a base 202 and at least three posts 203. The base 202 and the at least three posts 203, can be integral but may be constructed as separate pieces and joined together, for example by welding or press fitting or other methods commonly used in the art. The base of the housing 202 is also provided with at least one opening 204 (with a corresponding opening in the thermal battery 12 in FIG. 1) to allow the ignited sparks and fire to exit the inertial igniter into the thermal battery positioned under the inertial igniter 200 upon initiation of the inertial igniter pyrotechnics 215, FIG. 2, or percussion cap primer when used in place of the pyrotechnics as disclosed therein.

A striker mass 205 is shown in its locked position in FIG. 2. The striker mass 205 is provided with vertical surfaces 206 that are used to engage the corresponding (inner) surfaces of the posts 203 and serve as guides to allow the striker mass 205 to ride down along the length of the posts 203 without rotation with an essentially pure up and down translational motion. The vertical surfaces 206 may be recessed to engage the inner three surfaces of the properly shaped posts 203.

In its illustrated position in FIGS. 2 and 3, the striker mass 205 is locked in its axial position to the posts 203 by at least one setback locking ball 207. The setback locking ball 207 locks the striker mass 205 to the posts 203 of the inertial igniter body 201 through the holes 208 provided in the posts 203 and a concave portion such as a dimple (or groove) 209 on the striker mass 205 as shown in FIG. 2. A setback spring 210, which can be in compression, is also provided around but close to the posts 203 as shown in FIGS. 2 and 3. In the configuration shown in FIG. 2, the locking balls 207 are prevented from moving away from their aforementioned locking position by the collar 211. The collar 211 can be provided with partial guide 212 ("pocket"), which are open on the top as indicated by numeral 213. The guides 213 may be provided only at the locations of the locking balls 207 as shown in FIGS. 2 and 3, or may be provided as an internal surface over the entire inner surface of the collar 211 (not shown). The advantage of providing local guides 212 is that it would result in a significantly larger surface contact between the collar 211 and the outer surfaces of the posts 203, thereby allowing for smoother movement of the collar 211 up and down along the length of the posts 203. In addition, they would prevent the collar 211 from rotating relative to the inertial igniter body 201 and makes the collar stronger and more massive. The advantage of providing a continuous inner recess guiding surface for the locking balls 207 is that it would require fewer machining processes during the collar manufacture.

The collar 211 can ride up and down the posts 203 as can be seen in FIGS. 2 and 3, but is biased to stay in its upper most position as shown in FIGS. 2 and 3 by the setback spring 210. The guides 212 are provided with bottom ends 214, so that when the inertial igniter is assembled as shown in FIGS. 2 and 3, the setback spring 210 which is biased (preloaded) to push the collar 211 upward away from the igniter base 201, would hold the collar 211 in its uppermost position against the locking balls 207. As a result, the assembled inertial igniter 200 stays in its assembled state and would not require a top cap to prevent the collar 211 from being pushed up and allowing the locking balls 207 from moving out and releasing the striker mass 205.

In this embodiment, a one-part pyrotechnics compound 215 (such as lead styphnate or some other similar compounds) is used as shown in FIG. 2. The surfaces to which the pyrotechnic compound 215 is attached can be roughened and/or provided with surface cuts, recesses, or the like and/or treated chemically as commonly done in the art (not shown) to ensure secure attachment of the pyrotechnics material to the applied surfaces. The use of one-part pyrotechnics compound makes the manufacturing and assembly process much simpler and thereby leads to lower inertial igniter cost. The striker mass can be provided with a relatively sharp tip 216 and the igniter base surface 202 is provided with a protruding tip 217 which is covered with the pyrotechnics compound 215, such that as the striker mass is released during an all-fire event and is accelerated down, impact occurs mostly between the surfaces of the tips 216 and 217, thereby pinching the pyrotechnics compound 215, thereby providing the means to obtain a reliable initiation of the pyrotechnics compound 215.

Alternatively, instead of using the pyrotechnics compound 215, FIG. 2, a percussion cap primer can be used. An appropriately shaped striker tip can be provided at the tip 216 of the striker mass 205 (not shown) to facilitate initiation upon impact.

The basic operation of the embodiment 200 of the inertial igniter of FIGS. 2 and 3 is now described. In case of any non-trivial acceleration in the axial direction 218 which can cause the collar 211 to overcome the resisting force of the setback spring 210 will initiate and sustain some downward motion of the collar 211. The force due to the acceleration on the striker mass 205 is supported at the dimples 209 by the locking balls 207 which are constrained inside the holes 208 in the posts 203. If the acceleration is applied over long enough time in the axial direction 218, the collar 211 will translate down along the axis of the assembly until the setback locking balls 205 are no longer constrained to engage the striker mass 205 to the posts 203. If the event acceleration and its time duration is not sufficient to provide this motion (i.e., if the acceleration level and its duration are less than the predetermined threshold), the collar 211 will return to its start (top) position under the force of the setback spring 210 once the event has ceased.

Assuming that the acceleration time profile was at or above the specified "all-fire" profile, the collar 211 will have translated down past the locking balls 207, allowing the striker mass 205 to accelerate down towards the base 202. In such a situation, since the locking balls 207 are no longer constrained by the collar 211, the downward force that the striker mass 205 has been exerting on the locking balls 207 will force the locking balls 207 to move outward in the radial direction. Once the locking balls 207 are out of the way of the dimples 209, the downward motion of the striker mass 205 is no longer impeded. As a result, the striker mass 205 accelerates downward, causing the tip 216 of the striker mass 205 to strike the pyrotechnic compound 215 on the surface of the protrusion 217 with the requisite energy to initiate ignition.

In the embodiment 200 of the inertial igniter shown in FIGS. 2 and 3, the setback spring 210 is of a helical wave spring type fabricated with rectangular cross-sectional wires (such as the ones manufactured by Smalley Steel Ring Company of Lake Zurich, Illinois). This is in contrast with the helical springs with circular wire cross-sections used in other available inertial igniters. The use of the aforementioned rectangular cross-section wave springs or the like has the following significant advantages over helical springs that are constructed with wires with circular cross-sections. Firstly, and most importantly, as the spring is compressed and nears its "solid" length, the flat surfaces of the rectangular cross-section wires come in contact, thereby generating minimal lateral forces that would otherwise tend to force one coil to move laterally relative to the other coils as is usually the case when the wires are circular in cross-section. Lateral movement of the coils can, in general, interfere with the proper operation of the inertial igniter since it could, for example, jam a coil to the outer housing of the inertial igniter (not shown in FIGS. 2 and 3), which is usually desired to house the igniter 200 or the like with minimal clearance to minimize the total volume of the inertial igniter. In addition, the laterally moving coils could also jam against the posts 203 thereby further interfering with the proper operation of the inertial igniter. The use of the wave springs with rectangular cross-section would therefore significantly increase the reliability of the inertial igniter and also significantly increase the repeatability of the initiation for a specified all-fire condition.

In the embodiment 200 of FIGS. 2 and 3, following ignition of the pyrotechnics compound 215, the generated flames and sparks are designed to exit downward through the opening 204 to initiate the thermal battery below. Alternatively, if the thermal battery is positioned above the inertial igniter 200, the opening 204 can be eliminated and the striker mass could be provided with at least one opening (not shown) to guide the ignition flame and sparks up through the striker mass 205 to allow the pyrotechnic materials (or the like) of a thermal battery (or the like) positioned above the inertial igniter 200 (not shown) to be initiated.

Alternatively, side ports may be provided to allow the flame to exit from the side of the igniter to initiate the pyrotechnic materials (or the like) of a thermal battery or the like that is positioned around the body of the inertial igniter. Other alternatives known in the art may also be used.

In FIGS. 2 and 3, the inertial igniter embodiment 200 is shown without any outside housing. In many applications, as shown in the schematics of FIG. 4*a* (4*b*), the inertial igniter 240 (250) is placed securely inside the thermal battery 241 (251), either on the top (FIG. 4*a*) or bottom (FIG. 4*b*) of the thermal battery housing 242 (252). This is particularly the case for relatively small thermal batteries. In such thermal battery configurations, since the inertial igniter 240 (250) is inside the hermetically sealed thermal battery 241 (251), there is no need for a separate housing to be provided for the inertial igniter itself. In this assembly configuration, the thermal battery housing 242 (252) is provided with a separate compartment 243 (253) for the inertial igniter. The inertial igniter compartment 243 (253) can be formed by a member 244 (254) which is fixed to the inner surface of the thermal battery housing 242 (253), for example, by welding, brazing or very strong adhesives or the like. The separating member 244 (254) is provided with an opening 245 (255) to allow the generated flame and sparks following the initiation of the inertial igniter 240 (250) to enter the thermal battery compartment 246 (256) to activate the thermal battery 241 (251). The separating member 244 (254) and its attachment to the internal surface of the thermal battery housing 242 (252) must be strong enough to withstand the forces generated by the firing acceleration.

For larger thermal batteries, a separate compartment (similar to the compartment 10 over or possibly under the thermal battery hosing 11 as shown in FIG. 1) can be provided above, inside or under the thermal battery housing for the inertial igniter. An appropriate opening (similar to the opening 12 in FIG. 1) can also be provided to allow the flame and sparks generated as a result of inertial igniter initiation to enter the thermal battery compartment (similar to the compartment 14 in FIG. 1) and activate the thermal battery.

The inertial igniter 200, FIGS. 2 and 3 may also be provided with a housing 260 as shown in FIG. 5. The housing 260 can be one piece and fixed to the base 202 of the inertial igniter structure 201, such as by soldering, laser welding or appropriate epoxy adhesive or any other of the commonly used techniques to achieve a sealed compartment. The housing 260 may also be crimped to the base 202 at its open end 261, in which case the base 202 can be provided with an appropriate recess 262 to receive the crimped portion 261 of the housing 260. The housing can be sealed at or near the crimped region via one of the commonly used techniques such as those described above.

It is appreciated by those skilled in the art that by varying the mass of the striker 205, the mass of the collar 211, the spring rate of the setback spring 210, the distance that the collar 211 has to travel downward to release the locking balls 207 and thereby release the striker mass 205, and the distance between the tip 216 of the striker mass 205 and the pyrotechnic compound 215 (and the tip of the protrusion 217), the designer of the disclosed inertial igniter 200 can try to match the all-fire and no-fire impulse level requirements for various applications as well as the safety (delay or dwell action) protection against accidental dropping of the inertial igniter and/or the munitions or the like within which it is assembled.

Briefly, the safety system parameters, i.e., the mass of the collar 211, the spring rate of the setback spring 210 and the dwell stroke (the distance that the collar 210 must travel downward to release the locking balls 207 and thereby release the striker mass 205) must be tuned to provide the required actuation performance characteristics. Similarly, to provide the requisite impact energy, the mass of the striker 205 and the aforementioned separation distance between the tip 216 of the striker mass and the pyrotechnic compound 215 (and the tip of the protrusion 217) must work together to provide the specified impact energy to initiate the pyrotechnic compound when subjected to the remaining portion of the prescribed initiation acceleration profile after the safety system has been actuated.

The significant shortcomings of the prior art inertial igniters are related to their limitations for use in munitions with relatively low setback acceleration levels, for example, for munitions with setback acceleration levels of below around 300-500 Gs, or where the duration of the setback acceleration is very short, for example around 1 millisecond, and when the available space limits the height of the inertial igniter, for example to around 5-10 mm, or when more than one of the indicated limitations are present.

In addition, due to the unavoidable friction related forces, the difference between the no-fire impulse due to the acceleration level and duration acting on the striker mass release mechanism and the all-fire impulse due to the setback acceleration level and its duration acting on the striker mass release mechanism must be large enough to ensure the very high reliability that is required for the proper operation of the inertial igniters. In most munitions, operational reliability requirement of sometimes over 99.9 percent at 95 percent confidence level is very common and in certain cases must be even higher. In munitions in which the difference between no-fire and all-fire impulsive forces acting on the striker mass release mechanism is relatively small, the friction forces between the relevant moving parts of the inertial igniter must therefore be minimized.

It is also appreciated by those skilled in the art that currently available G-switches of different type that are used for opening or closing an electrical circuit are designed to perform this function when they are subjected to a prescribed acceleration level without accounting for the duration of the acceleration level. As such, they suffer from the shortcoming of being activated accidentally, e.g., when the object in which they are used is subjected to short duration shock loading such as could be experienced when dropped on a hard surface as was previously described for the case of inertial igniter used in munitions.

When used in applications such as in munitions, it is highly desirable for G-switches to be capable to differentiate the aforementioned accidental and short duration shock (acceleration) events such as those experienced by dropping on hard surfaces, i.e., all no-fire conditions, from relatively longer duration firing setback (shock) accelerations, i.e., all-fire condition. Such G-switches should activate when firing setback (all-fire) acceleration and its duration results in an impulse level threshold corresponding to the all-fire event has been reached, i.e., they must operate as an "impulse switch". This requirement necessitates the employment of safety mechanisms like those used in the inertial igniter embodiments, which are capable of allowing the switch activation only when the firing setback acceleration level and duration thresholds have been reached. The safety mechanism can be thought of as a mechanical delay mechanism, after which a separate electrical switch mechanism is actuated or released to provide the means of opening or closing at least one electrical circuit.

Such impulse switches with the aforementioned integrated safety mechanisms are highly desirable to be very small in size so that they could be readily used on electronic circuit boards of different products such as munitions or the like.

In addition, in certain applications, while the firing setback acceleration levels are very low, sometimes in the order of only a few tens of Gs, the inertial igniter is also required to provide protection against initiation when dropped from 5-7 feet on hard surfaces, usually acceleration shocks with peaks that may reach 2000-3000 Gs with up to 0.5 msec of duration. In addition, the inertial igniters are routinely required to be small and occupy as little volume as possible. In such applications, the firing setback acceleration is not high enough to allow the striker mass of the inertial igniter to gain enough kinetic energy in a relatively short distance, i.e., in a limited available inertial igniter height, to initiate a percussion primer. In addition, currently available inertial igniters for applications with relatively low firing setback acceleration (even up to 100-200 Gs) cannot accommodate the required no-fire condition of 2000-3000 Gs with up to 0.5 msec duration shock loading.

SUMMARY

A need therefore exists for methods to design mechanical inertial igniters for munitions applications and the like in which the setback acceleration levels and/or duration are low; and/or due to space limitations, the height of the inertial igniter must be very low, for example, in the range of 5-10 mm; and/or the no-fire and all-fire related impulsive forces acting on the striker mass release mechanism of the inertial igniter are too close to each other; and that the inertial igniter is required to be highly reliable, for example, have better than 99.9 percent reliability with 95 percent confidence level.

A need also exists for mechanical inertial igniters that are developed based on the above methods and that can satisfy the safety requirement of munitions, i.e., the no-fire conditions, such as accidental drops and transportation vibration and other similar events.

A need therefore exists for novel miniature mechanical inertial igniters for thermal batteries used in gun-fired munitions, mortars and the like, particularly for small thermal batteries that could be used in fuzing and other similar applications, that are safe (i.e., satisfy the munitions no-fire conditions), have short height to minimize the size of the thermal battery, and that can be used in applications in which the setback acceleration level is relatively low (for example, 300-500 Gs) and/or the setback acceleration duration is short (for example, in the order of 1-2 milliseconds).

Such innovative inertial igniters are highly desired to be scalable to thermal batteries of various sizes, in particular to miniaturized inertial igniters for small size thermal batteries. Such inertial igniters are generally also required not to initiate if dropped from heights of up to 5-7 feet onto a concrete floor, which can result in impact induced inertial igniter decelerations of up to of 2000 G that may last up to 0.5 msec. The inertial igniters are also generally required to withstand high firing accelerations, for example up to 20-50,000 Gs (i.e., not to damage the thermal battery); and should be able to be designed to ignite at specified acceleration levels when subjected to such accelerations for a specified amount of time to match the firing acceleration.

To ensure safety and reliability, inertial igniters should not initiate during acceleration events which may occur during manufacture, assembly, handling, transport, accidental drops, etc. Additionally, once under the influence of an acceleration profile particular to the intended firing of ordinance from a gun, the device should initiate with high reliability. It is also conceivable that the igniter will experience incidental low but long-duration accelerations, whether accidental or as part of normal handling, which must be guarded against initiation. Again, the impulse given to the inertial igniter will have a great disparity with that given by the initiation acceleration profile because the magnitude of the incidental long-duration acceleration will be quite low.

In addition, the inertial igniters used in munitions are generally required to have a shelf life of better than 20 years and could generally be stored at temperatures of sometimes in the range of −65 to 165 degrees F. The inertial igniter designs must also consider the manufacturing costs and simplicity in the designs to make them cost effective for munitions applications.

Accordingly, methods are provided that can be used to design fully mechanical inertial igniters that can satisfy the prescribed no-fire requirements while satisfying relatively low all-fire firing setback acceleration level requirement and/or short all-fire firing setback acceleration duration requirement. The methods rely on potential energy stored in a spring (elastic) element, which is then released upon the detection of the prescribed all-fire conditions. These methods are particularly suitable for use in munitions that are subjected to very short setback accelerations, such as those of the order of 1-2 milliseconds or when the setback acceleration level is low and space constraints does now allow the use of relatively large striker mass or where the height limitations of the available space for the inertial igniter does not provide enough travel distance for the inertial igniter striker to gain the required velocity and thereby kinetic energy to initiate the pyrotechnic material.

Also provided are fully mechanical igniters that are designed based on the above methods that can satisfy the prescribed no-fire requirements while satisfying relatively low all-fire firing setback acceleration level requirements and/or short all-fire firing setback acceleration duration requirement. The inertial igniters rely on potential energy stored in a spring (elastic) element, which is then released upon the detection of the prescribed all-fire conditions. Such inertial igniters are particularly suitable for use in munitions that are subjected to very short setback accelerations, such as those of the order of 1-2 milliseconds or when the setback acceleration level is low and space constraints does now allow the use of relatively large striker mass or where the height limitations of the available space for the inertial igniter does not provide enough travel distance for the inertial igniter striker to gain the required velocity and thereby kinetic energy to initiate the pyrotechnic material.

Those skilled in the art will appreciate that the inertial igniters disclosed herein may provide one or more of the following advantages over prior art inertial igniters:

- provide inertial igniters that are safe and can differentiate no-fire conditions from all-fire conditions based on the prescribed all-fire setback acceleration level (target impact acceleration level when used for target impact activation) and its prescribed duration;
- provide inertial igniters that can be activated by very short duration setback accelerations (target impact acceleration level when used for target impact activation) of the order on 1-2 milliseconds or less;
- provide inertial igniters that are very short in height to minimize the space that is occupied by the inertial igniter in the reserve battery and other locations that they are used, which is made possible by separating the striker mass release mechanism from the mechanism that accelerates the striker element, i.e., the use of potential energy stored in the device elastic element (preloaded spring element);
- provide inertial igniters that allow the use of standard off-the-shelf percussion cap primers or commonly used one part or two-part pyrotechnic components.
- provide inertial igniters that can be sealed to simplify storage and to increase shelf life.

It is appreciated by those skilled in the art that the disclosed inertial igniter mechanisms may also be used to construct electrical impulse switches, which are activated like the so-called electrical G switches but with the added time delays to account for the activation shock level duration requirement, i.e., similar to the disclosed inertial igniters to activate when a prescribed shock loading (acceleration) level is experienced for a prescribed length of time (duration). The electrical "impulse switches" may be designed as normally open or closed and with or without latching mechanisms. Such impulse switch embodiments that combine such safety mechanisms with electrical switching mechanisms are described herein together with alternative methods of their construction.

Also disclosed are inertial igniters with the capability to open or close an electrical switch, which can then be used by the user to determine the activation status of the inertial igniter as assembled in the reserve battery or the like. This capability may also be used for all-fire event detection in munitions or the like.

A need therefore exists for novel miniature impulse switches for use in munitions or the like that can differentiate accidental short duration shock loading (so-called no-fire events for munitions) from generally high but longer duration, i.e., high impulse threshold levels, that correspond to all-fire conditions in gun fired munitions or the like. Such impulse switches must be very small in size and volume to make them suitable for being integrated into electronic circuit boards or the like. They must also be readily scalable to different all-fire and no-fire conditions for different munitions or other similar applications. Such impulse switches must be safe and should be able to be designed to activate at prescribed acceleration levels when subjected to such accelerations for a specified amount of time to match the firing acceleration experienced in a gun barrel as compared to high G accelerations experienced during accidental falls or other similar events which last over very short periods of time, for example accelerations of the order of 1000 Gs when applied for 5 msec as experienced in a gun as compared to 2000 G acceleration levels experienced during accidental fall over a concrete floor but which may last only 0.5 msec. Reliability is also of much concern since most munitions are required to have a shelf life of up to 20 years and could generally be stored at temperatures of sometimes in the range of −65 to 165 degrees F. This requirement is usually satisfied best if the device is in a sealed compartment. The impulse switch must also consider the manufacturing costs and simplicity of design to make it cost effective for munitions applications.

Those skilled in the art will appreciate that the compact impulse-based mechanical impulse switches disclosed herein may provide one or more of the following advantages over prior art mechanical G-switches:

- provide impulse-based G-switches that are small in both height and volume, thereby making them suitable for mounting directly on electronic circuit boards and the like;
- provide impulse-based switches that differentiate all-fire conditions from all no-fire conditions, even those no-fire conditions that result in higher levels of shock but short duration, thereby eliminating the possibility of accidental activation;
- provide impulse switches that are modular in design and can therefore be readily customized to different no-fire and all-fire requirements;
- provide impulse switches that may be normally open or normally closed and that are modular in design and can be readily customized for opening or closing or their combination of at least one electric circuit.

Accordingly, impulse-based impulse switches with modular design for use in electrical or electronic circuitry are provided that activate upon a prescribed acceleration profile threshold. In most munitions applications, the acceleration profile is usually defined in terms of firing setback acceleration and its duration.

A need also exists for mechanical inertial igniters for munitions applications and the like in which the setback acceleration levels are very low, such as in the order of 10-50 Gs; and/or due to space limitations, the height of the inertial igniter must be very low, such as in the range of 5-10 mm; and that the required no-fire condition is relatively very high, such as in the order of 2000-3000 Gs with durations of up to 0.5 msec due to accidental drops over hard surfaces from heights, such as 5-7 feet; and that the inertial igniter is required to be highly reliable, such as, have better than 99.9 percent reliability with 95 percent confidence level.

A need therefore exists for miniature mechanical inertial igniters for reserve batteries, such as thermal or liquid reserve batteries used in gun-fired munitions, mortars, rockets, and the like, such as for small reserve batteries that could be used in fuzing and other similar applications, that are safe, i.e., satisfy the munitions no-fire conditions, have short height to minimize the size of the reserve battery, and that can be used in applications in which the setback acceleration level is relatively low, such as tens of Gs but with relatively long duration, such as tens or even hundreds of milliseconds.

Such inertial igniters are also desired to be scalable to reserve batteries of various sizes, such as to miniaturized inertial igniters for small size reserve batteries. The inertial igniters are also generally required to withstand high firing accelerations, for example up to 20-50,000 Gs, i.e., not to damage the battery); and should be able to ignite at specified acceleration levels when subjected to such accelerations for a specified amount of time to match the firing acceleration.

To ensure safety and reliability, inertial igniters should not initiate during acceleration events which may occur during manufacture, assembly, handling, transport, accidental drops, etc. Additionally, once under the influence of an acceleration profile particular to the intended firing, i.e., a prescribed firing acceleration level and its duration threshold, the device should initiate with high reliability. It is also conceivable that the igniter will experience incidental low but long-duration accelerations, whether accidental or as part of normal handling, which must be guarded against initiation. The primary challenge in the development of methods and devices for activation at very low firing acceleration levels is in the prevention of initiation under high accidental accelerations (for example, up to 2,000-3000 Gs), albeit their short duration.

In addition, the inertial igniters used in munitions are generally required to have a shelf life of better than 20 years and could generally be stored at temperatures of sometimes in the range of −65 to 165 degrees F. The inertial igniter designs must also consider the manufacturing costs and simplicity in the designs to make them cost effective for munitions applications.

Accordingly, fully mechanical inertial igniters are provided that can satisfy the prescribed very low firing acceleration levels (such as as low as 15-20 Gs) with relatively long duration (such as of the order of tens of msec), while satisfying no-fire conditions with relatively very high G levels (such as up to 2,000-3000 Gs), but with relatively low durations (such as on the order of a fraction of a msec).

Such inertial igniters rely on potential energy stored in a spring (elastic) element, which is then released upon the detection of the prescribed all-fire conditions and can be used to design compact and low height inertial igniters, which are highly desirable in gun-fired munitions, rockets, etc., particularly where space constraints does now allow the use of a relatively large striker mass or where the height limitations of the available space for the inertial igniter does not provide enough travel distance for the inertial igniter striker to gain the required velocity and thereby kinetic energy to initiate the pyrotechnic material.

The inertial igniters rely on potential energy stored in a spring (elastic) element, which is then released upon the detection of the prescribed all-fire conditions. Such inertial igniters are particularly suitable for use in applications in which the setback acceleration level is low and space constraints does now allow the use of a relatively large striker mass or where the height limitations of the available space for the inertial igniter does not provide enough travel distance for the inertial igniter striker to gain the required velocity and thereby kinetic energy to initiate the pyrotechnic material.

Those skilled in the art will appreciate that the inertial igniters disclosed herein may provide one or more of the following advantages over prior art inertial igniters:

- provide inertial igniters that are safe and can differentiate no-fire conditions from all-fire conditions based on the prescribed all-fire setback acceleration level (target impact acceleration level when used for target impact activation) and its prescribed duration;
- provide inertial igniters for very low firing setback acceleration levels with relatively long duration that can withstand very high G accidental shock loading with relatively short duration that are sometimes orders of magnitude larger than the firing setback acceleration level, which is made possible by separating the striker mass release mechanism from the high G accidental shock loading mechanism resistant mechanism that actuates the striker mass release mechanism;
- provide inertial igniters that are short in height to minimize the space that is occupied by the inertial igniter in the reserve battery and other locations that they are used, which is made possible by separating the striker mass release mechanism from the mechanism that accelerates the striker element, i.e., the use of potential energy stored in the device elastic element (preloaded spring element);
- provide inertial igniters that allow the use of standard off-the-shelf percussion cap primers or commonly used one part or two-part pyrotechnic components.

Accordingly, a device is provided to comprise: a casing; an actuation mass rotatable between a first position and a second position relative to the casing; a first spring for biasing the actuation mass towards the second position; and a blocking mass rotatable between a third position and a fourth position relative to the casing, a first portion of the blocking mass, while in the third position, is configured to engage with a second portion of the actuation mass to maintain the actuation mass in the first position and to prevent the actuation mass, against the biasing by the spring, from rotating to the second position; wherein upon an acceleration event having an acceleration and duration greater than a predetermined threshold, the blocking mass is configured to rotate to the fourth position to release engagement of the first portion of the blocking mass with the second portion of the actuation mass to allow the spring to move the actuation mass to the second position.

The device can further comprise a second spring for biasing the blocking mass in the third position.

The device can further comprise a removable pin disposed in a hole in the casing, the pin having a portion blocking the blocking mass from moving to the fourth position.

The first portion of the blocking mass can be a rod connected to the blocking mass. The second portion of the actuation mass can be a concavity having a lip for retaining the rod.

The device can further comprise a pyrotechnic material configured to produce flames by movement of the actuation mass to the second position. The pyrotechnic material can be disposed in the casing, where the casing can have a hole for outputting the flames from the pyrotechnic material. The pyrotechnic material can be disposed outside of the casing, wherein the actuation mass can have an extended portion for striking the pyrotechnic material when the actuation mass moves to the second position. The extended portion can be a link rotatably connected to the actuation mass.

The device can further comprise a normally open switch that is closed by movement of the actuation mass to the second position. The normally open switch can comprise: an insulating material disposed in the casing; first and second electrical contacts disposed in the insulating material such that the first and second electrical contacts are spaced apart from each other; and a conducting material disposed in or on the actuation member such that the conducting material contacts both of the first and second electrical contacts when the actuation mass moves to the second position.

The device can further comprise a normally closed switch that is closed by movement of the actuation mass to the second position. The normally closed switch can comprise:

a first insulating material disposed in the casing; first and second electrical contacts disposed in the first insulating material such that the first and second electrical contacts are in contact with each other; and a second insulating material disposed in or on the actuation member such that the second insulating material separates the first and second electrical contacts when the actuation mass moves to the second position.

The first spring can be a torsion spring. The actuation mass can rotate about a shaft where the shaft can be disposed within an inner diameter of the torsion spring.

The device can further comprise: a pyrotechnic material configured to produce flames by movement of the actuation mass to the second position; and a switch configured to output or stop a signal when the actuation mass moves to the second position. The switch can be a normally open switch. The actuation mass can have a first end configured to produce the flames by movement of the actuation mass to the second position and the actuation mass can have a second end configured to operate the switch when the actuation mass moves to the second position.

Also provided is a method comprising: biasing an actuation mass in a second position; engaging a blocking mass with the actuation mass to maintain the actuation mass in a first position against the biasing; and rotating the blocking mass away from engagement with the actuation mass to allow the actuation mass to rotate from the first position to the second position upon an acceleration event having an acceleration and duration greater than a predetermined threshold.

The method can further comprise producing a flame when the actuation mass moves to the second position. The method can further comprise, simultaneously with the producing, outputting or stopping a signal when the actuation mass moves to the second position.

BRIEF DESCRIPTION OF THE DRAWINGS

These and other features, aspects, and advantages of the apparatus will become better understood with regard to the following description, appended claims, and accompanying drawings where:

DETAILED DESCRIPTION

Figure 6:
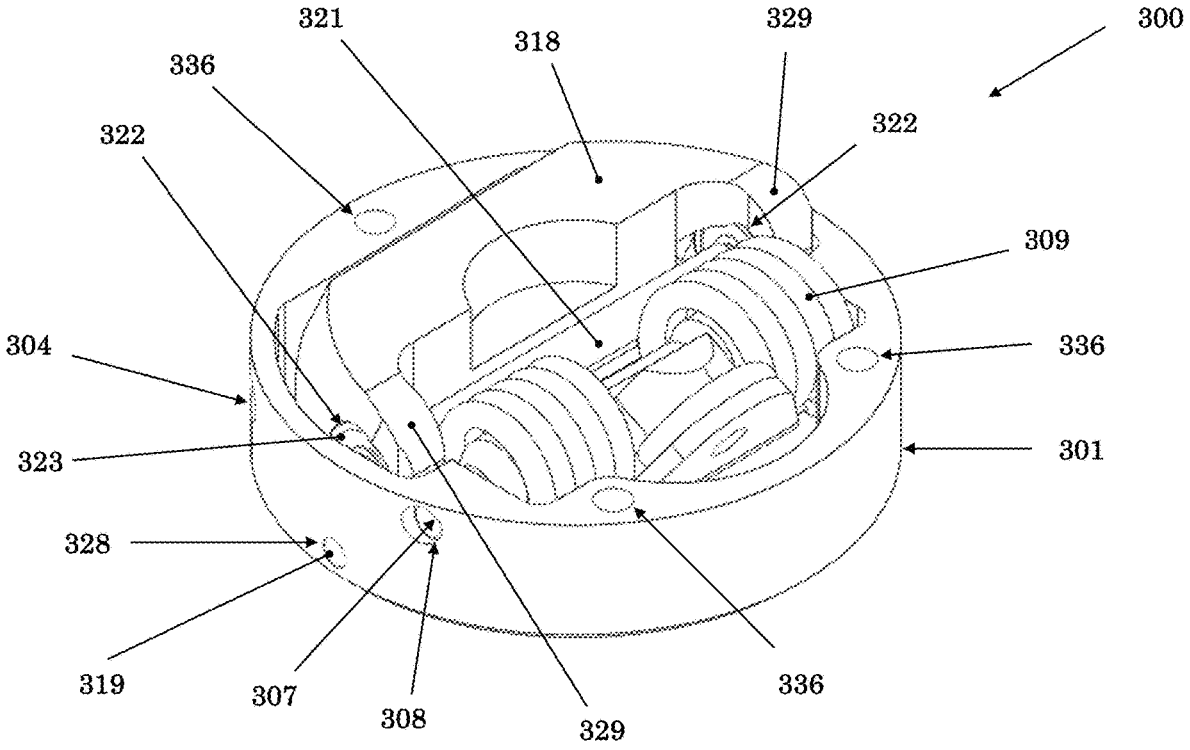
FIG. 6 illustrates a schematic of the isometric drawing of the first inertial igniter embodiment.

Referring now to FIG. 6, a full isometric view of a first inertial igniter embodiment 300 is shown therein. The inertial igniter 300 is constructed with igniter body 301 and a cap 302 (see FIG. 8), which is attached to the body 301 with the screws 303 (see FIG. 8) through the tapped holes 336. When needed, an access hole 304 is provided for an arming pin to prevent accidental activation of the inertial igniter while handling or accidental drop or the like before assembly into the intended reserve battery or the like.

Figure 7:
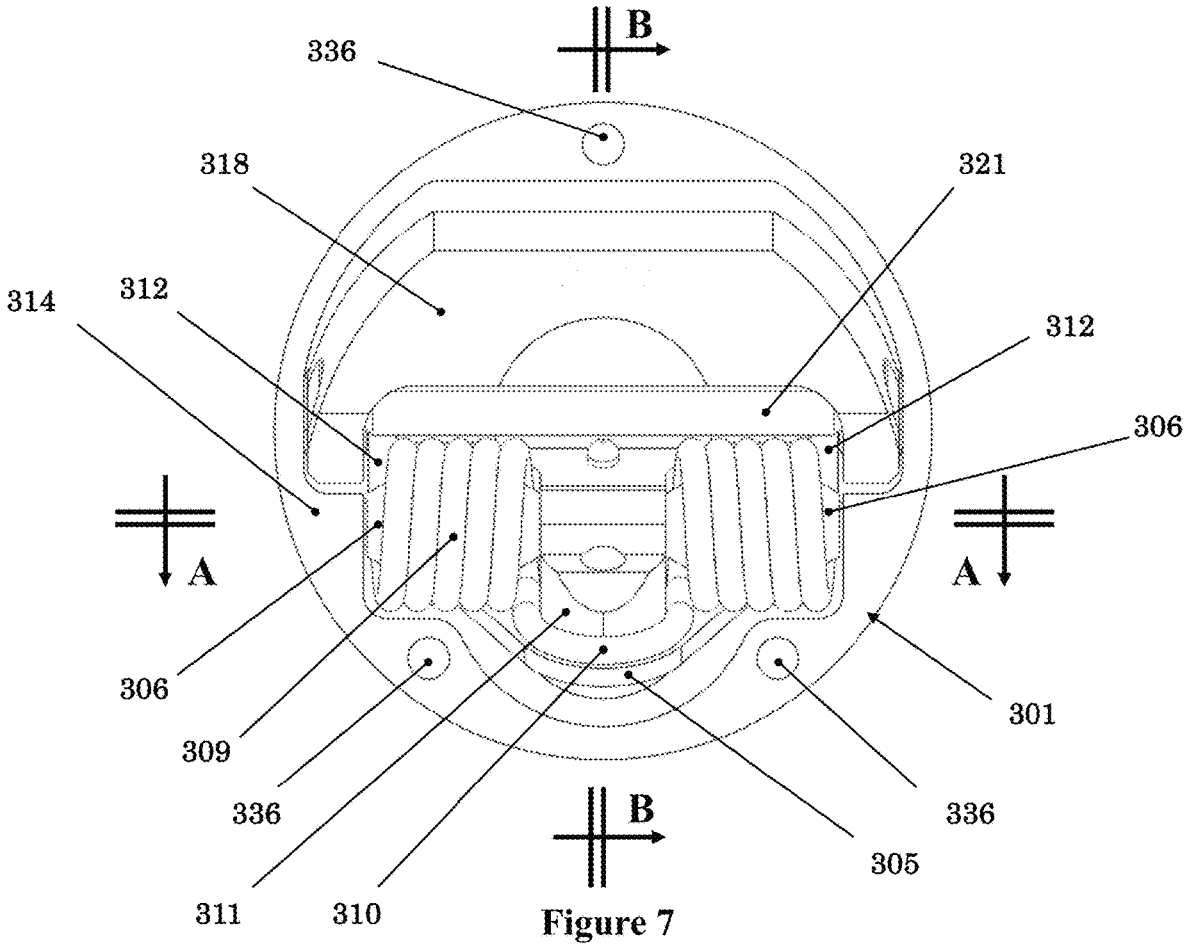
FIG. 7 illustrates a schematic of the top view of the inertial igniter embodiment of FIG. 6 with its cap removed to show the internal components of the device. The striker mass element release arm and its inertial igniter body attached shaft are also removed for clarity.
Figure 8:
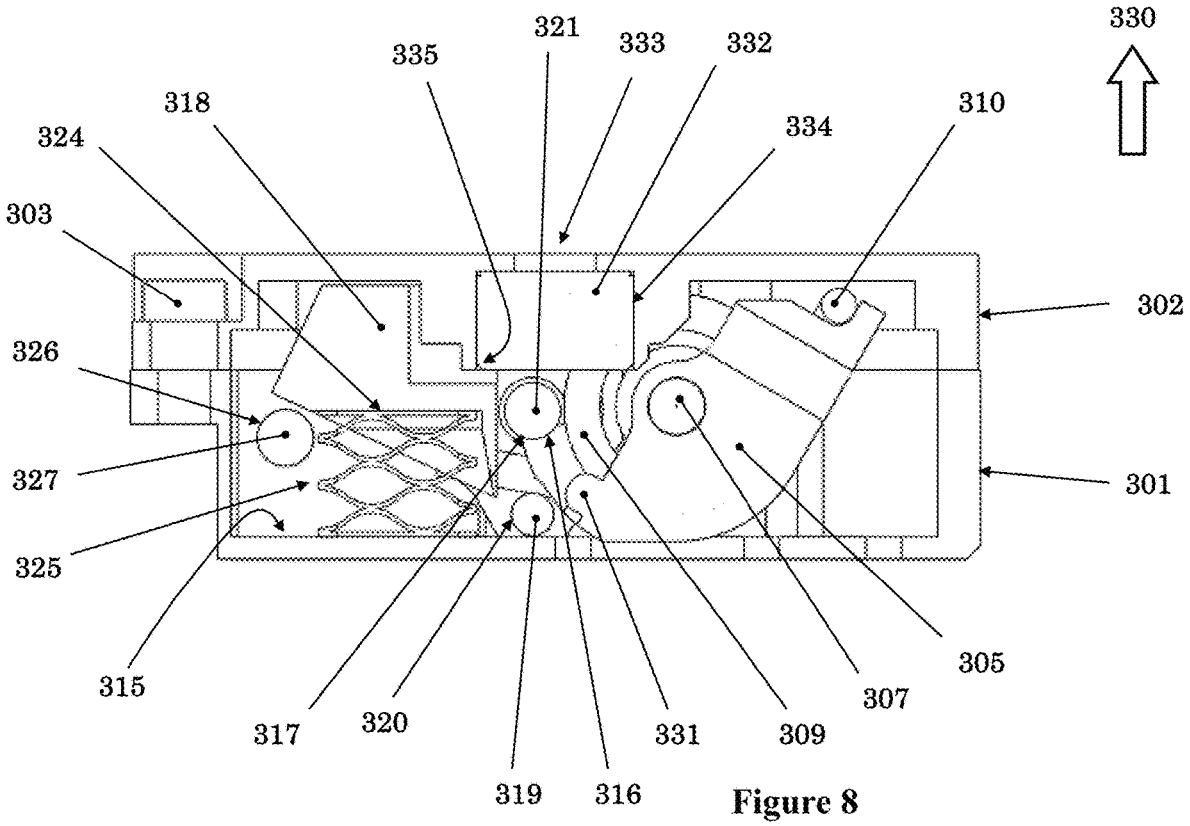
FIG. 8 illustrates a schematic of a cross-sectional view of the inertial igniter embodiment of FIG. 6 in its pre-activation state with the inertial igniter cap assembly removed for clarity.

The top view of the inertial igniter 300 of FIG. 6 with its cap 302 removed is shown in the schematic of FIG. 7. The cross-sectional view B-B (FIG. 7) of the inertial igniter 300 is also shown in the schematic of FIG. 8. In the cross-sectional view of FIG. 8, the cap 302 of the inertial igniter 300 is also shown. In the top view of FIG. 7, the blocking mass, referred to herein as a release lever 318 and its rotary joint pin 319 (shown also in FIG. 6) and striker mass engagement pin 321 as shown engaged with the provided surface on the actuation mass, referred to herein as a striker mass 305 (see also FIG. 8) are shown.

As can be seen in the top view of FIG. 7 of the inertial igniter with the cap 302 removed, the inertial igniter is provided with the striker mass 305, which is rotatable about the axis of the shaft 307, FIG. 8. The striker mass 305 and shaft 307 assembly is shown in the cross-sectional view A-A (see FIG. 7) of FIG. 9. As can be seen in the cross-sectional view A-A of FIG. 9, the striker mass 305 is free to rotate about the shaft 307 by the provided clearance in the passing hole 313 in the body of the striker mass 305. On both sides of the striker mass 305, bushings 306 are provided to essentially fill the gap between the shaft 307 and both wound sides of the torsion spring 309. The bushings 306 are provided with enough clearance with the torsion spring 309 to allow its free rotational movement with minimal friction. The bushings 306 are also provided to constrain radial movement of the torsion spring 309 as it is preloaded and released to activate the inertial igniter as described later in this disclosure.

Figure 9:
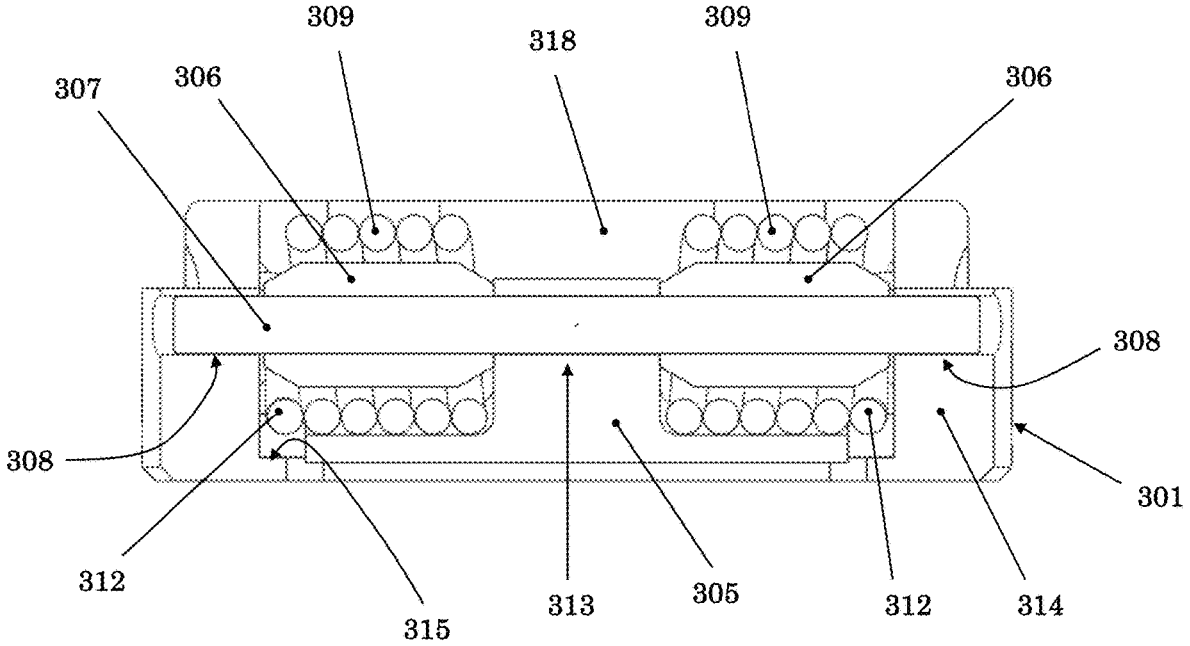
FIG. 9 illustrates the cross-sectional view A-A indicated in the top view of FIG. 7 of the inertial igniter.

The shaft 307 is mounted onto the inertial igniter body 301 through the holes 308 in the wall 314 of the inertial igniter body, FIGS. 6 and 9. The shaft 307 is fitted in the holes 308 tightly to prevent it from sliding out of the inertial igniter body.

The two wound halves of the torsional spring 309 are mounted over the shaft 307 over the sleeves 306 as can be seen in the top view of FIG. 7 and the cross-sectional view of FIG. 9, with the "U" section 310 of the torsion spring 309 engaging the provided mating surface 311 of the striker mass 305 as can be seen in the top view of FIG. 7 and more clearly in the cross-sectional view of FIG. 8. The free legs 312 of the torsion spring 309 rests against the bottom surface 315 as the torsion spring 309 is preloaded in its pre-activation state as shown in the schematic of FIG. 8. Alternatively, the free legs 312 of the torsion spring 309 may be positioned to rest against the inside surface of the cap 302 (not shown).

In the cross-sectional view of the inertial igniter 300 shown in its pre-activation state in FIG. 8, the striker mass release lever 318 and its striker mass engagement pin 321 are shown in their pre-loaded state. It is appreciated by those skilled in the art that in the configuration shown in FIG. 8, the clockwise rotation of the striker mass (as seen in the view of FIG. 8) by the preloaded torsional spring 309 is prevented by the striker mass engagement pin 321 of the release lever 318 as described later in this disclosure. It is noted that in the pre-activation configuration shown in the cross-sectional view of FIG. 8, the free-ends 312 of the torsional spring 309 are pressing against the bottom surface 315 of the inertial igniter body 301 on one end and tending to rotate the striker mass 305 in the clockwise direction about the shaft 307 as viewed in the schematic of FIG. 8 via its "U" shaped portion, which is engaged with matching surfaces 311 of the striker mass 305, on the other end. In the pre-activation configuration of FIG. 8, the striker mass engagement pin 321 of the release lever 318 is shown to prevent clockwise rotation of the striker mass 305 as described below, thereby forcing the striker mass 305 to remain in it illustrated configuration, thereby keeping the torsional spring 306 in its pre-loaded state.

As can be seen in the cross-sectional schematic of FIG. 8, which shows the state of the inertial igniter 300 in its pre-activation state, the inertial igniter is provided with a release lever 318. The release lever 318 is connected to the inertial igniter body 301 via the rotary joint provided by the pin 319 passing through the hole 320 across the length of the release lever 318—along the line perpendicular to the plane of the cross-sectional view of FIG. 8. The pin 319 is firmly mounted in the holes 328 (FIG. 6), while the mating hole 320 in the release lever 318 is provided with minimal clearance to allow for unimpeded rotation (clockwise and counter-clockwise as viewed in the cross-sectional view of FIG. 8). Alternatively, ball bearings or low friction bushings may be used at this joint.

The striker mass engagement pin 321 is mounted onto the release lever 318 as shown in the schematic of FIG. 6, in which the protruding sides 329 of the release lever is provided with the holes 322, in which the striker engagement pin 321 is assembled. In the schematic of FIG. 6, the striker mass engagement pin 321 in shown to be mounted in the provided holes 322 of the release lever 318 via ball bearings 323 to minimize resistance to its rotation relative to the release lever 318. As it is described later in this enclosure, the striker engagement pin 321 rotation relative to the release lever 318 is desired to generate minimal resistance due to friction between their mating surfaces to minimize variation in the inertial igniter activation acceleration levels. It is, however, appreciated by those skilled in the art that in applications in which such igniter activation acceleration level variations can be tolerated, there would be no need for the ball bearings 323. Alternatively, low friction bushings (not shown) may be used in place of the ball bearings 323.

In the pre-activation configuration of the inertial igniter 300 shown in the schematic of FIG. 8, the striker engagement pin 321 of the release lever 318 is shown to be positioned over the provided curved surfaces 316 (FIG. 8 and under pin 321 in FIG. 7), resisting the force applied by the preloaded torsional spring 309 via the striker mass 305, thereby keeping the inertial igniter in its pre-activation state shown in FIG. 8.

The force applied by the striker mass 305 to the striker mass engagement pin 321 via the striker mass surfaces 316 is prevented from rotating the release lever in the counter-clockwise direction and thereby pushing the striker mass engagement pin 321 to the left as seen in the cross-sectional view of FIG. 8, which would then releasing the striker mass 305 to rotate in the clockwise direction by the preloaded torsional spring 309. This is accomplished using one or more of the following methods. The features enabling these methods to maintain the striker mass 305 in its pre-activation state shown in FIG. 8 are also used to design inertial igniters to the prescribed no-fire and all-fire condition requirements of each application.

The first method that can be used to keep the inertial igniter in its pre-activation state is based on the use of the curvature of the striker mass surfaces 316 that engages the striker mass engagement pin 321 of the release lever 318, FIG. 8. In this method, lips 317 are provided on the striker mass surfaces 316 as shown in the schematic of FIG. 8. As a result, for the striker mass engagement pin 321 of the release lever 318 to disengage the striker mass surfaces 316, i.e., to rotate in the counter-clockwise direction as viewed in FIG. 8, the striker mass engagement pin must force rotation of the striker mass 305 in the counter-clockwise direction as viewed in FIG. 8, i.e., it has to increase the preloading level of the torsional spring 309. As a result, the inertial igniter would stay in its pre-activation state shown in FIG. 8.

The second method that can be used to keep the inertial igniter in its pre-activation state is based on the provision of at least one elastic element (spring) element to bias the release lever 318 in the direction of clockwise rotation. As an example, the biasing preloaded compressive spring 325 may be positioned between the release lever 318 and the bottom surface 315 of the inertial igniter body 301 as shown in the schematic of FIG. 8. The spring 325 can be positioned in a pocket 324 to keep from moving out of position. It is appreciated by those skilled in the art that many different spring types may also be used for the indicated clockwise rotation biasing of the release lever 318 as seen in the view of FIG. 8.

It is appreciated by those skilled in the art that that the acceleration of the inertial igniter 300 in the direction of the arrow 330 shown in FIG. 8 would act on the inertia of the release lever 318 and apply a downward force at its center of mass equal to the product of its mass and the acceleration in the direction of the arrow 330, which would tend to rotate the release lever 318 in the counter-clockwise direction. The rotation of the release lever 318 is, however, resisted by the biasing force of the preloaded compressive spring 325 and the required counter-clockwise rotation of the striker mass 305 in order for the striker mass engagement pin 321 to be able to travel leftward due to the rotation of the release lever 318 about the pin 319. It is appreciated that for the pin 319 to move to the left in the direction of releasing the striker mass 305, it must push the lips 317 of the striker mass surfaces 316 downwards, thereby forcing the striker mass 305 to undergo the required amount of counter-clockwise rotation, which would in turn provide resistance to counter-clockwise rotation of the release lever 318.

It is therefore appreciated that the level of acceleration of the inertial igniter 300 that is needed for the release lever 318 to rotate the required amount in the counter-clockwise direction for the striker mass engagement pin 321 to disengage the striker mass 305 and thereby allow it to be freely accelerated in the clockwise direction can be varied by varying one or more of the following parameters to match a prescribed all-fire acceleration level and duration thresholds. The all-fire acceleration level threshold can be reduced by varying one or more of the following inertial igniter parameters: (a) reducing the preloading of the compressive spring 325 and its rate, (b) increasing the moment of inertia of the release lever 318 about the axis of the 319, (c) reducing the extent of the lips 317, i.e., the amount of counter-clockwise rotation of the striker mass 305 that is required for striker mass engagement pin 321 to release the striker mass; and (d) by positing the pin 319 laterally relative to the striker mass engagement pin 321 as viewed in FIG. 8 in the pre-activation configuration of the inertial igniter 300 to minimize the amount of counter-clockwise rotation of the striker mass 305 that is required for the striker mass engagement pin 321 to release the striker mass. The all-fire duration threshold for the activation of the inertial igniter 300 at a prescribed acceleration level can be reduced by varying one or more of the following inertial igniter parameters: (a) by reducing the preloading of the compressive spring 325 and its rate; (b) by increasing the moment of inertia of the release lever 318 about the axis of the 319; and (3) varying the striker mass engagement pin 321 and the striker mass surfaces 316 and the lips 317 geometries to reduce the amount of counter-clockwise rotation of the release lever 318 that is required for the striker mass 305 to be released. The opposite changes in the aforementioned inertial igniter 300 parameters would have the opposite effect.

Now, when the inertial igniter 300 is accelerated in the direction of the arrow 330, FIG. 8, as the prescribed acceleration level threshold and duration is reached, the release lever 318 is rotated in the counter-clockwise direction until the striker mass engagement pin 321 moves far enough to the left and pass over the lips 317, thereby releasing the striker mass 305. At this point, the stored mechanical (potential) energy in the torsional spring 309 would begin to rotationally accelerate the striker mass 305 in the clockwise direction about the axis of the shaft 307. The striker mass 305 is thereby accelerated in the clockwise direction until the percussion pin 331 strikes the percussion primer 332 and causing it to initiate as shown in the cross-sectional view of FIG. 10. It is noted that in the cross-sectional view of FIG. 10, the inertial igniter cap 302 containing the percussion primer 332 with the provided flame exit hole are shown. The release lever 318, FIG. 8, in its released position as indicated by the numeral 337 is also shown in the cross-sectional view of FIG. 10, thereby providing a complete cross-sectional view of the inertial igniter 300 in its post-activation state. In this state, the biasing elastic element (spring) 325, FIG. 8, is shown to be compressively deformed and indicated by the numeral 328.

Figure 10:
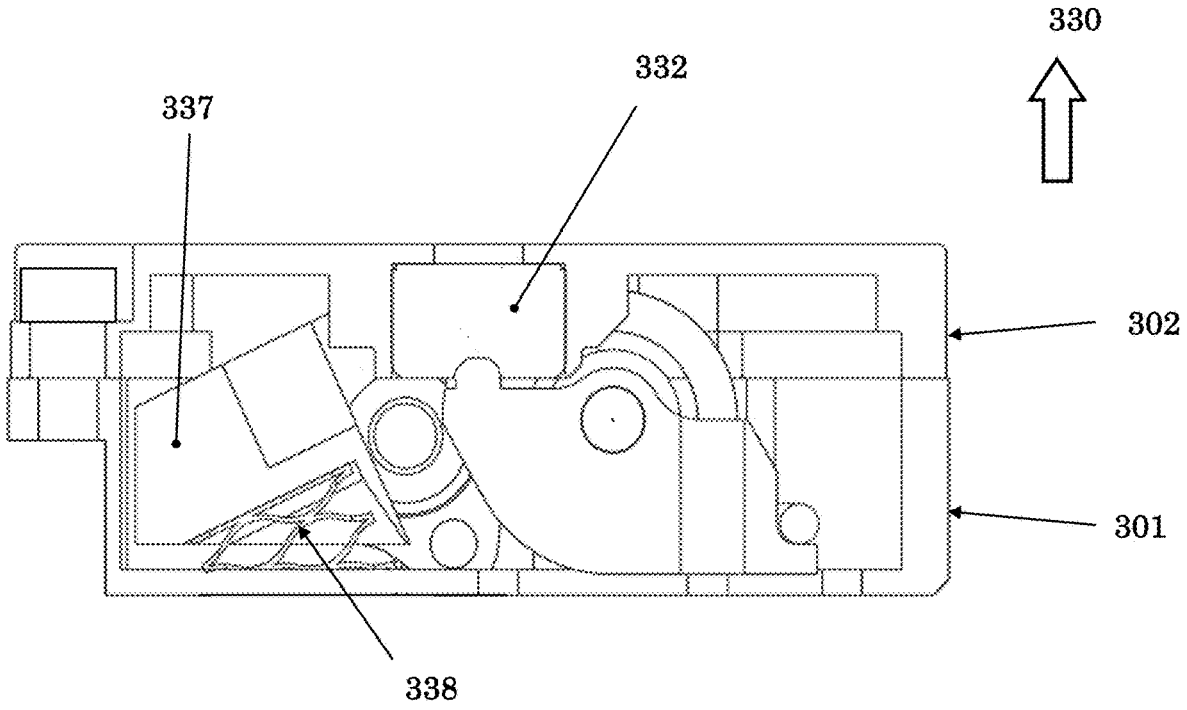
FIG. 10 illustrates the schematic of the cross-sectional view of the inertial igniter embodiment of FIG. 6 in its post-activation state.

Once the percussion primer 332 is initiated, the flames and sparks generated by the initiation of the primer 332 would then exit from the hole 333 in the inertial igniter cap 302, FIGS. 8 and 10. The cross-sectional view of the inertial igniter 300 in this post-activation configuration is shown in FIG. 10. The hole 333 at the center of the cap 302, FIG. 8, is provided for the exiting primer or other pyrotechnic material generated flames and sparks upon the inertial igniter activation as is described below.

It is appreciated by those skilled in the art that the pre-activation torsional preloading level of the torsional spring 309 and its spring rate must be high enough and the range of rotation of the striker mass 305 from its pre-activation (FIG. 8) to its post-activation positions must be large enough so that the striker mass 305 would gain enough kinetic energy after its release so that as it impacts the percussion primer 332 (FIG. 10) as was previously described it would initiate the percussion primer.

In general, it is desirable to provide a "safety pin" that would prevent the inertial igniter 300, FIG. 6, activation prior to assembly due to accidental drops or impacting forces or the like. In the inertial igniter 300, such a safety pin may be provided to prevent the release lever 318 from rotating in the counter-clockwise direction as viewed in FIG. 8 to release the striker mass 305. In this example, a pin 327 is inserted across the base 301 of the inertial igniter 300 through the provided hole 326 in the base as shown in the cross-sectional view of FIG. 8. As can be seen in the FIG. 8, the pin 327 is positioned below and very close to the release lever 318 so that while in place, it would prevent the release lever 318 from rotating in the counter-clockwise direction from its pre-activation position shown in this view, preventing the inertial igniter from being activated, thereby providing its safety functionality. It is appreciated that the safety pin 327 is generally selected to be long so that it would protrude far enough from the assembled inertial igniter body for ease of extraction as well as for preventing accidental assembly into the thermal battery or the like while still in place.

It is appreciated by those skilled in the art that percussion primers are generally required to be compacted and kept firmly in place when assembled in devices such as the present inertial igniters. For this reason and as can be seen in the cross-sectional view of FIG. 8, the primer 332 is assembled into the space 334 in the inertial igniter cap 302, followed by applying the specified compacting pressure on the primer and crimping or staking (not shown) the provided lip 335 to ensure that the primer is firmly held in its assembled position.

Figure 1:
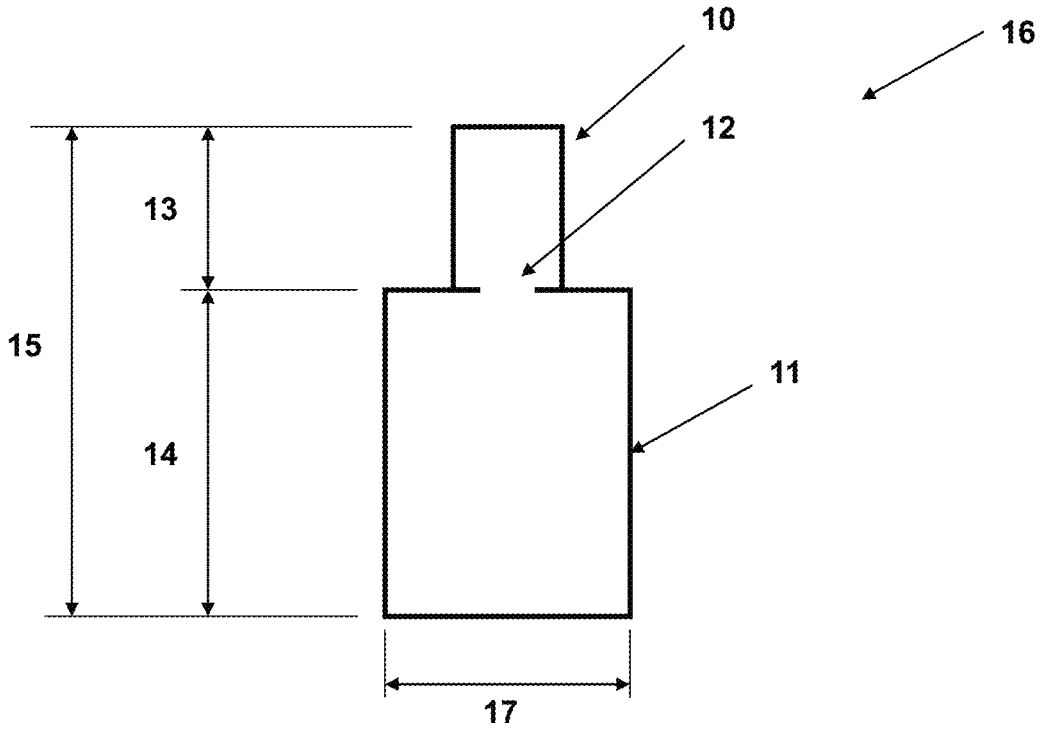
Figure 1 (PRIOR ART)
FIG. 1 illustrates a schematic of a cross-section of a thermal battery and inertial igniter assembly.
Figure 2:
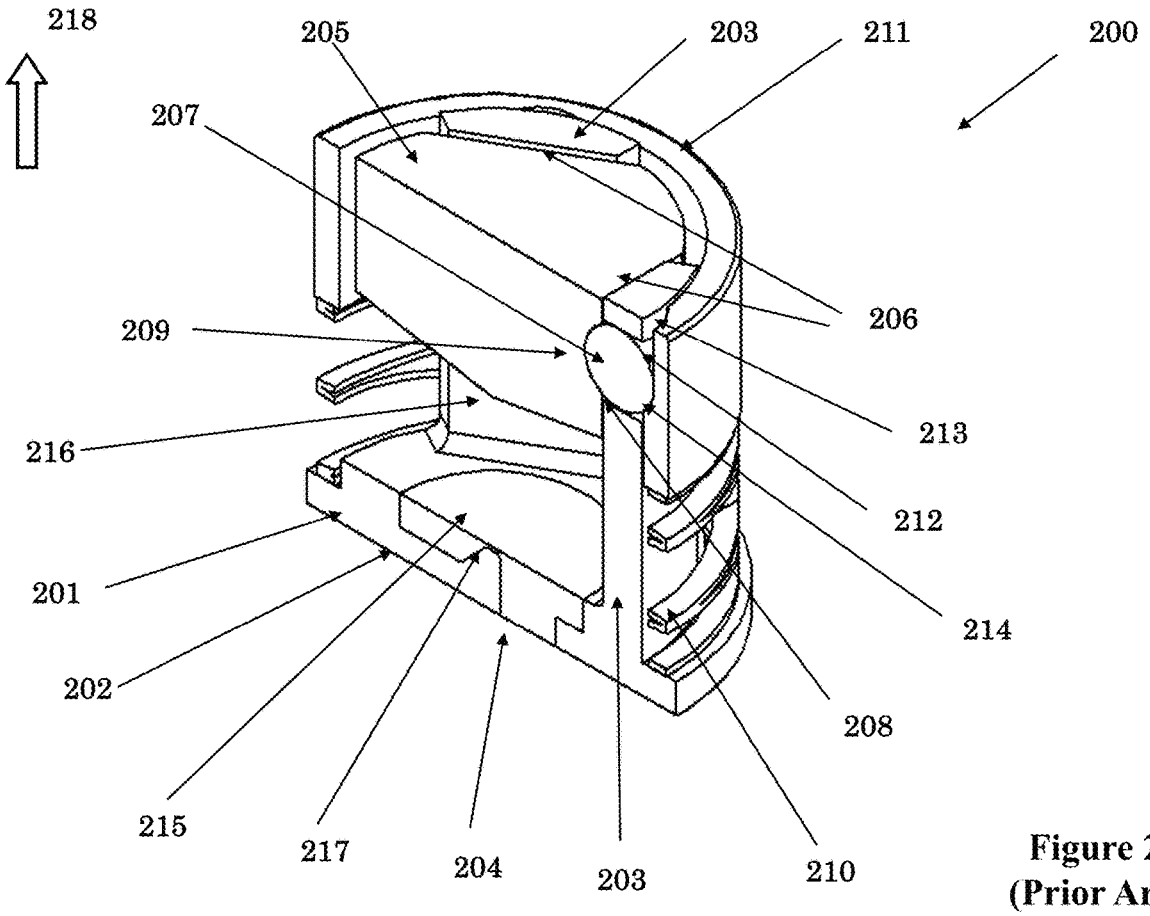
Figure 2 (Prior Art)
FIG. 2 illustrates a schematic of a cross-section of an inertial igniter for thermal battery described in the prior art.
Figure 3:
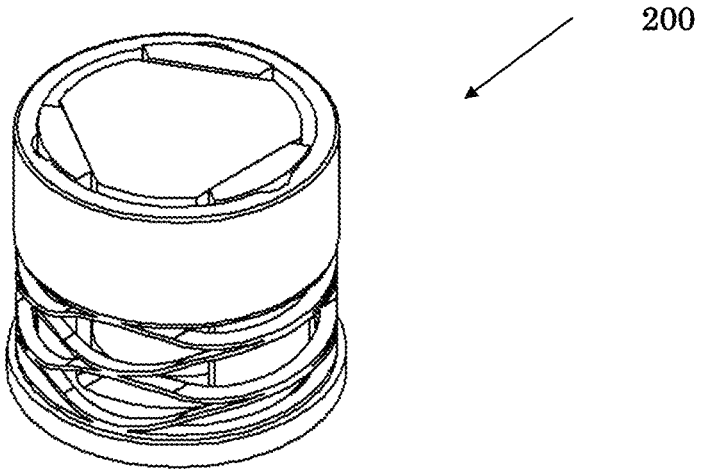
Figure 3 (Prior Art)
FIG. 3 illustrates a schematic of the isometric drawing of the inertial igniter for thermal battery of FIG. 2.
Figure 4A:
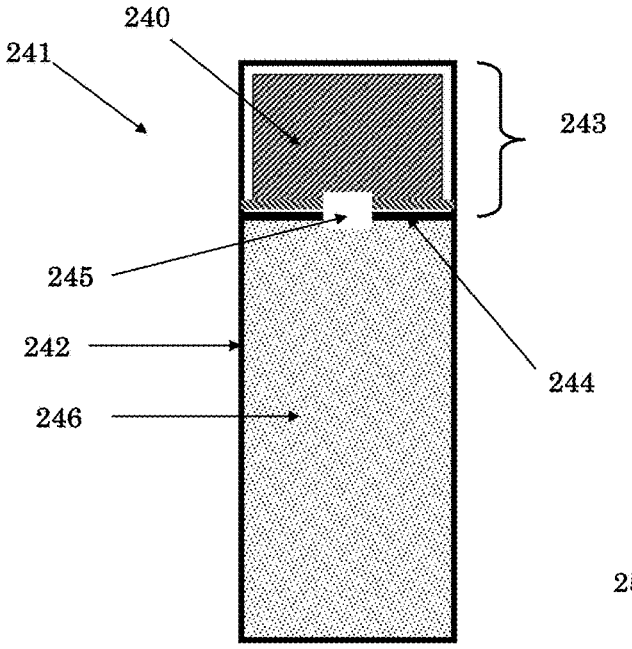
Figure 4a (Prior Art)
FIG. 4*a* illustrates a schematic of a cross-section of a thermal battery with an inertial igniter positioned on the top portion of the thermal battery and in which the ignition generated flame to be directed downwards into the thermal battery compartment.
Figure 4B:
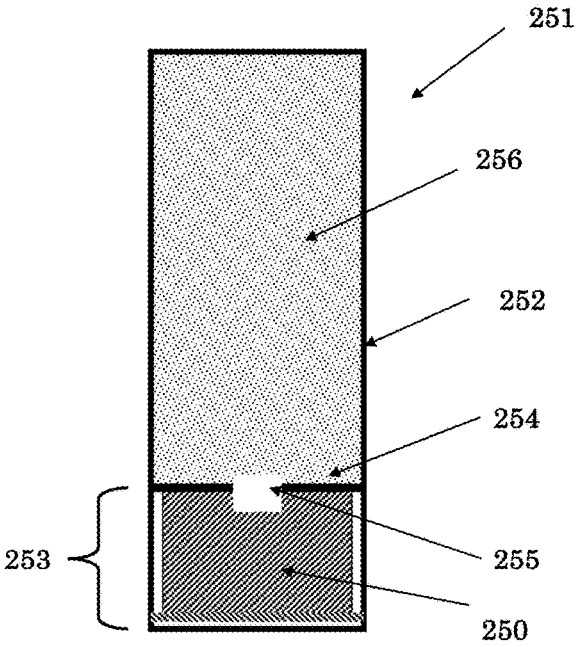
Figure 4b (Prior Art)
FIG. 4*b* illustrates a schematic of a cross-section of a thermal battery with an inertial igniter positioned on the bottom portion of the thermal battery and in which the ignition generated flame to be directed upwards into the thermal battery compartment.
Figure 5:
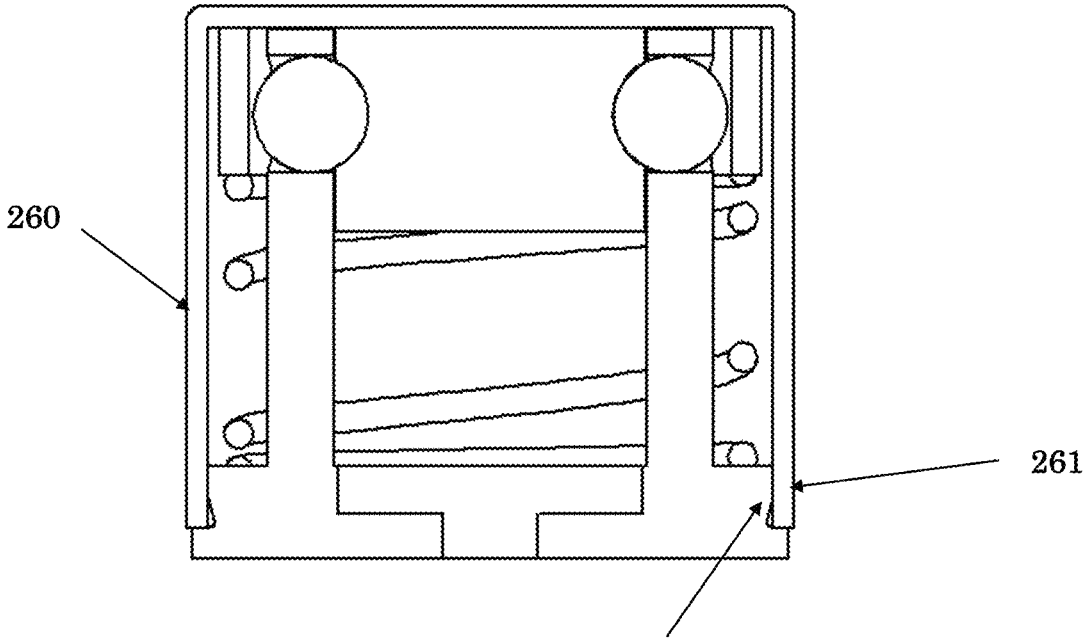
Figure 5 (Prior Art)
FIG. 5 illustrates a schematic of cross-section of an inertial igniter for thermal battery described in prior art with an outer housing.

It is also appreciated by those skilled in the art that in place of the percussion primer 334, pyrotechnic materials such as those based on lead azide or lead styphnate or various lead-free versions may also be applied directly over provided "anvils" such as the one shown in FIG. 2.

In the cross-sectional view of FIG. 8 of the inertial igniter embodiment 300, the release lever biasing elastic element (spring) 325 for keeping the inertial igniter in its pre-activation state is shown to be a helical spring that is positioned between the release lever 318 and the and the bottom surface 315 of the inertial igniter body 301. It is appreciated by those skilled in the art that the clastic (spring) element 325 may also be positioned between the wall of the inertia igniter body and the back of the release lever 318 (not shown). The spring element 325, if of a helical type, can be a wave type spring constructed from flat wire stock to minimize the chances of displacing sideways due to lateral movements and accelerations that may be experienced by the inertial igniter. It is also appreciated by those skilled in the art that many different spring types, such as flat springs working in bending and well known in the art may also be used for this purpose.

Now referring to the cross-sectional view of FIG. 8 of the inertial igniter 300, the inertial igniter is designed to initiate when subjected to the prescribed all-fire condition, i.e., a minimum prescribed acceleration level in the direction of the arrow 330 with a minimum prescribed duration. Then once initiated by the impact of the percussion pin 331 on the percussion primer 332, the ignition flame and sparks generated by the initiation of the primer 332 would exit from the hole 333 in the inertial igniter cap 302, with the activated state of the inertial igniter as shown in FIG. 10. It is, however, appreciated by those skilled in the art that the inertial igniter 300 may be readily configured to discharge the initiated flame and sparks through a hole provided on the bottom side of the inertial igniter 300, i.e., through a hole provided on the opposite side of the hole 333, FIG. 8. This is achieved by configuring an inertial igniter that is the mirror image of the inertial igniter 300 (about a plane perpendicular to the direction of the arrow 330) as seen in the cross-sectional view of FIG. 8.

Figure 11:
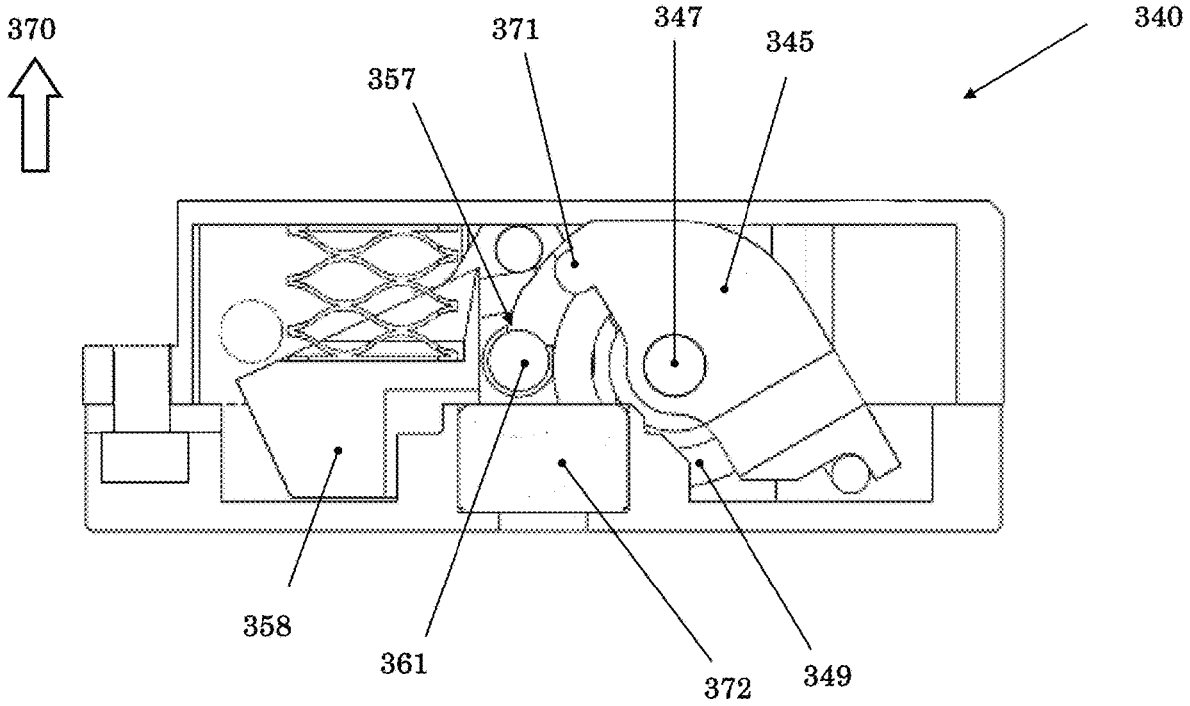
FIG. 11 illustrates a schematic of a cross-sectional view of the second inertial igniter embodiment in its pre-activation state based on a re-configuration of the inertial igniter of FIG. 6 for flame and spark exiting in the opposite direction and with the inertial igniter cap assembly removed for clarity.

The cross-sectional view of such a mirror image configured inertial igniter 340 is shown in the schematic of FIG. 11 in its pre-activation state. The inertial igniter 340 is hereinafter referred to as the second embodiment.

In the inertial igniter embodiment 340 of FIG. 11, all the components of the inertial igniter are similar and with identical features to those of the embodiments 300 shown in FIGS. 6-10, but as their mirror as indicated previously and shown in FIG. 11. Now, when the inertial igniter 340 is accelerated in the direction of the arrow 370, FIG. 11, as the prescribed acceleration level threshold and duration is reached, the release lever 358 (318 in the embodiment of FIGS. 6-10) is rotated in the clockwise direction as viewed in FIG. 11 until the striker mass engagement pin 361 (321 in the embodiment of FIGS. 6-10) moves far enough to the left and pass over the lips 357 (317 in the embodiment of FIGS. 6-10), thereby releasing the striker mass 345 (305 in the embodiment of FIGS. 6-10). At this point, the stored mechanical (potential) energy in the torsional spring 349 (309 in the embodiment of FIGS. 6-10) would begin to rotationally accelerate the striker mass 345 in the counter-clockwise direction about the axis of the shaft 347 (307 in the embodiment of FIGS. 6-10).

Figure 12:
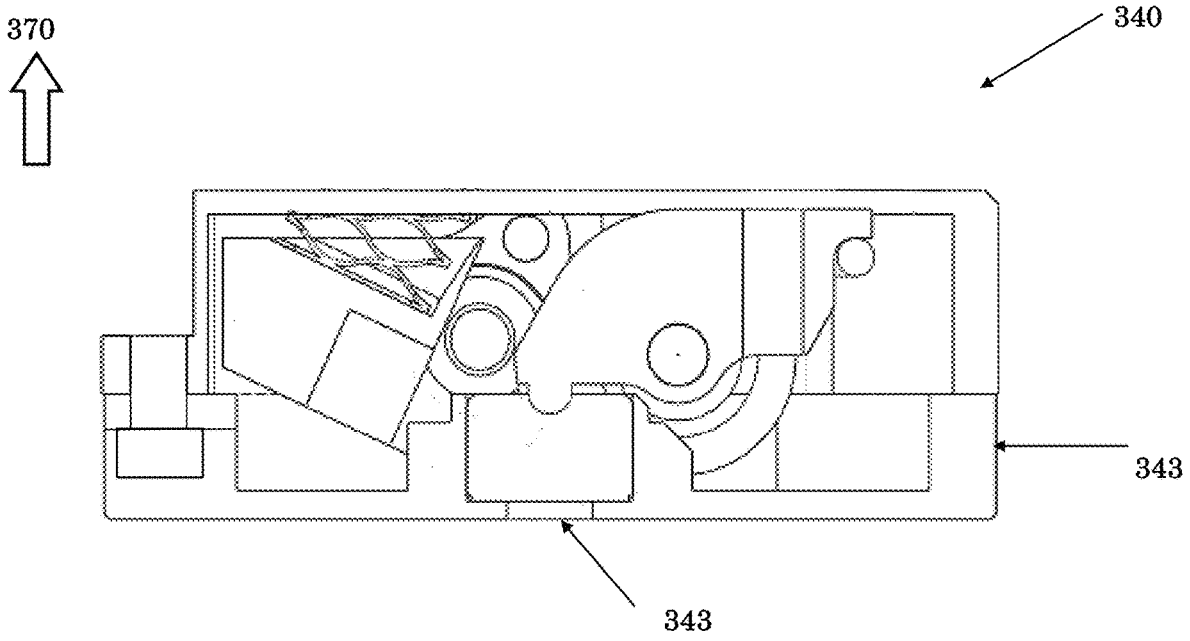
FIG. 12 illustrates the schematic of the cross-sectional view of the inertial igniter embodiment of FIG. 11 in its post-activation state.

The striker mass 345 is thereby accelerated in the counter-clockwise direction until the percussion pin 371 (331 in the embodiment of FIGS. 6-10) strikes the percussion primer 372 (332 in the embodiment of FIGS. 6-10) and causing it to initiate. The post-activation state of the inertial igniter 340 is shown in FIG. 12. The cross-sectional view of FIG. 12 shows a complete view of the inertial igniter 340 in its activated state.

Once the percussion primer 372 is initiated, the flames and sparks generated by the initiation of the primer 372 would exit from the hole 343 (333 in the embodiment of FIGS. 6-10) in the inertial igniter cap 342, FIG. 12.

The embodiments of FIGS. 6-10 and FIGS. 11-12 are designed to initiate a primer when subjected to a prescribed all-fire condition. The basic operating mechanism of these embodiments may also be used to construct normally open (closed) electrical switches that close (open) a circuit when subjected to similar prescribed acceleration shock loading levels and durations as described below for the inertial igniter embodiment of FIGS. 6-10.

In the embodiment of FIGS. 6-10 and FIGS. 11-12, the disclosed inertial igniters are intended to release a striker mass (e.g., the striker mass 305 in the inertial igniter embodiment of FIGS. 6-11) in response to a prescribed all-fire setback acceleration event in the direction of the indicated arrow, FIG. 8, and accelerate the striker mass to impact the provided percussion primer or pyrotechnics materials causing them to ignite. The same mechanism used for the release of the striker mass due to a prescribed all-fire acceleration event (usually a prescribed minimum acceleration level with a prescribed minimum duration, i.e., a prescribed impulse threshold) can be used to provide the means of opening or closing or both of at least one electrical circuit, i.e., act as a so-called "Impulse Switch," that is actuated only if it is subjected to the above prescribed minimum acceleration level as well as its minimum duration (all-fire condition in munitions), while staying inactive during all impulse conditions, even if the acceleration level is higher than the prescribed minimum acceleration level but its duration is significantly shorter than the prescribed duration threshold.

Such "impulse switches" also have numerous non-munitions applications. For example, such impulse switches can be used to detect events such as impacts, falls, structural failure, explosions, etc., and open or close electrical circuits to initiate prescribed actions.

Such "impulse switch" embodiments for opening/closing electrical circuits, with and without latching features, are described herein together with alternative methods of their design, particularly as modular designs that can be readily assembled to the customer requirements.

The disclosed "impulse switches" function like the disclosed inertia igniter embodiments. They similarly comprise of two basic mechanisms so that together they provide for mechanical safety, which can be described as a preloaded delay mechanism, and the switching mechanism, which provides the means to open or close electrical circuits. The function of the safety system is to prevent activation of the switching mechanism until the prescribed minimum acceleration level and minimum duration at the minimum acceleration level has been reached and would only then releases the switching mechanism, thereby allowing it to undergo its actuation motion to open or close the electrical circuit by connecting or disconnecting electrical contacts. The switching mechanism may be held in its activated state, i.e., may be provided with a so-called latching mechanism, or may move back to its pre-activation state after opening or closing the circuit.

The basic design of such impulse switches using the design and functionalities of the disclosed inertial igniter embodiments is herein described using the inertial igniter embodiment of FIGS. 6-11. However, it is appreciated by those skilled in the art that other inertial igniter embodiments may also be similarly modified to function as impulse switches as will be described below for the embodiment of FIGS. 6-11.

Figure 13:
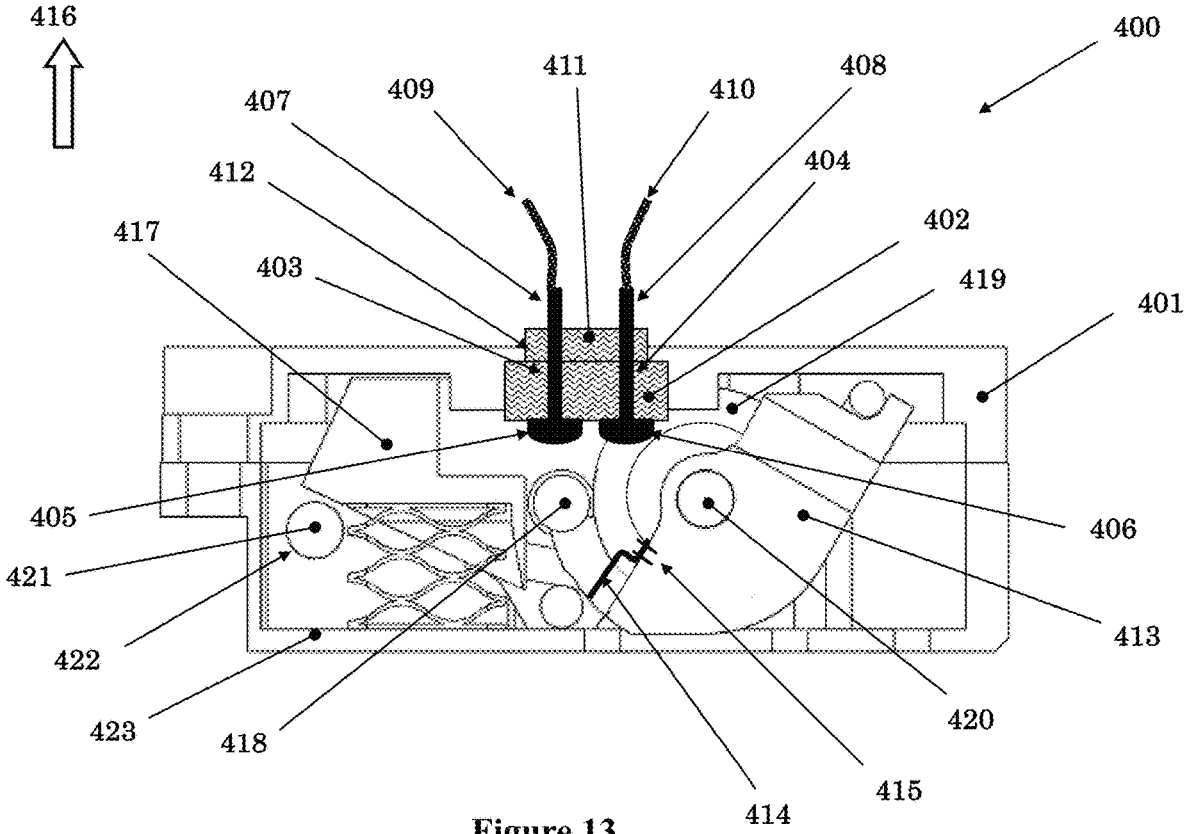
FIG. 13 illustrates a schematic of the cross-sectional view of the normally open impulse switch embodiment for closing electrical circuits when subjected to a prescribed all-fire or the like condition in its non-activated state.

The schematic of such an impulse switch embodiment 400 is shown in FIG. 13. The basic design of the impulse switch 400 is like the inertial igniter embodiment of FIGS. 6-11, except that its primer 332 is removed and its assembly space 334 region of the inertial igniter cap 302, FIG. 8, is modified to assemble the electrical switching contacts and related elements described below to convert the inertial igniter into impulse switches for opening or closing electrical circuits.

In the impulse switch embodiment 400 of FIG. 13, an element 402 which is constructed of an electrically non-conductive material is fixed to the impulse switch cap 401 (cap 302 in the inertial igniter, FIG. 8). The electrically non-conductive element 402 may be attached to the cap 401 by fitting its smaller diameter top portion 411 through the hole 412 in the cap 401. The element 402 is provided with two electrically conductive elements 403 and 404 with contact ends 405 and 406, respectively. The electrically conductive elements 403 and 404 may be provided with the extended ends 407 and 408, respectively, to form contact "pins" for direct insertion into provided holes in a circuit board or may alternatively be provided with wires 409 and 410 for connection to appropriate circuit junctions, in which case, the wires 409 and 410 may be desired to exit from the sides of the impulse switch 400 (not shown).

Previously described (striker) element 413 (element 305 in the inertial igniter 300, FIG. 8) is provided with a flexible strip of electrically conductive material 414, which is fixed to the surface of the element 413 as shown in FIG. 13, for example, with fasteners 415 or by soldering or other methods known in the art.

The basic operation of the impulse switch 400 of FIG. 13 is very similar to that of the inertial igniter 300 of FIGS. 6-11. Here again and as was described for the inertial igniter 300, when the impulse switch 400 is accelerated in the direction of the arrow 416, FIG. 13, as the prescribed acceleration level threshold and duration is reached, the release lever 417 is rotated in the counter-clockwise direction until the striker mass engagement pin 418 (pin 321 in FIG. 8) moves far enough to the left to release the striker mass 413 as was described for the inertial igniter 300.

At this point, the stored mechanical (potential) energy in the preloaded torsional spring 419 would begin to rotationally accelerate the striker mass 413 (305 in FIG. 8) in the clockwise direction about the axis of the shaft 420 (307 in FIG. 8). The striker mass 413 is thereby accelerated in the clockwise direction until the strip of the electrically conductive material 414 (replacing the percussion pin 331 in FIG. 8) comes into contact with the contact ends 405 and 406, thereby closing the circuit to which the impulse switch 400 is connected (through the extended ends 407 and 408 or wires 409 and 410) as shown in the cross-sectional view of FIG. 14.

Figure 14:
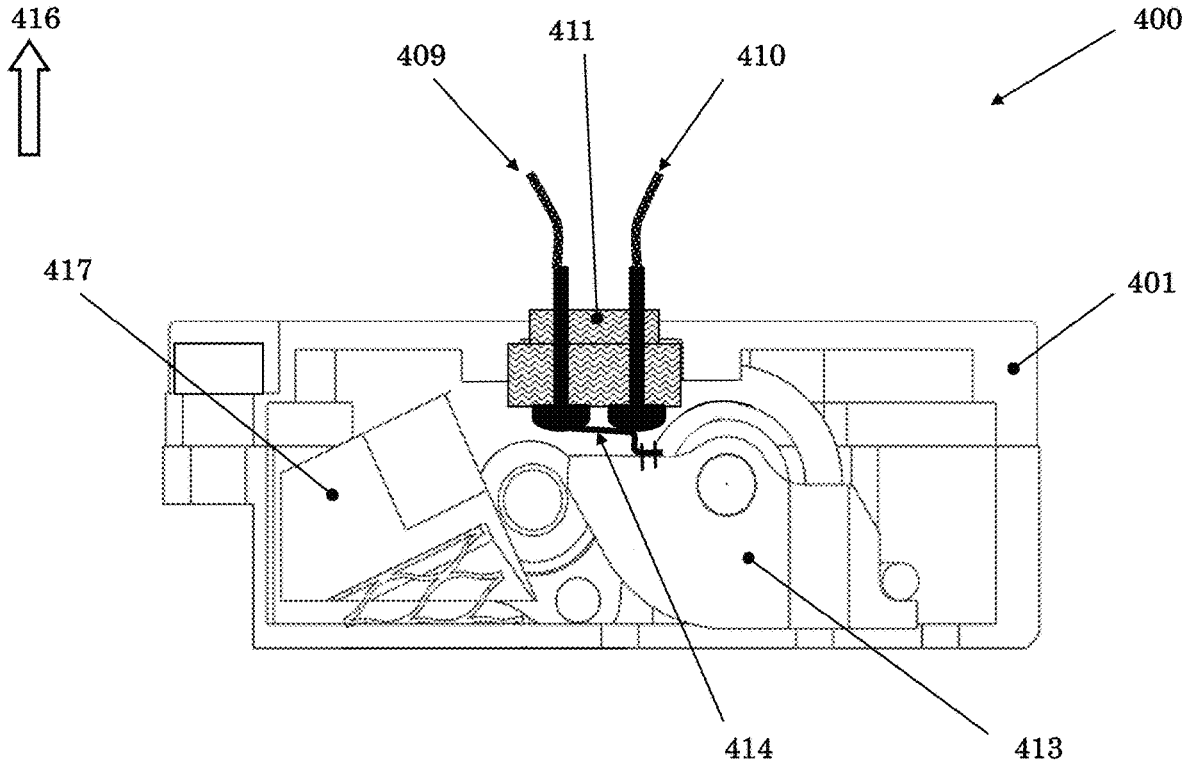
FIG. 14 illustrates a schematic of the cross-sectional view of the normally open impulse switch embodiment of FIG. 13 for closing electrical circuits in its activated state after having been subjected to a prescribed all-fire or the like condition.

It is noted that in the cross-sectional view of FIG. 14, the impulse switch cap 401 with the assembled electrically non-conductive element 402 and the aforementioned electrical contact elements provide a complete cross-sectional view of the normally open impulse switch 400 in its post activation to close the circuit to which it is connected.

It is appreciated by those skilled in the art that the impulse switch 400 of FIG. 13 is a "normally open impulse switch" and once activated due to the prescribed minimum acceleration level threshold (in the direction of the arrow 416) with the prescribed minimum duration, it would close the circuit to which it is connected as described above.

It is also appreciated by those skilled in the art that the impulse switch 400 of FIG. 13 is a latching type, i.e., after activations and closing the connected circuit, the impulse switch keeps the circuit closed. The impulse switch 400 may also be designed as a "normally open impulse switch" that is of a non-latching type. To make the impulse switch 400 into a "latching normally open impulse switch" type, the level of preload in the torsional spring 419 is selected such that once the impulse switch is activated as shown in its activated state in the cross-sectional view of FIG. 14, the torsional spring 419 still retains enough level of preload to bias it towards rotating the striker mass 413 in the clockwise direction, thereby keeping the strip of the electrically conductive material 414 in contact with the contact ends 405 and 406, thereby keeping the circuit to which the impulse switch 400 is connected closed, i.e., the state shown in FIG. 14. The resulting impulse switch would thereby become a normally open and latching impulse switch.

The impulse switch 400 may also be designed as a "non-latching and normally open impulse switch" type. To this end, the level of preload in the torsional spring 419 is selected such that once the impulse switch is activated as was previously described, the torsional spring 419 passes its free (no-load) configuration as it rotates the striker mass 413 in the clockwise direction and before the strip of the electrically conductive material 414 encounters the contact ends 405 and 406. With such a preloading level of the torsional spring 419 in its pre-activation state of FIG. 13, the striker mass 413 is accelerated in the clockwise direction upon impulse switch activation as was previously described, and due to the kinetic energy stored in the striker mass 413, it would rotate in the clockwise direction passed the free (no-load) configuration of the torsional spring 419, close the circuit—by the strip of the electrically conductive material 414 coming into contact with the contact ends 405 and 406—but the striker mass 413 is then rotated back in the counter-clockwise direction by the torsional spring 419 to its free (no-load) configuration. The circuit to which the impulse switch 400 is connected is thereby opened after a momentary closing. The resulting impulse switch would thereby become a normally open and non-latching impulse switch.

Figure 15:
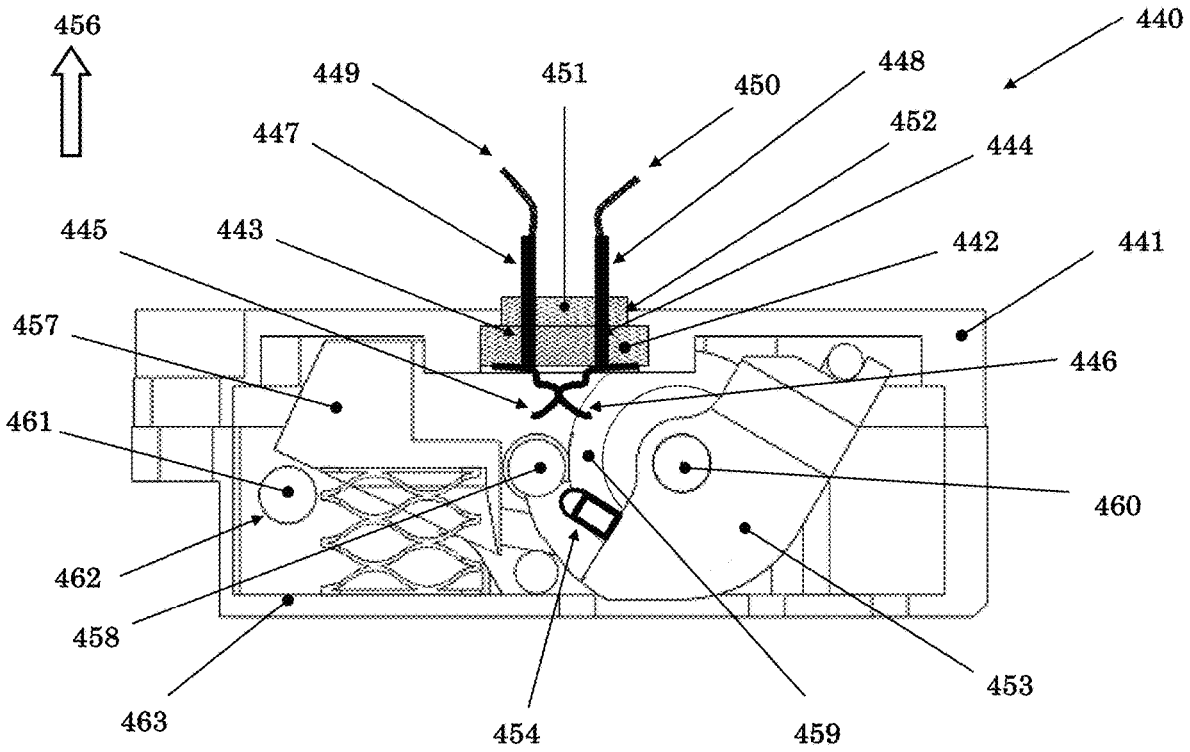
FIG. 15 illustrates a schematic of the cross-sectional view of the normally closed impulse switch embodiment for opening electrical circuits when subjected to a prescribed all-fire or the like condition in its non-activated state.

The normally open impulse switch 400 of FIGS. 13 and 14 may also be modified to function as a normally closed impulse switch. The schematic of such a normally closed impulse switch embodiment 440 is shown in FIG. 15. The basic design and operation of the impulse switch 440 is identical to that of the normally open impulse switch embodiment 400 of FIGS. 13 and 14, except for its electrical switching contacts and related elements described below to convert it from a normally open to a normally closed impulse switch.

In the normally closed impulse switch embodiment 440 of FIG. 15, like the normally open impulse switch 400 of FIG. 13, an element 442, which is constructed of an electrically non-conductive material is fixed to the impulse switch cap 441 (cap 302 in the inertial igniter, FIG. 8). The electrically non-conductive element 442 may be attached to the cap 441 by fitting its smaller diameter top portion 451 through the hole 452 in the cap 441. The element 442 is provided with two electrically conductive elements 443 and 444 with flexible contact ends 445 and 446, respectively. The flexible electrically conductive contact ends 445 and 446 are biased to press against each other as seen in the schematic of FIG. 15. As a result, a circuit connected to the electrically conductive elements 443 and 444 is normally closed in the pre-activation state of the impulse switch 440 as shown in the configuration of FIG. 15.

The electrically conductive elements 443 and 444 may be provided with the extended ends 447 and 448, respectively, to form contact "pins" for direct insertion into provided holes in a circuit board or may alternatively be provided with wires 449 and 450 for connection to appropriate circuit junctions, in which case, the wires 449 and 450 may be desired to exit from the sides of the impulse switch 440 (not shown).

The previously described (striker) element 453 (element 305 in the inertial igniter 300, FIG. 8) is then provided with an electrically nonconductive wedge element 454, which is fixed to the surface of the element 453 as shown in FIG. 15, for example, by an adhesive or using other fastener methods known in the art.

The basic operation of the impulse switch 440 of FIG. 15 is very similar to that of the inertial igniter 300 of FIGS. 6-10. Here again and as was described for the inertial igniter 300, when the impulse switch 440 is accelerated in the direction of the arrow 456, FIG. 15, as the prescribed acceleration level threshold and duration is reached, the release lever 457 is rotated in the counter-clockwise direction until the striker mass engagement pin 458 (pin 321 in FIG. 8) moves far enough to the left to release the striker mass 453 as was described for the inertial igniter 300.

Figure 16:
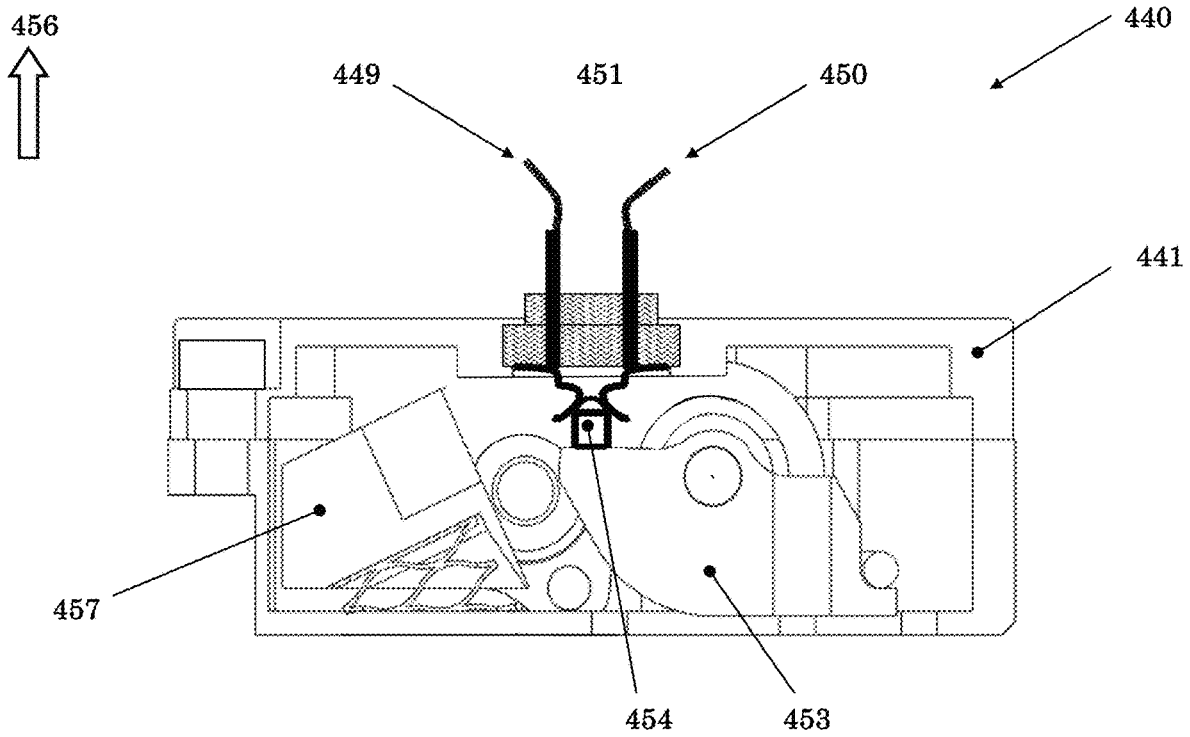
FIG. 16 illustrates a schematic of the cross-sectional view of the normally closed impulse switch embodiment of FIG. 15 for opening electrical circuits in its activated state after having been subjected to a prescribed all-fire or the like condition.

At this point, the stored mechanical (potential) energy in the preloaded torsional spring 459 would begin to rotationally accelerate the striker mass 453 (305 in FIG. 8) in the clockwise direction about the axis of the shaft 460 (307 in FIG. 8). The striker mass 453 is thereby accelerated in the clockwise direction until the electrically nonconductive wedge element 454 (replacing the percussion pin 331 in FIG. 8) is inserted between the contacting surfaces of the flexible electrically conductive contact ends 445 and 446, thereby opening the circuit to which the impulse switch 440 is connected (through the extended ends 447 and 448 or wires 449 and 450) as shown in the cross-sectional view of FIG. 16.

It is noted that in the cross-sectional view of FIG. 15, the impulse switch cap 441 with the assembled electrically non-conductive element 442 and the aforementioned electrical contact elements is shown to provide a complete cross-sectional view of the impulse switch 440.

It is appreciated by those skilled in the art that the impulse switch 440 of FIG. 15 is a "normally closed impulse switch" and once activated due to a prescribed minimum acceleration level threshold (in the direction of the arrow 456) with the prescribed minimum duration event, it would open the circuit to which it is connected as described above.

It is appreciated by those skilled in the art that the impulse switch 440 of FIG. 15 is a latching type, i.e., after activation and opening the connected circuit, the impulse switch keeps the circuit open. The impulse switch 440 may also be designed as a "normally closed impulse switch" that is of a non-latching type. To make the impulse switch 440 into a "latching normally closed impulse switch" type, the level of preload in the torsional spring 459 is selected such that once the impulse switch is activated as shown in its activated state in the cross-sectional view of FIG. 16, the torsional spring 459 still retains an enough level of preload to bias it towards rotating the striker mass 453 in the clockwise direction, thereby keeping the electrically nonconductive wedge element 454 between the contacting surfaces of the flexible electrically conductive contact ends 445 and 446, thereby keeping the connected circuit open as shown in the cross-sectional view of FIG. 16.

The impulse switch 440 may also be designed as a "non-latching and normally open impulse switch" type. To this end, the level of preload in the torsional spring 459 is selected such that once the impulse switch is activated as was previously described, the torsional spring 459 passes its free (no-load) configuration as it rotates the striker mass 453 in the clockwise direction and before the electrically nonconductive wedge element 454 reaches the contacting surfaces of the flexible electrically conductive contact ends 445 and 446. By a proper selection of the preloading level of the torsional spring 449 in its pre-activation state of FIG. 15, the striker mass 453 is accelerated in the clockwise direction upon impulse switch activation as was previously described, and due to the kinetic energy stored in the striker mass 453, it would rotate in the clockwise direction passed the free (no-load) configuration of the torsional spring 459, open the circuit by partial insertion of the electrically nonconductive wedge element 454 between the contacting surfaces of the flexible electrically conductive contact ends 445 and 446. The striker mass 453 is then rotated in the counter-clockwise direction by the torsional spring 459 to its free (no-load) configuration. The circuit to which the impulse switch 440 is connected is thereby closed after being momentary opened.

In general, it is also desirable to provide a "safety pin" that would prevent the impulse switch 400 (440), FIG. 13 (15) activation prior to assembly due to accidental drops or impacting forces or the like. In the impulse switch 400 (440), like the inertial igniter 300 of FIGS. 6-11, such a safety pin may be provided to prevent the release lever 417 (457) from rotating in the counter-clockwise direction as viewed in FIG. 13 (15) to release the striker mass 413 (453). In this example, a pin 421 (461) is inserted across the base 423 (463) of the of the impulse switch through the provided hole 422 (462) in the base as shown in the cross-sectional view of FIG. 13 (15). As can be seen in the FIG. 13 (15), the pin 421 (461) is positioned below and very close to the release lever 417 (457) so that while in place, it would prevent the release lever from rotating in the counter-clockwise direction from its pre-activation position shown in this view and thereby preventing the impulse switch from being activated, thereby providing its safety functionality. It is appreciated that the safety pin 421 (461) is generally selected to be long so that it would protrude far enough from the assembled impulse switch body for ease of extraction as well as for preventing accidental assembly into the intended device while still in place.

As can be seen in FIGS. 8 and 11, in both embodiments the percussion primer 332 and 372, respectively, are located inside the inertial igniter housings. In some applications, however, a percussion primer that is mounted on another object to which the inertial igniter is attached is to be initiated. In such applications, the percussion pin (331 and 371 in FIGS. 8 and 11, respectively) must be designed to extend out of the inertial igniter housing and strike the percussion primer with the required impact energy. To this end, as it is described below, the inertial igniters of FIGS. 8 and 11 may be modified to perform the indicated task.

Figure 17:
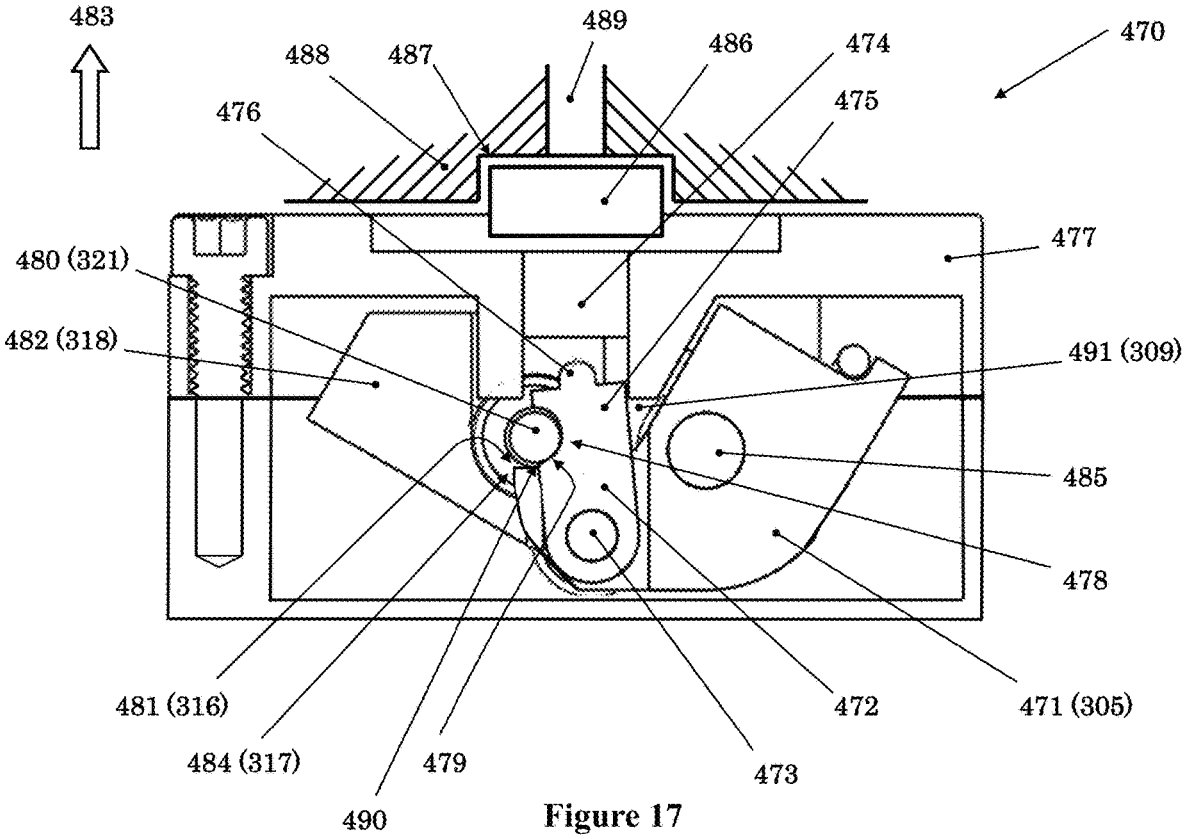
FIG. 17 illustrates a cross-sectional view of the modified inertial igniter embodiment of FIG. 6 in its pre-activation state for initiating percussion primers positioned exterior to the inertial igniter housing.

The modifications made to the embodiment shown in FIGS. 6-12 to initiate percussion caps positioned outside of the inertial igniter housing are illustrated in the cross-sectional view of the modified inertial igniter embodiment 470 shown in FIG. 17. In FIG. 17, the embodiment 470 is shown in its pre-activation state. Hereinafter, only the modifications made to the embodiment of FIGS. 6-12 are described and the remaining components and functionalities are essentially the same as those of the embodiment of FIGS. 6-10.

In the embodiment 470 shown in FIG. 17, the first modification is made to the striker mass 305 to provide the means of extending the reach of the percussion pin (331 and 371 in FIGS. 8 and 11, respectively), outside of the inertial igniter 470 housing. To this end, the striker mass 305, indicated in FIG. 17 with the numeral 471, is provided with a link 472, which is attached to the striker mass with a rotary joint 473. As can be seen in FIG. 17, the link 472 is attached on one end to the striker mass through the joint 473, while its other end 475 is constrained to move up as seen in the view of FIG. 17 in the pathway 474, which is provided in the modified cap 477 component of the inertial igniter 470. The end 475 is provided with the percussion pin tip 476, to function as the percussion pins 331 and 371 in FIGS. 8 and 11, respectively.

In this embodiment 470, the inertial igniter may be held in its pre-activation state like the embodiment 300 (FIGS. 6-8), i.e., by the engagement of the striker mass engagement pin 321 (480 in the embodiment 470 of FIG. 17) against the striker mass surfaces 316 (481 in the embodiment 470 of FIG. 17) as was described for the embodiment 300 (FIGS. 6-8). Alternatively, the striker mass engagement pin 480 may be made to engage the surface 472 provided in the cutout 478 on the link 472 as shown in FIG. 17.

Figure 18:
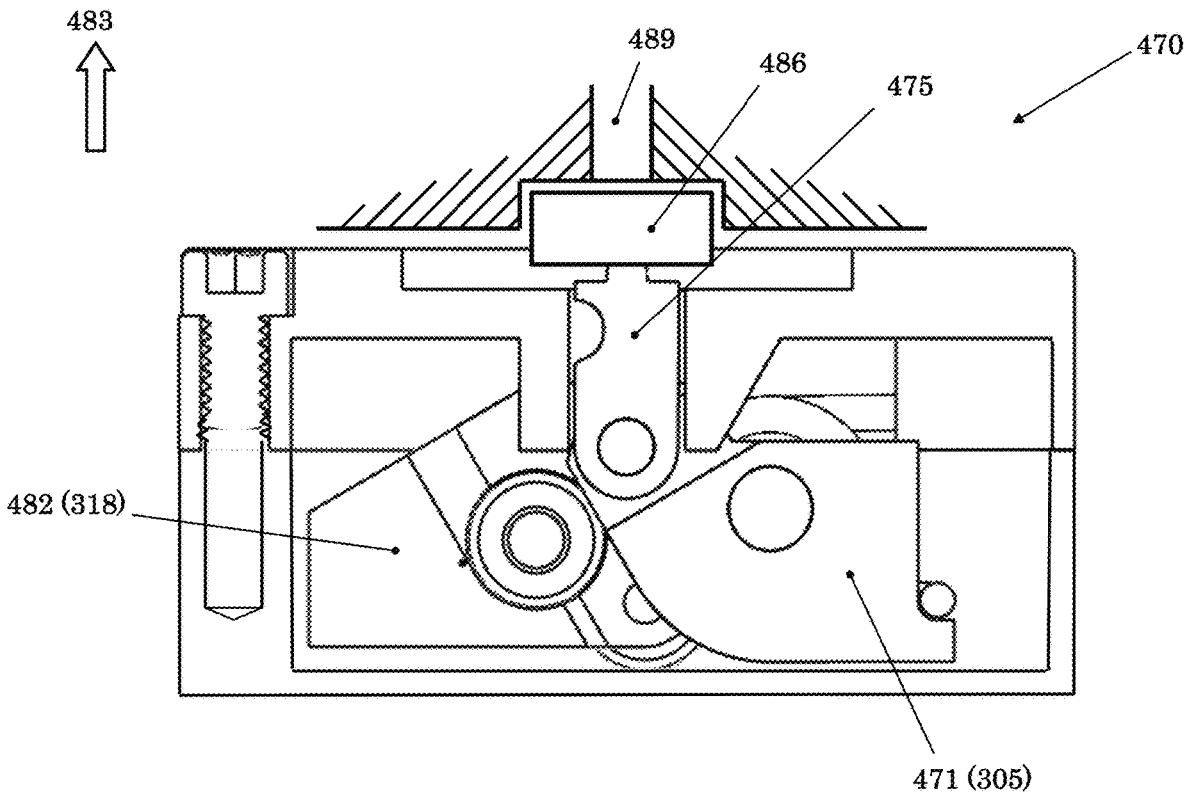
FIG. 18 illustrates the schematic of the cross-sectional view of the inertial igniter embodiment of FIG. 17 in its post-activation state.

It is noted that for the sake of clarity, the biasing preloaded compressive spring 325 (FIG. 8), which is positioned between the release lever 318 (482 in FIGS. 17 and 18) and the bottom surface of the inertial igniter body is not shown in FIGS. 17 and 18.

It is appreciated by those skilled in the art that as was previously described for the embodiment 300 regarding the shape and inclination of the surfaces 316 of the striker mass surfaces, by varying the position and inclination of the surface 316, the amount of counter-clockwise torque that is required to rotate the release lever 318 to release the striker mass 305, i.e., the level of acceleration in the direction of the arrow 330 required to activate the inertial igniter, is varied. The same process may be used to vary the level of acceleration in the direction of the arrow 483 that is required to activate the inertial igniter 470 of FIG. 17 when the surface 481 of the striker mass 471 is used to engage the striker mass engagement pin 480. When the surface 479 of the link 472 is used against the striker mass engagement pin 480 to keep the inertial igniter 470 in its pre-activation state, similar changes in the position and inclination of the surface 479 of the link 472 can be used to vary the level of acceleration in the direction of the arrow 483 that is required to activate the inertial igniter 470. It is appreciated that in the latter case, the portion of the striker mass 471 containing the surfaces 481 is eliminated to prevent its interference with the striker mass engagement pin 480.

Now, similar to the inertial igniter 300 of FIGS. 6-10, when the inertial igniter 470 is accelerated in the direction of the arrow 483, FIG. 17, as the prescribed acceleration level threshold and duration is reached, the release lever 482 is rotated in the counter-clockwise direction until the striker mass engagement pin 480 moves far enough to the left and pass over the lip 484 (317 in FIG. 8) or the lip 490 of the link 472 (when the link 472 is used to keep the striker mass 471 in its pre-activation state), thereby releasing the striker mass 471 (305 in FIG. 8). At this point, the stored mechanical (potential) energy in the torsional spring 491 (309 in FIGS. 6-9) would begin to rotationally accelerate the striker mass 471 in the clockwise direction about the axis of the shaft 485. The striker mass 471 is thereby accelerated in the clockwise direction, also accelerating the link 472 upwards in the direction of the arrow 483 inside the pathway 474 of the modified cap 477, until the percussion pin 476 (331 in the embodiment of FIG. 8) strikes the percussion primer 486 and causing it to initiate as shown in the cross-sectional view of FIG. 18.

It is appreciated that in FIG. 17, the percussion primer 486 is shown to be mounted in the housing 487 provided in the body 488 of an external object (not shown) to which the inertial igniter 470 is attached. The body 488 is also seen to be provided with a passage 489 for the flame and sparks generated by the initiation of the percussion primer 486 to exit.

The cross-sectional view of the inertial igniter 470 in this post-activation configuration is shown in FIG. 18.

It is appreciated that like the inertial igniter 300 shown in FIGS. 6-10, the inertial igniter 470 is designed to initiate when subjected to the prescribed all-fire condition, i.e., a minimum prescribed acceleration level in the direction of the arrow 483, FIG. 17, with a minimum prescribed duration. Then once initiated by the impact of the percussion pin 476 on the percussion primer 486, the ignition flame and sparks generated by the initiation of the primer 486 would exit from the hole 489 provided in the object to which the inertial igniter is firmly attached. It is, however, appreciated by those skilled in the art that the inertial igniter 470 may be readily configured to discharge the initiated flame and sparks through a hole provided on the bottom side of the inertial igniter 470, i.e., through a hole provided on the opposite side of the hole 487, FIG. 17. This is achieved by configuring an inertial igniter that is the mirror image of the inertial igniter 470 (about a plane perpendicular to the direction of the arrow 483) as seen in the cross-sectional view of FIG. 17, as was described for the inertial igniter 300 of FIGS. 6-10, the corresponding inertial igniter embodiment 340 of which is shown in the schematic of FIG. 11 in its pre-activation state.

The same mechanism used for the release of the striker mass due to a prescribed all-fire acceleration event (usually a prescribed minimum acceleration level with a prescribed minimum duration, i.e., a prescribed impulse threshold) was previously shown that can be used to provide the means of opening or closing or both of at least one electrical circuit, i.e., act as a so-called "Impulse Switch", that is to be actuated only if it is subjected to the above prescribed minimum acceleration level as well as its minimum duration (all-fire condition in munitions), while staying inactive during other impulse conditions, even if the acceleration level is higher than the prescribed minimum acceleration level but its duration is significantly shorter than the prescribed duration threshold. Such conversions of the inertial igniter 300 of FIGS. 6-10 to normally open and normally closed impulse switches were illustrated in the schematics of FIGS. 13-16. It is appreciated by those skilled in the art that the inertial igniter 470 of FIG. 17 may also be similarly converted to a normally open impulse switch, FIGS. 13-14, and a normally closed impulse switch, FIGS. 15-16.

It is appreciated by those skilled in the art that in thermal and other reserve batteries that use inertial igniters, it is highly desirable to have the capability of determining if the initiator has activated or not, for example after an accidental drop. In certain cases, the inertial igniter has activated but the reserve battery has failed to activate. In yet another case, the inertial igniter may have been activated but the percussion primer or other pyrotechnic material that is used may have not been ignited. In short, it is highly desirable for the reserve battery user to be able to determine the status of the battery without having to perform x-ray or other complicated and expensive testing. In addition, in certain applications, it is highly desirable for the munitions and/or the weapon system control system to be able to obtain the above battery status information for optimal operation and safety. To this end, the inertial igniter embodiments may be readily equipped to perform the above tasks as described below by an example of the required modifications to the embodiment 300 of FIGS. 6-10. The remaining embodiments may be similarly modified to perform the described functionality.

Figure 19:
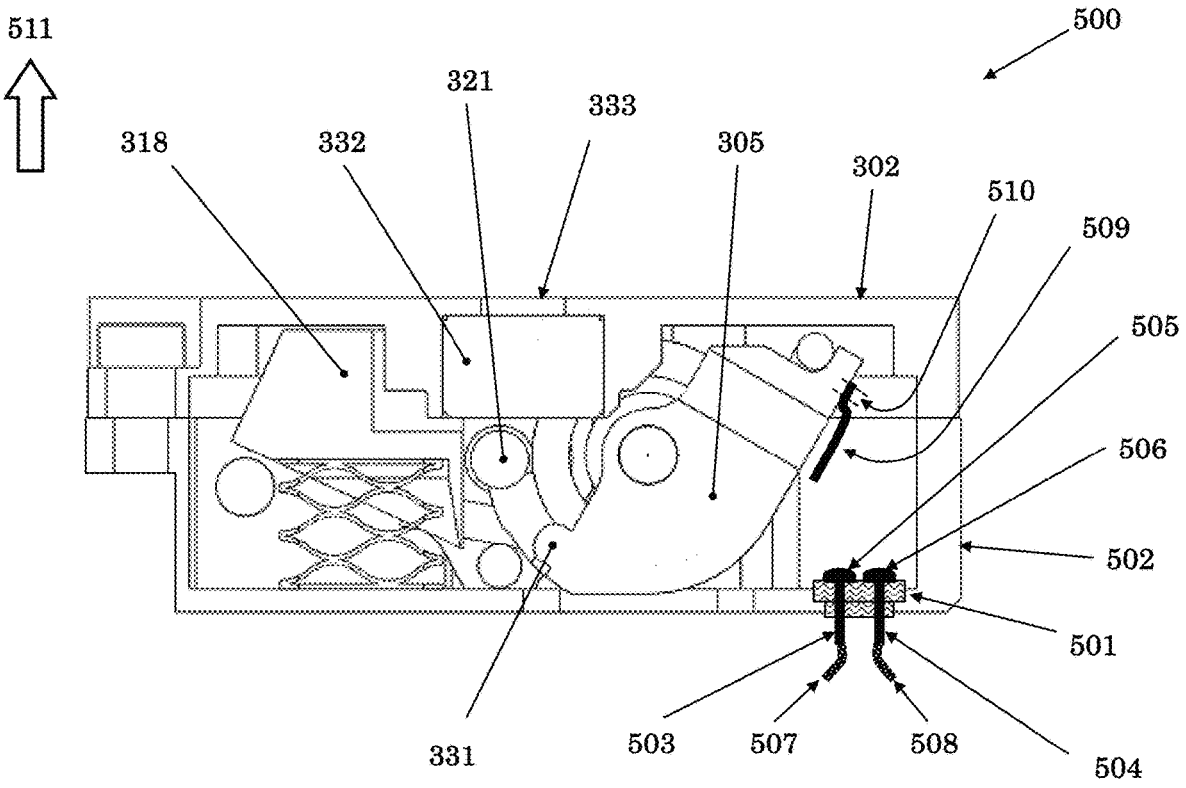
FIG. 19 illustrates a cross-sectional view of the modified inertial igniter embodiment of FIG. 6 in its pre-activation state for initiating percussion primers and simultaneously closing a normally open switch for indicating the activation state of the inertial igniter and/or function as an impulse switch.

FIG. 19 shows the cross-sectional view of the embodiment 300 of FIG. 8, with the modification to also function as a switch that indicates if the inertial igniter has been activated, i.e., for the user to determine the activation state of the inertial igniter. The resulting inertial igniter with the integrated "activation state indicating sensor" of FIG. 19 is indicated by the numeral 500 and is hereinafter referred to as the "inertial igniter with activation sensor".

The inertial igniter with activation state indicating sensor embodiment 500 of FIG. 19 is identical to the inertial igniter embodiment 300 of FIG. 8, except for the addition of the following electrical contact forming components to provide the means of sensing whether the inertial igniter has been activated. In this embodiment, like the impulse switch 400 of FIG. 13, an element 501 which is constructed of an electrically non-conductive material is fixed to the body 502 (301 in the inertial igniter, FIG. 8) of the inertial igniter with activation state indicating sensor. The electrically non-conductive element 501 may be attached to the body 502 by fitting it in the matching opening in the base of the of body 502 as shown in FIG. 19. The element 501 is provided with two electrically conductive elements 503 and 504 with contact ends 505 and 506, respectively. The electrically conductive elements 503 and 504 may be extended to form contact "pins" for direct insertion into provided holes in a circuit board or may alternatively be provided with wires 507 and 508 for connection to appropriate circuit junctions, in which case, the wires 507 and 508 may be desired to exit from the sides of the inertial igniter with activation state indicating sensor embodiment 500 (not shown).

Previously described striker mass 305 is then provided with a flexible strip of electrically conductive material 509, which is fixed to the surface of the striker mass 305 as shown in FIG. 19, for example, with fasteners 510 or by soldering or other methods known in the art.

The operation of the inertial igniter with activation state indicating sensor embodiment 500 of FIG. 19 is the same as that of the inertial igniter 300 of FIGS. 6-10. Here again and as was described for the inertial igniter 300, when the inertial igniter with activation state indicating sensor embodiment 500 is accelerated in the direction of the arrow 511, as the prescribed acceleration level threshold and duration is reached, the release lever 318 is rotated in the counter-clockwise direction until the striker mass engagement pin 321 moves far enough to the left to release the striker mass 305 as was described for the inertial ignite 300, FIG. 8.

At this point, the stored mechanical (potential) energy in the preloaded torsional spring 309 (FIGS. 6-8) would begin to rotationally accelerate the striker mass 305 in the clockwise direction about the axis of the shaft 307 (FIGS. 6-8). The striker mass 305 is thereby accelerated in the clockwise direction until the percussion pin 331 strikes the percussion primer 332 and cause it to initiate as shown in the cross-sectional view of FIG. 10. The flames and sparks generated by the ignition of the percussion primer 332 would then exit through the hole 333 provided in the device cap 302. At the same time, the strip of the electrically conductive material 509 has also come into contact with the contact ends 505 and 506, thereby closing the circuit to which the inertial igniter with activation state indicating sensor embodiment 500 is connected.

Alternatively, since the striker mass 305 is usually metallic, for example made from brass or stainless steel and therefore electrically conductive, there may not be any need for the flexible strip of electrically conductive material 509. In such cases, the contact ends 505 and 506 can be flexible to ensure contact with the surface of the striker mass 305.

The inertial igniter with activation state indicating sensor embodiment 500 is shown to perform percussion primer initiation as well as an impulse switch functionality. As a result, when the device is packaged in a reserve battery or in any other device for initiation of pyrotechnic materials or the like, the user or the system controller or diagnostic system can check the activation status of the inertial igniter for safety and/or for system readiness or the like. The activation status sensor component of the device may also be used as an input to the system activation status indication algorithm, for example as an independent sensory input to munitions fuzing to indicate if the munitions was fired.

The inertial igniter with activation state indicating sensor embodiment 500 acts as a normally open electrical switch, in which the switch is closed when the inertial igniter is activated. It is appreciated by those skilled in the art that the device may also be designed as a normally closed electrical switch as was described for the impulse switch embodiment of FIGS. 15-16.

In the above inertial igniter embodiments, percussion primers are shown to be used to generate the required flame and sparks. It is appreciated that alternatively, appropriate pyrotechnic materials, such as those generally used in percussion primers or one of the recently developed green (no-lead) versions may be used directly as described for the prior art inertial igniters of FIG. 2.

In certain munitions applications, the firing acceleration experienced by the munition is very low, sometimes as low as 10-20 Gs but with relatively long duration (all-fire condition), sometimes in the order of tens or even hundreds of milliseconds. However, for safety reasons, the munition must be capable of withstanding thousands Gs of that are short duration (usually a fraction of a millisecond long) shock loading (one of the no-fire conditions) due to accidental drops on hard surfaces from 5-7 feet height.

Currently, mechanical inertial igniters that can satisfy the above all-fire and no-fire conditions do not exist. The development of such mechanical inertial igniters becomes even more challenging since due to space limitations, the height of the inertial igniter must be very low, sometimes as low as 5-10 mm. The main challenge is the result of the very large difference between the 10-20 Gs all-fire acceleration level from the accidental high G levels that could be several thousand Gs in magnitude.

The methods to design the inertial igniters are based on providing an additional mechanism, hereinafter referred to as the "striker mass release mechanism actuation mechanism", which are designed to actuate the release lever (318 in the embodiment of FIGS. 6-10 and 358 in the embodiment of FIGS. 11-12 and 482 in the embodiment of FIGS. 17-18) to release the striker mass (305 in the embodiment of FIGS. 6-10 and 345 in the embodiment of FIGS. 11-12 and 471 in the embodiment of FIGS. 17-18) upon an acceleration duration and magnitude greater than a prescribed threshold (all-fire condition). The "striker mass release mechanism actuation mechanism" must not actuate the release lever to release the striker mass when the inertial igniter is subjected to any of the aforementioned no-fire conditions, including very high G accelerations due to accidental drops over hard surfaces from 5-7 feet that could subject the inertial igniter to acceleration pulses of the order of several thousand Gs for a fraction of a millisecond in any direction. In comparison, the all-fire acceleration level threshold could be as low as 10-20 Gs but with significantly longer duration of the order of tens or hundreds of milliseconds.

In the present disclosure, two basic methods are presented that can be used to design "striker mass release mechanism actuation mechanism" that can function as described above, i.e., to actuate the release lever to release the striker mass upon an acceleration duration and magnitude greater than the prescribed threshold (all-fire condition) and not actuate the release lever to release the striker mass when the inertial igniter is subjected to any of the aforementioned no-fire condition.

The first basic method is based on employing a mechanism in which a provided inertial element would displace (or rotate) by the application of the short duration high G accidental acceleration to the mechanism, the resulting displacement (rotation) of the provided inertial element would in turn prevent the "striker mass release mechanism actuation mechanism" from actuating the release lever to release the striker mass. However, the application of the low G firing acceleration over its relatively long duration would not impede the "striker mass release mechanism actuation mechanism" from actuating the release lever to release the striker mass.

The second basic method is based on the use of a mechanical delay mechanism that prevents an inertial element that provides the "striker mass release mechanism actuation mechanism" with the means of actuating the release lever to release the striker mass to perform its actuation function during the very short duration of the high G accidental acceleration events, but would allow the low G firing acceleration to perform the release lever actuation function since its duration is significantly longer than those of the high G accidental accelerations (sometimes several orders of magnitude longer as was previously described).

The first basic method was described in the U.S. Pat. No. 9,123,487, the content of which is hereby incorporated by reference. This method is described below using the embodiment of FIG. 21 (FIG. 8 in the above U.S. Pat. No. 9,123,487). In this method, the prior art inertial igniter mechanism of FIG. 20 (FIG. 6 in the above U.S. Pat. No. 9,123,487) is provided with a "deployable locking mechanism" which would prevent the inertial igniter initiation when the inertial igniter is subjected to the previously described high G but short duration accelerations but which would deploy to prevent initiation of the inertial igniter when the acceleration levels are significantly lower G in magnitude and significantly longer in duration.

Figure 20:
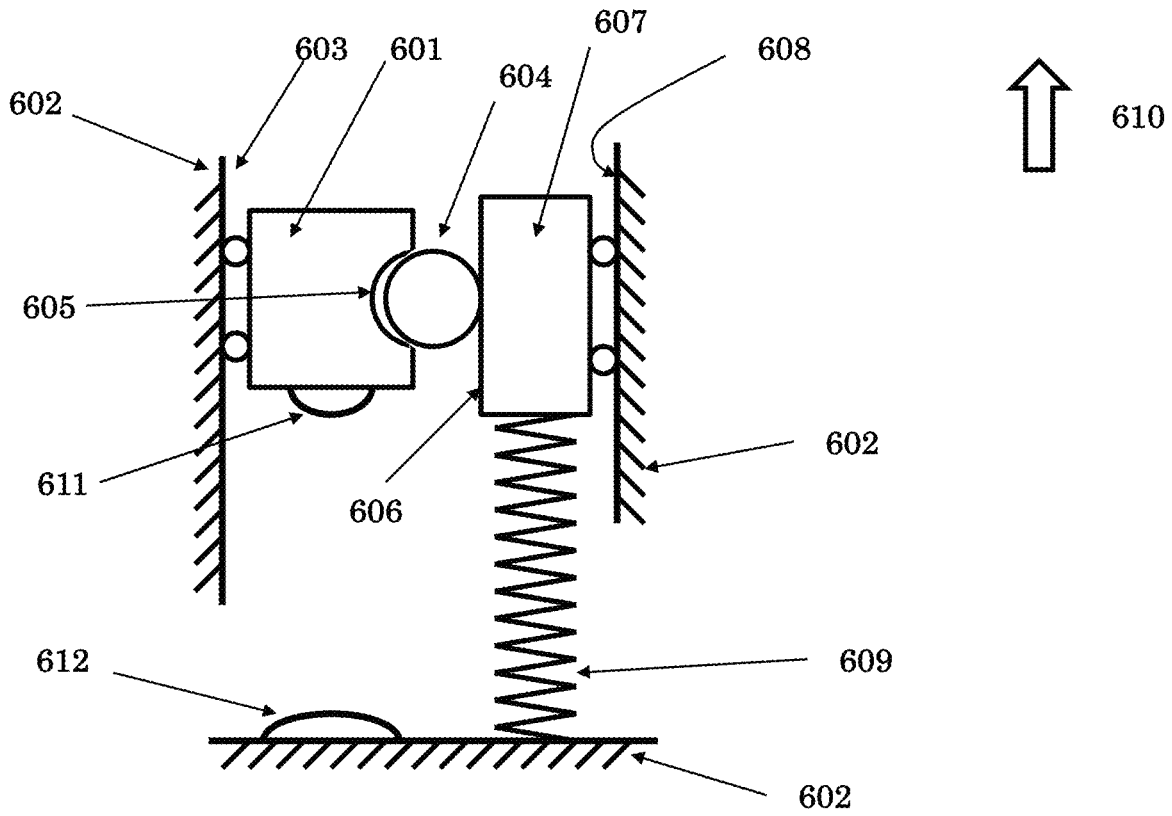
Figure 20 (Prior Art)
FIG. 20 illustrates a schematic of the basic components of an inertial igniter used to describe the operation of a mechanical inertial igniter of the prior art with 5-7 feet accidental drop safety mechanism.

To describe the first method, consider the schematic of the prior art inertial igniter mechanism of FIG. 20 (FIG. 6 in the U.S. Pat. No. 9,123,487), which is used to satisfy safety (no initiation) requirement for drops from heights that could result in up to 2,000 Gs of acceleration for up to 0.5 msec. In these mechanical inertial igniters, a striker mass 601 is provided, which when free, can slide down against the surface 603 of the inertial igniter structure 602. Before being activated, the striker mass 601 is held fixed to the inertial igniter structure 602 by the mechanically interfering element (in the schematic of FIG. 20 the ball 604), which engages the striker mass 601 in the provided dimple 605. In this state, the ball 604 rests against the surface 606 of the element 607, thereby it is prevented from disengaging the element 601, i.e., to move to the right and out of the dimple 605. The element 607 is free to slide along the surface 608 of the inertial igniter structure 602. The element 607 is also attached to the inertial igniter structure 602 via the spring element 609, which is attached to the element 607 on one side and to the inertial igniter structure 602 on the other side.

In the schematic of FIG. 20, the direction of firing acceleration is as indicated by the arrow 610. If the inertial igniter is dropped from a certain height, e.g., from 7 feet over a concrete floor, and strikes the floor while oriented as shown in FIG. 20, the resulting impact causes the inertial igniter to be decelerated (accelerated in the direction of the arrow 610), as it would have during the firing. Following the impact, the element 607 is decelerated from its initial (downward) velocity at the time of impact at a rate proportional to the dynamic (inertial force) due to its deceleration, less the force applied by the spring element 609 (neglecting friction and other usually incidental forces). If the level of downward deceleration of the element 607 relative to the inertial igniter structure 602 is high enough and acts over long enough time, then the element 607 moves down enough to allow the locking ball 604 to be pushed out of the dimple 605 by the dynamic force acting on the inertial of the striker mass 601. The striker mass 601 is then accelerated downward, causing the pyrotechnic elements 611 and 612 (alternatively one-part pyrotechnic material or percussion primer 612 and the striker tip 611) to impact and initiate the igniter. Otherwise, if the inertial igniter impact induced deceleration ends before the striker mass 601 is released, the element 607 is pushed back up to its pre-impact position by the spring element 609, securing the striker mass 601 via the locking ball 604. Similar excursions of the element 607 may occur during transportation induced movements (acceleration/deceleration cycles applied to the inertial igniter) without causing the striker mass 601 to be released.

The safety requirements for inertial igniter transportation and drops from heights of up to 7 feet over concrete floor are designed to be satisfied by selecting appropriate values for the mass of the element 607, the level of preloading of the spring element 609 and its rate, and the distance that the element 607 has to travel down before the locking ball 604 is released.

Figure 21:
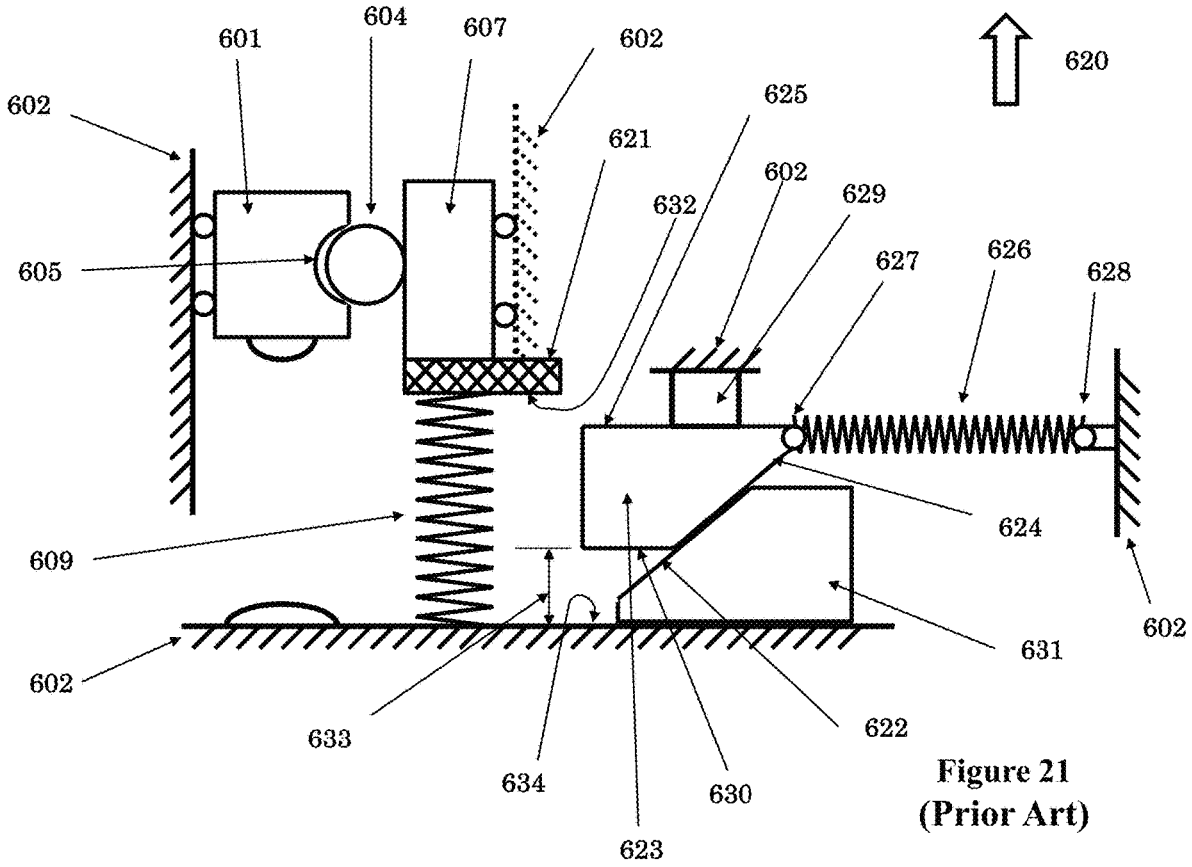
Figure 21 (Prior Art)
FIG. 21 illustrates a schematic of basic components used to describe the operation of a mechanical inertial igniter of the prior art that is provided with a striker mass release preventing mechanism when subjected to accidental drops from high heights of up to 40 feet over hard surfaces.

The basic inertial igniter device design shown in the schematic of FIG. 20 is used in the prior art embodiment of FIG. 21 (FIG. 8 in the U.S. Pat. No. 9,123,487) by the addition of a mechanism called the "deployable locking mechanisms", which enabled the inertial igniter to satisfy the requirement of safety (no initiation) when dropped on hard surfaces from heights that could subject the inertial igniter to thousands of G acceleration pulses for short durations, for example to up to a 10,000 Gs of acceleration pulse for 0.5 msec. The inertial igniter should still be capable of providing initiation at significantly lower prescribed firing acceleration levels that have significantly longer duration, for example, firing accelerations of the order of 500 G with 10 msec duration.

As can be seen in the schematic of the prior art embodiment of FIG. 21, the element 607 is provided with a protruding step 621. It is noted that as it was previously described, that the element 607 serves to prevent the release of the striker mass 601 by preventing the locking ball 604 from moving out of the dimple 605 of the striker mass 601. In this prior art method, a "deployable locking mechanism" is provided that engages the provided step 621 (or other similarly provided motion constraining surface on the element 607) and prevents it from moving down far enough to allow the release of the locking ball 604 when the inertial igniter is subjected to impact induced (or explosion or the like) in the direction parallel to that of the arrow 620 corresponding to drops from high-heights (for example of up to 40 feet, which can subject the inertial igniter to an acceleration pulse of up to 18,000 Gs with durations of up to 1 msec).

In the prior art embodiment of FIG. 21, the "deployable locking mechanism" consists of a solid element 631 which is fixed to the inertial igniter 602. The element 631 is provided with an inclined surface 622. A second solid movable element 623 with a matching inclined surface 624 is positioned as shown over the element 631. The inclined surfaces 622 and 624 of the elements 631 and 623 are held in contact, allowing the element 623 to slide up or down along this inclined surface of contact. The element 623 is held in place and is prevented from sliding down along the said inclined surfaces of contact by the spring (elastic) element 626, which is attached to the element 623 at one end (such as through a rotary joint 627 or the like) and to the structure of the inertial igniter 602 at the other end (such as through a second rotary joint 628 or the like). The spring element 626 is preloaded in tension, while the upward movement of element 623 is constrained by the stop 629, which is fixed to the structure of the inertial igniter 602.

The "deployable locking mechanism" works as follows. If the inertial igniter is dropped such that it impacts a solid surface vertically (in a direction parallel to the arrow 620), during the impact, the element 623 is decelerated in the direction the arrow 620 from its initial velocity at the time of impact. The level of deceleration is obviously proportional to the net force acting on the inertia of the element 623. The net decelerating force is due mainly to the components of the force applied by the spring element 626 and the contact (reaction) force between the contacting surfaces 622 and 624 and other (usually incidental) forces such as those generated by friction, in a direction parallel to the direction of the arrow 620. The said resisting force offered by the spring element 626 is generated since the spring element 626 is preloaded in tension. As a result, the spring element 626 resists downwards slide of the element 623 over the surface 622 of the element 631, FIG. 21. Thus, if the aforementioned initial velocity of the element 623 at the time of inertial igniter drop induced impact is high enough (given the slope of the surfaces 624 and 622, the tensile preloading level of the spring 626 and its rate and the level of friction and other said forces acting on the element 623), the resistance of the spring element 626 and friction forces are overcome, and the element 623 begins to slide down the surface 622 of the element 631, causing the element 623 to move down as well as to move towards the left.

If the impact induced deceleration level of the inertial igniter is high enough and its duration is long enough, then the element 623 travels down until its bottom surface 630 comes into contact with the surface of the inertial igniter structure 602. By this time, the top surface 625 of the element 623 is positioned under the bottom surface 632 of the protruding portion (step) 621, thereby preventing the element 607 from moving down enough to cause the locking ball 604 to be disengaged from the striker mass 601.

This scenario obviously assumes that the locking element 623 of the "deployable locking mechanism" moves far enough to the left and under the protruding element 621 by the time the element 607 is about to have moved down enough to release the striker mass 601. Then once the impact induced high G acceleration has ceased, the spring element 626 pulls the element 623 back to its position shown in the schematic of FIG. 21, therefore the inertial igniter becomes operational and can be initiated by the prescribed all-fire acceleration level and duration as was previously described.

In the prior art inertial igniter embodiment of FIG. 21, the spring 626 is preloaded in tension to prevent the locking element 623 from moving to block downward motion of the element 607 when the acceleration in the direction of the arrow is at or below the prescribed firing acceleration level. Thus, allowing the prescribed all-fire acceleration profile releasing the striker mass 601 as was previously described for the embodiment of FIG. 20.

As an example, consider a typical situation in which the firing (setback) acceleration is around 3,000 Gs and lasts up to 4 msec, and the no-fire requirements to be 18,000 Gs with a duration of 1 msec (for drops from up to 40 feet). The inertial igniter may then be designed with the following component parameters.

The spring element 609 of the striker mass 601 release element 607 (FIGS. 20 and 21) is provided with a compressive preload corresponding to a force acting on the element 607 that is generated when an acceleration of 2,500 Gs acts on the inertia of the element 607. This means that for inertial igniter accelerations of up to 2,500 Gs acting in the direction of the arrow 620, the net force acting on the element 607 is upwards, i.e., does not cause the element 607 to begin to translate downwards relative to the inertial igniter structure 602 (in the direction of releasing the locking ball 604). In addition, the spring element 626 of the deployable locking mechanism is preloaded in tension corresponding to a force acting on the element 623 that is generated when an acceleration of 3,000 Gs acts on the inertia of the element 623 and causing it to begin to slide down on the surface 622 of the fixed element 631. This means that for inertial igniter accelerations of up to 3,000 Gs acting in the direction of the arrow 620, the net force acting on the element 623 in the lateral direction prevents it from beginning to move to the left (in the direction of blocking full downward translation of the element 607 to release the locking ball 604).

On the other hand, if the all-fire acceleration of 3,000 G is experienced by the inertial igniter, at the 2,500 G level, the element 607 begins to move down (acted upon by a net equivalent acceleration level of 500 Gs (i.e., 3,000–2,500=500 Gs), thereby if the 3,000 G firing (setback) acceleration is applied over long enough period of time, then the element 607 travels down enough to release the striker mass 601 by allowing the locking ball 604 to move out of the dimple 605. The striker mass is then accelerated down by the applied 3000 G acceleration, causing the pyrotechnics components 611 and 612 (or a percussion primer and a striker pin), FIG. 20, to impact and thereby initiate the thermal or liquid reserve battery.

In the prior art embodiment of FIG. 21, the element 607 serves to prevent the release of the striker mass 601 by preventing the locking ball 604 from moving out of the dimple 605 of the striker mass 601. Then when the inertial igniter is subjected to a high G acceleration due to an event such as drop on a hard surface, i.e., an acceleration level that is significantly higher than that of the firing acceleration, then the element 623 would block the path of travel of the striker mass 601 release element 607, thereby prevents the inertial igniter from being initiated.

However, when the level of no-fire acceleration due to events such as accidental drop over hard surfaces is very high, for example in the order of 5,000 G to 7,000 G, even with short durations, such as 0.5 msec or lower, and when the firing acceleration is very low, for example as low as 10 G to 20 G, even with durations could be as long as 100-500 msec or more, then the spring element 626 must have a very low rate to ensure that the element 623 can move far enough to block the downward motion of the striker mass release element 607 with accelerations above the above firing acceleration levels. The striker mass release element 607 must also be allowed to travel down a relatively long distance before releasing the striker mass 601 as was previously described so that the element 623 has enough time to be positioned under the protruding step 621. The latter requirement results in relatively tall inertial igniter, which is counter to the desire of munitions developers to miniaturize the inertial igniters and thereby achieve smaller reserve batteries.

In addition, when the firing acceleration is very low, for example around 10 G to 20 G or even 100 G to 1,000 G, then the spring element 626 can only be preloaded in tension to the level of firing acceleration. Therefore, if the acceleration due to accidental drop on hard surfaces in the direction of the arrow 620 is around 5,000 G with a duration of 0.5 msec, considering a spring element 626 preloading to a firing acceleration level of 1,000 G, the blocking element 623 will be accelerated along the surface 622 of the fixed element 631 at a rate of:

$$a = (5000)(9.8)\sin(\theta)$$

where θ is the angle of the sloped surface 622 relative to a plane normal to the direction of the acceleration 620. The angle θ cannot be small since the element 623 may get stuck to the surface 622 of the fixed element 631. Now let the angle θ be 45 degrees, which means that neglecting the effects of friction, the above net acceleration of 5,000 G would result in an element 623 acceleration downward over the surface 622 of:

$$a = (5000)(9.8)\sin(\theta) = (5000)(9.8)\sin(45°) \approx 34{,}650\ \text{m/s}^2$$

With the above acceleration being applied over the indicated 0.5 msec, the distance travelled during this time is calculated as:

$$d = (1/2)(34{,}650\ \text{m/s}^2)t^2 = (17{,}325\ \text{m/s}^2)(0.0005\ \text{sec})^2 \approx 0.0043\ \text{m} = 4.3\ \text{mm}$$

A distance of around 4.3 mm along the surface 622 corresponds to a vertical distance 633 ($d_v$), FIG. 22, of:

$$d_v = (4.3\ \text{mm})\cos(45°) \approx 3\ \text{mm}$$

With a vertical distance $d_v$=3 mm, which is not far from what can be considered for a small inertial igniter, the speed $V_v$ of the element 623 as it strikes the surface 634 of the inertial igniter base 602 is determined as:

$$V_v = a\,t = (34{,}650\ \text{m/s}^2)(0.0005\ s) = 17.3\ \text{m/s}$$

It is appreciated by those skilled in the art that the 17.3 m/s speed with which the element 623 is expected to strike the surface 634 of the inertial igniter base 602, and considering the fact that inertial igniter components are generally constructed with stainless steel due to their 20 year shelf life requirement, is not possible to overcome by friction or any other similar means. As a result, the element 623 would strike the surface 634 at excessive speeds that can reach up to the above calculated 17 m/s and would thereby bounce back rapidly.

The process of back and forth bouncing of the element 623 makes it impossible to ensure that the element 623 would be positioned under the protruding step 621 as it moves to release the striker mass 601. This problem becomes very difficult to solve using commonly used methods, e.g., by providing friction between the contact surfaces 622 and 630 or making the element 623 with a shock absorbing material such as high damping elastomers, or the base 602 with shock absorbing material, or the like. These solutions generally cannot be used in inertial igniters for munitions since the 20 year shelf like requirement eliminates the use of shock absorbing elastomers or the like and the friction between the surfaces 622 and 630 cannot be significant due to the very low level of firing acceleration levels of, for example, 10 G to 20 G.

It is therefore appreciated by those skilled in the art that when the firing acceleration is very low and the acceleration in the direction of the firing acceleration due to accidental drops over hard surfaces or other sources is very high, then the element 623 of the prior art embodiment cannot be guaranteed to stay positioned under the member 621 as it moves to release the striker mass 601, FIG. 21.

In certain munitions applications, particularly when munitions are accidentally dropped from very high heights, such as the previously indicated 40 feet, which may result in the munitions experiencing accelerations of up to 18,000 G for 1 msec, the inertial igniter is required not to initiate under such a no-fire condition, but is not required to stay operational. In fact, in many applications, following such accidental drops, the munitions are considered damaged and the inertial igniters are desired to become non-operational for safety reasons.

Figure 22A:
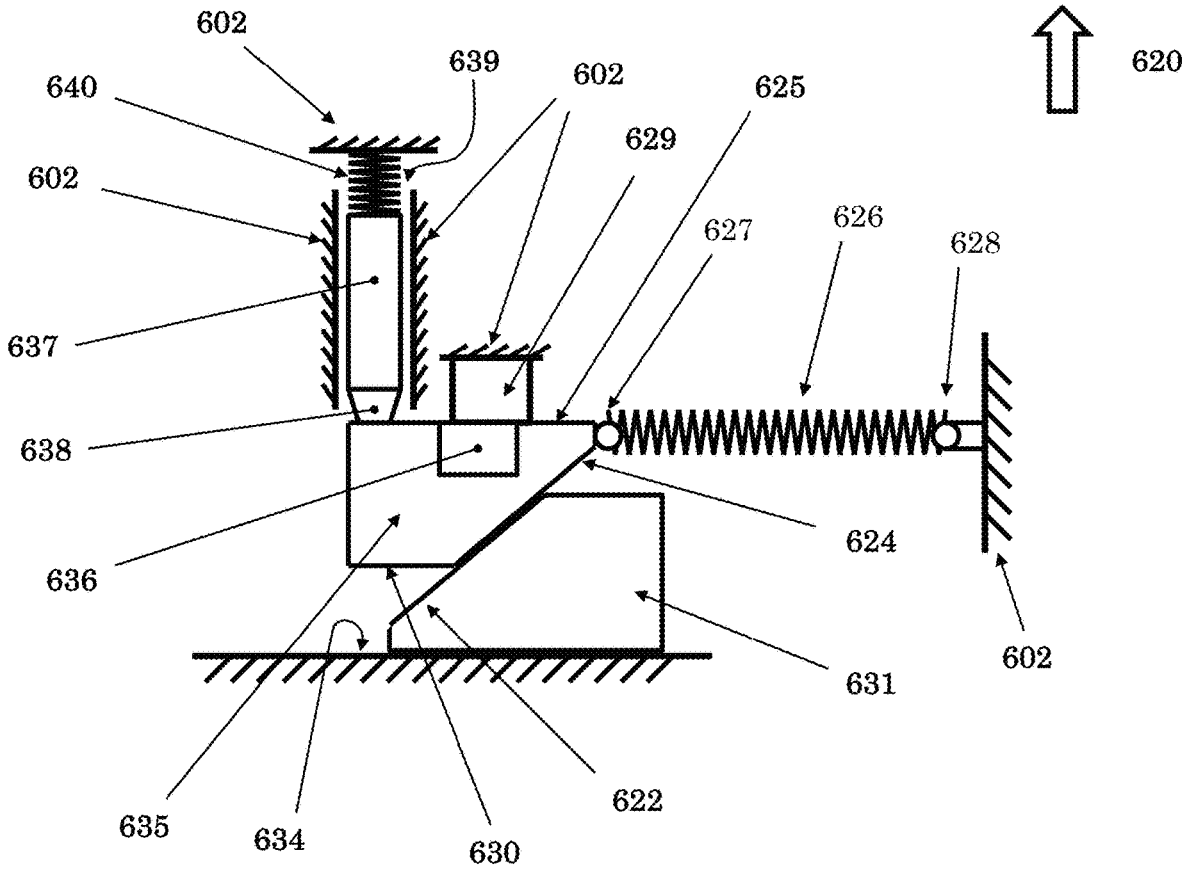
FIGS. 22A-22C illustrate a method of rendering an inertial igniter inoperative following a high G acceleration pulse due to an accidental drop from relatively high heights or similar high G and usually short duration accidental accelerations.

The method to develop inertial igniters with the above capability is described using the prior art inertial igniter embodiment of FIG. 21 as shown in the schematic of FIG. 22A. In the schematic of FIG. 22A, the method of providing the element 623 of the prior art embodiment of FIG. 21 with the means of moving into position under the member 621 and staying in that position even after the high G accidental acceleration has ceased is described. It is appreciated that once the element 623 is permanently positioned under the member 621, it is ensured that the striker mass can no longer be released, even by the prescribed firing acceleration event and the inertial igniter would therefore become totally in-operative, i.e., disarmed. It is also appreciated by those skilled in the art that the disclosed method is general and applicable to almost all inertial igniters and electrical impulse switches described in the present patent application and the inertial igniter and electrical impulse switches disclosed in the U.S. Pat. No. 9,123,487.

The above disclosed method is then used to provide the means of preventing initiation of the inertial igniters of the types of embodiments shown in FIGS. 6-12 and 17-18, and impulse switch designs of the embodiments of FIGS. 13-16 and 19.

In the schematic of FIG. 22A, the method of rendering an inertial igniter inoperative following a high G acceleration pulse due to accidental drop from relatively high heights or similar high G and usually short duration accidental accelerations is described by its application to the embodiment of FIG. 21. In the schematic of FIG. 22A, only the components related to the element 623 and its operation for preventing striker mass release by being positioned under the member 621, FIG. 21, are shown. The remaining components of the mechanism are as shown in the schematic of FIG. 21.

In the schematic of FIG. 22A, the element 635 (623 in FIG. 21) is shown to be provided with a "pocket" 636. The solid element 631 of the "deployable locking mechanism" described for the embodiment of FIG. 21 is also fixed to the inertial igniter structure 602. The element 631 is still provided with the inclined surface 622. The solid movable element 635 with its matching inclined surface 624 is similarly positioned as shown over the element 631. The inclined surfaces 622 and 624 of the elements 631 and 635 are held in contact, allowing the element 635 to slide up or down along this inclined surface of contact. Similar to the embodiment of FIG. 21, the element 635 is held in place and is prevented from sliding down over the inclined surface 622 by the spring (elastic) element 626, which is attached to the element 635 at one end (preferably through a rotary joint 627 or the like) and to the structure of the inertial igniter 602 at the other end ((preferably through a second rotary joint 628 or the like). The spring element 626 is preloaded in tension, while the upward movement of element 635 is constrained by the stop 629, which is fixed to the structure of the inertial igniter 602.

The "deployable locking mechanism" of FIG. 22A is also provided with a locking pin 637, which is free to slide up and down along the guide 639 provided in the structure of the inertial igniter 602. In the configuration of FIG. 22A, the tip 638 is held in contact with the top surface 625 of the element 635 by the compressively preloaded spring 640, which is held on its top fixed end against the structure 602 of the inertial igniter.

In the embodiment of FIG. 22A, the "deployable locking mechanism" works as follows. If the inertial igniter is dropped such that it impacts a solid surface in a direction parallel to the arrow 620, during the impact, the element 635 is decelerated in the direction the arrow 620 from its initial velocity at the time of impact. The level of deceleration is proportional to the net force acting on the inertia of the element 635. The net decelerating force is due mainly to the components of the force applied by the spring element 626 and the contact (reaction) force between the contacting surfaces 622 and 624 and other (usually incidental) forces such as those generated by the component of friction in the direction parallel to the arrow 620. The resisting force offered by the spring element 626 is generated since the spring element 626 is preloaded in tension. As a result, the spring element 626 resists downwards slide of the element 635 over the surface 622 of the element 631.

Figure 22B:
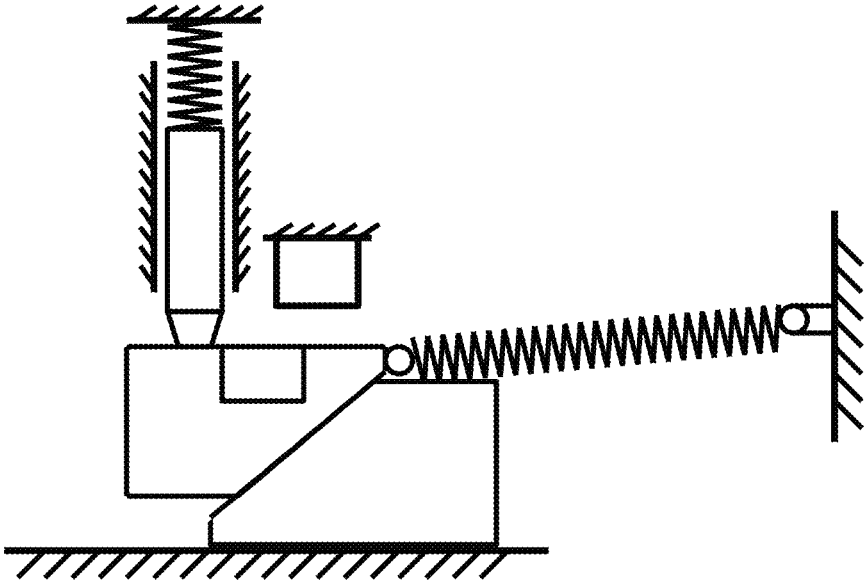

Thus, if the aforementioned initial velocity of the element 635 at the time of inertial igniter drop induced impact is high enough (given the slope of the surfaces 624 and 622, the tensile preloading level of the spring 626 and its rate and the level of friction and other said forces acting on the element 635), the resistance of the spring element 626 and friction forces are overcome, and the element 635 begins to slide down the surface 622 of the element 631, causing the element 635 to move down as well as to move towards the left, as shown in FIG. 22B. It is appreciated that as the element 635 slides down, the tip 638 of the of the pin 637 is held in contact with the top surface 625 of the element 635 by the compressively preloaded spring 640.

Figure 22C:
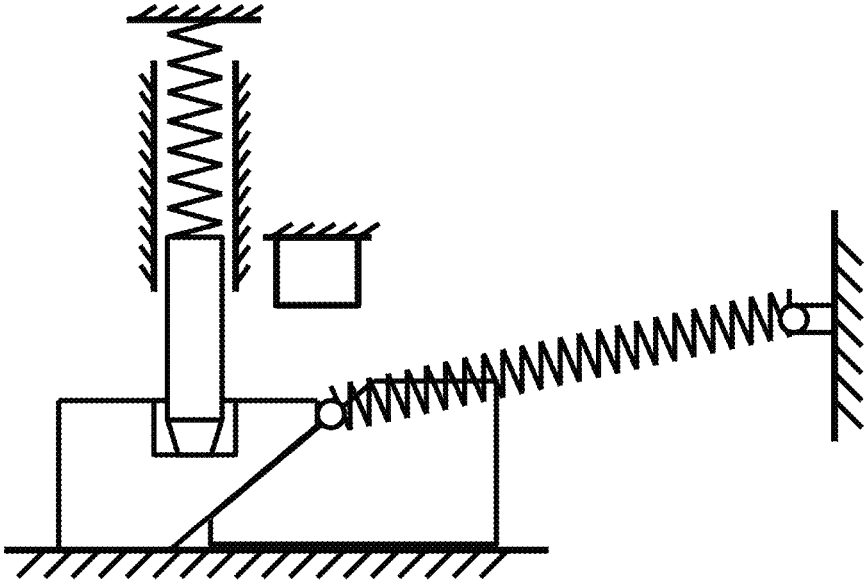

If the impact induced deceleration level of the inertial igniter is high enough and its duration is long enough, then the element 635 travels down until its bottom surface 630 contacts the surface 634 of the inertial igniter structure 602 as shown in the schematic of FIG. 22C. By this time, the top surface 625 of the element 635 is positioned under the bottom surface 632 of the protruding portion (step) 621, FIG. 21, thereby preventing the element 607 from moving down enough to cause the locking ball 604 to be disengaged from the striker mass 601. By this time, the tip 638 of the pin 637 has passed the "pocket" 636 opening and the compressively preloaded spring 640 has pushed the tip 638 and portion of the pin 637 into the pocket 636 as shown in FIG. 22C.

As a result, once the high G acceleration in the direction of the arrow 620, which may have been induced by the dropping of the inertial igniter from a relatively high height over hard surfaces or other similarly high G inducing events, has ceased, then the tension preloaded spring 626 would tend to pull the element 635 back towards its initial positioning as shown in FIG. 22A, but can only pull it back slightly until the pin 637 engages the side of the pocket 636, thereby preventing it from returning to its initial positioning shown in FIG. 22A. As a result, the top surface 625 of the element 635 stays permanently under the surface 632 of the protruding portion (step) 621, FIG. 21, thereby preventing the element 607 from moving down enough to cause the locking ball 604 to be disengaged from the striker mass 601. As a result, the inertial igniter is rendered inoperative following the indicated high G acceleration event.

This scenario obviously assumes that the locking element 635, FIG. 22A, of the "deployable locking mechanism" moves far enough to the left and under the protruding element 621, FIG. 21, by the time the element 607 has moved down enough to release the striker mass 607. In addition, in its locked position shown in FIG. 22C, the top surface 625 of the element 635 must still extend far enough under the protruding element 621, FIG. 21, to permanently block its downward motion to the point that would release the striker mass 607.

The second of the aforementioned two basic methods for the design of "striker mass release mechanism actuation mechanisms" that can function to actuate the release lever to release the striker mass upon an acceleration duration and magnitude greater than the prescribed threshold (all-fire condition) and not actuate the release lever to release the striker mass when the inertial igniter is subjected to any of the aforementioned no-fire condition is herein described. As was previously indicated, the second basic method is based on the use of a mechanical delay mechanism. The mechanical delay mechanism function is to prevent an inertial element that provides the "striker mass release mechanism actuation mechanism" with the means of actuating the release lever from performing its actuation function when the inertial igniter is subjected to short durations of high G accidental acceleration events, but would allow the low G and relatively long duration firing acceleration to actuate the release lever and release the striker mass of the inertial igniter. It is appreciated that as was previously indicated, the (no-fire) short duration but high G accelerations may be several thousand G in magnitude but a fraction of one millisecond in duration. While the (all-fire) firing acceleration levels may be a few tens of G tens of milliseconds in duration.

Several methods to provide mechanical delays in inertial igniters have been described in the U.S. Pat. Nos. 7,587,979 and 8,191,476, the contents of which are hereby included in this disclosure by reference. The basic method is best described by the design and operation of the "finger-driven wedge design" embodiment (FIGS. 5*a*-5*d* in the U.S. Pat. No. 7,587,979), which is a multi-stage mechanical delay mechanism, and is shown in the schematics of FIGS. 23A-23D.

Figure 23A:
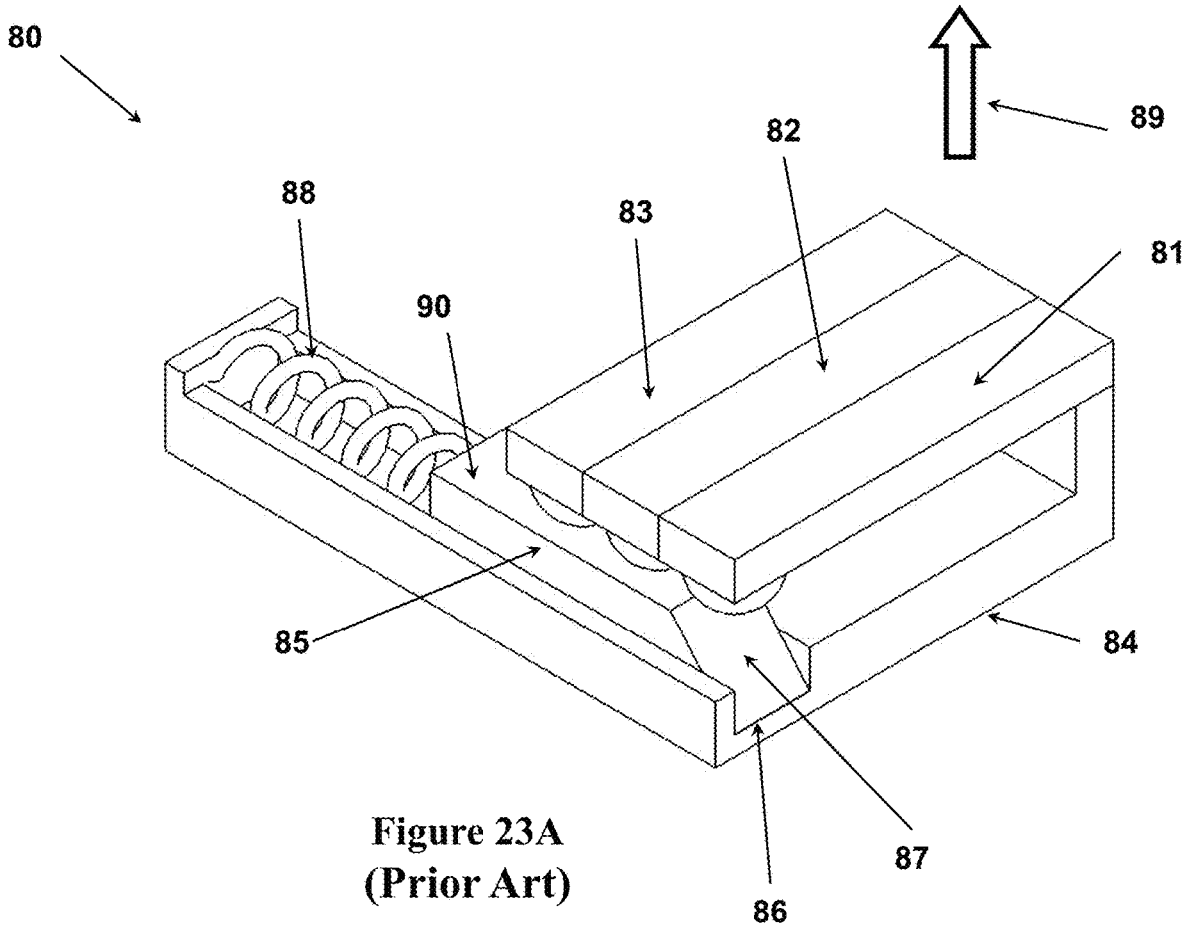
Figure 23A (Prior Art)
FIG. 23A-23D illustrate a schematic of an inertial based mechanical delay mechanism of the prior art that can be used to delay inertial igniter activation or electrical switching or the like in munitions or the like when subjected to a prescribed firing acceleration.

In the prior art embodiment of FIG. 23A, a three-stage delay mechanism is illustrated, but may obviously be designed with as many stages (fingers) as may be required to accommodate the desired delay time. In the schematic of FIG. 23A, the mechanism has three fingers (stages) 81, 82 and 83, each of which provides a specified amount of delay when subjected to a certain amount of acceleration in the direction of the arrow 89. The fingers are fixed to the mechanism base 84 on one end. Each finger is provided with certain amount of mass and deflection resisting elasticity (in this case in bending). Certain amount of upward preloading may also be provided to delay finger deflection until a desired acceleration level is reached. When at rest, only the first finger 81 is resting on the sloped surface 87 of the delay wedge 85. The delay wedge 85 is preferably provided with a resisting spring 88 to bring the system back to its rest position, if the applied acceleration profile is within the no-fire regime of the inertial igniter using this delay mechanism and to offer more programmability for the device. The delay wedge 85 is positioned in a guide 86 which restricts the delay wedge's 85 motion along the guide 86.

The operation of the device 80 is as follows. At rest, the delay wedge 85 is biased to the right by the delay wedge spring 88, and the three fingers 81, 82 and 83 may be biased upwards with some pre-load. The ratio of pre-load to effective finger mass will determine the acceleration threshold below which there will be no relative movement between components. The positions of the three fingers 81, 82 and 83 are such that finger 81 is above the sloped surface 87 of the delay wedge 85 and fingers 82 and 83 are supported by the top surface 90 of the delay wedge 85, and are prevented from moving until the delay wedge 85 has advanced the prescribed distance, FIG. 23A.

Figure 23B:
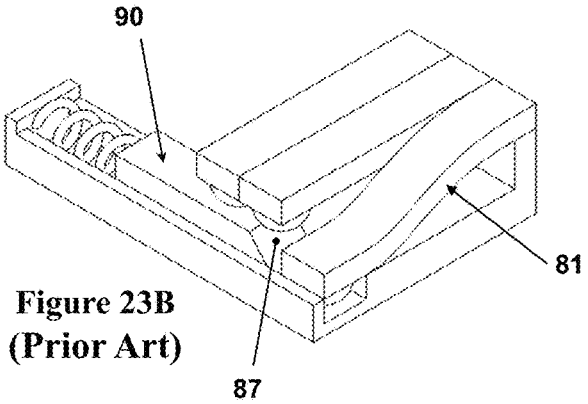
Figure 23B (Prior Art)
Figure 23C:
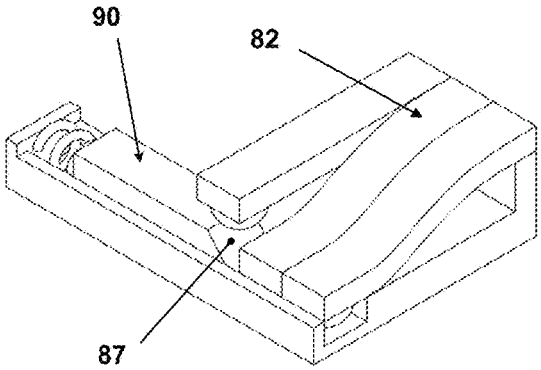
Figure 23C (Prior Art)
Figure 23D:
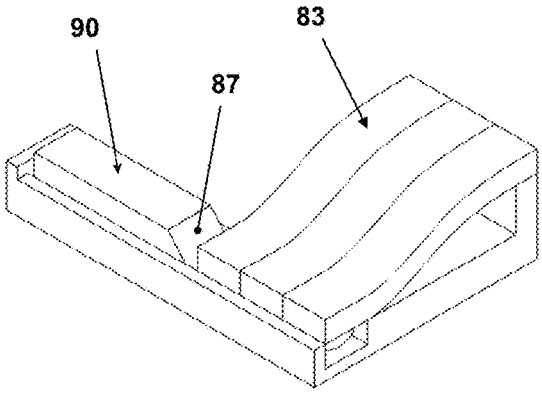
Figure 23D (Prior Art)

If the device 80 experiences an acceleration in the direction 89 above the threshold determined by the ratio of initial resistances (elastic pre-loads) to effective component masses, the primary finger 81 will act against the sloped surface 87 of the delay wedge 85, advancing the delay wedge 85 to the left as shown in FIG. 23B. At this instant, the second finger 82 is no longer supported by the top surface 90 of the delay wedge 85 and is free to move downwards provided that the acceleration is still sufficiently high to overcome the preload for the second finger 82 and the delay wedge spring 88 force. If the acceleration continues at the all-fire profile, the second finger 85 will drive the delay wedge further to the left while the third finger 83 remains in contact with the top surface 90 of the delay wedge 85, until the second finger 82 is fully actuated and the third finger 83 is positioned on the sloped surface 87 of the delay wedge 85 as shown in FIG. 23 C. Then if the acceleration continues at the all-fire profile, the third finger 83 will drive the delay wedge further to the left until the third finger is fully actuated as shown in FIG. 23D.

If the acceleration terminates or falls below the all-fire requirements, the mechanism will reverse until balance is achieved between the acceleration reaction forces and the elastic resistances. This may be a partial or complete reset from which the mechanism may be re-advanced if an all-fire profile is applied or resumed.

It is appreciated by those skilled in the art that if the magnitude of the short duration (no-fire) high G acceleration due to accidental drop over hard surfaces or the like is not significantly higher than the longer duration all-fire acceleration level, then the prior art delay mechanism of FIGS. 23A-23D may be used as is described in the U.S. Pat. No. 7,587,979 to design inertial igniters that would satisfy prescribed no-fire and all-fire conditions. For example, if the no-fire accidental drop event can result in an acceleration in the direction of the arrow 89, FIG. 23A, of 2,000 G for 0.5 msec and the firing (all-fire) acceleration is 1,500 G for 4 msec, then the preloading of the fingers 81, 82 and 83 and the preloading of the compressive spring 88 can be selected such that with the application of the no-fire acceleration of 2,000 G for 0.5 msec, the finger 81 or the finger 81 and 82 could be depressed (FIG. 23B or FIG. 23C) during the 0.5 msec of the inertial igniter 2,000 G acceleration in the direction of the arrow 89. However, the all-fire duration of 4 msec would allow the firing 1,500 G acceleration enough time to depress all three fingers 81, 82 and 83, thereby releasing the inertial igniter striker mass to initiate the igniter pyrotechnic material or primer as described in the U.S. Pat. No. 7,587,979.

However, if the magnitude of the accidental no-fire acceleration level is several thousands of G, for example, 5,000 G to 6,000 G, even with a short duration of less than 0.5 msec, and if the magnitude of the all-fire acceleration is only a few tens of G, for example, 10 G to 40 G, even with a duration of tens of msec, for example, 20 msec to 50 msec, then the separation between the no-fire and all-fire impulse levels is too high to allow the design of a mechanical delay of the type shown in FIGS. 23A-23D to present a practical solution. Such mechanical delay types would require a very large number of actuating fingers, noting that the finger and spring 88, FIG. 23A, must have very low preloading levels to allow for their actuation by the low G firing acceleration. As a result, large number of fingers will be actuated very rapidly, requiring a very long delay mechanism. In addition, since the all-fire acceleration is low, friction forces between the moving member 85 and the guide 86 needs to be very low, thereby each finger actuation would add to the speed of the moving member 85, increasingly reducing the amount of time that it takes for the next finger to actuate. In addition, the length of the spring 86 needs to be long and its rate must stay low to absorb the kinetic energy of the moving member 85. All the above issues make it almost impossible to design a delay mechanism for actuating the striker mass of an inertial igniter when the magnitudes of the no-fire accidental accelerations and the firing accelerations are so far apart, even though their durations are also very far apart.

It is appreciated by those skilled in the art that the delay mechanisms of the type shown in FIGS. 23A-23D function based on allowing the applied acceleration (accidental high G and short duration no-fire acceleration) to sequentially accelerate the provided masses (finger 81, 82 and 83) a very short distance from their resting position relative to the inertial igniter structure, thereby preventing them from gaining high speeds relative to the inertial igniter structure. Then once the applied no-fire acceleration has ceased, the imparted kinetic energy on the moving part, in the case of the mechanical delay mechanism of FIGS. 23A-23D the moving member 85, must be absorbed to bring it to a stop, e.g., by friction forces or resisting spring elements (spring 88 in this case) or a viscous damping element (not used in this case) or the like.

However, as was previously described, when the magnitude of the accidental high G acceleration is very high and the magnitude of the all-fire acceleration is very low, then since the preloading of the moving mass 85 actuating elements (finger 81, 82 and 83) and the resisting spring 88 must be very low to allow the low G all-fire acceleration to actuate the moving mass 85, the kinetic energy of the moving mass 85 can only be absorbed over its relatively long travel distance. This means that the delay mechanism of the inertial igniter will become very large, thereby impractical for inertial igniters, considering the relatively small size of the reserve batteries and the like within which they are supposed to be packaged.

The novel method used for the present design "mechanical delay mechanism" based "striker mass release mechanism actuation mechanisms" are in contrast based on absorption of a "moving mass" momentum as it is accelerated by the (no-fire) short duration accidental high G accelerations towards the position at which it would actuate the striker mass release mechanism of the inertial igniter (such striker mass release mechanism options are presented later in this disclosure).

Figure 24:
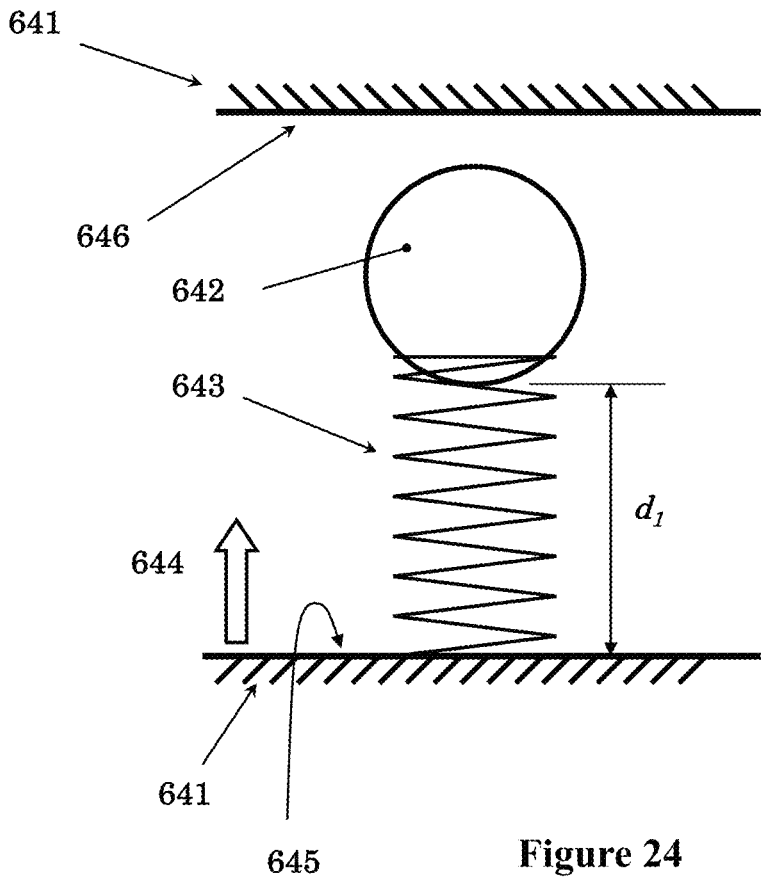
FIG. 24 illustrates a process of using impact to reduce the velocity of a mass attached to an accelerating platform by a soft spring.

The present novel method of providing mechanical delay to the "moving mass" that is used to actuate the aforementioned "striker mass release mechanism" is first described by its basic method of operation using the illustration of FIG. 24. In FIG. 24, the inertial igniter structure is indicated by the numeral 641. A mass 642 (which is considered to be the aforementioned "moving mass" that is to be used to actuate the "striker mass release mechanism"), supported by an attached spring 643 is provided as shown in FIG. 24. The spring 643 is fixedly attached to the inertial igniter structure 641. The spring 643 is relatively soft and its rate and compressive preloading are selected not to significantly resist downward motion of the mass 642 at all-fire acceleration levels of the inertial igniter in the direction of the arrow 644. As a result, the mass 642 would move down towards and reach the surface 645 under the all-fire acceleration as will be described below for several of the inertial igniter design options.

Now consider the case in which the inertial igniter structure 641 is subjected to a high G and short duration acceleration in the direction of the arrow 644 due to an accidental drop over a hard surface or other similar event. Now neglecting the low resistance of the spring 634, the mass 642 is accelerated downward towards the surface 645 of the inertial igniter structure. The mass 642 will then impact the surface 645 at its attained velocity and bounces up with (at most) the same velocity, assuming perfectly elastic impact. It is appreciated by those skilled in the art that some of the kinetic energy of the mass 642 is absorbed due to the impact and assumption that the rebound velocity is as high as the mass velocity before the impact is a conservative assumption.

Thus, after the impact, the mass 642 begins to travel up with the indicated bouncing velocity, while at the same time the inertial igniter surface 645 is being accelerated towards it. As a result, the velocity of the mass 642 relative to the inertial igniter surface 645 keeps on being reduced. Thereafter, the following two situations may be faced:

1. The inertial igniter surface 645 acceleration in the direction of the arrow 644 continues as the upward velocity of the mass 642 relative to the surface 645 is reduced and eventually becomes zero or that the mass 642 impacts the surface 645 again and the process is repeated. In the rare situation in which the upward velocity of the mass 642 relative to the surface 645 of the inertial igniter becomes zero just as the acceleration of the inertial igniter has ended, then the mass 642 stays stationary relative to the inertial igniter.
2. The inertial igniter surface 645 acceleration in the direction of the arrow 644 continues as the upward velocity of the mass 642 relative to the surface 645 is reduced but ceases before it impacts the mass 642. In this case, the mass 642 keeps on moving away from the surface 645 and is stopped either by the spring 643 or after impacting the surface 646 provided on the inertial igniter structure to limit upward motion of the mass. The mass 642 eventually stops due to inevitable impact and friction losses.

It is appreciated by those skilled in the art that each time the mass 642 impacts the surface 645, following the impact, it begins its upward motion with its rebound velocity, while inertial igniter acceleration in the direction of the arrow 644 tends to slow its velocity relative to the inertial igniter.

It is also appreciated by those skilled in the art that neglecting all losses due to impact and friction and neglecting the relatively small forces acting on the mass 642 by the spring 643 and if the high G acceleration of the inertial igniter is constant, if the initial resting position of the mass 642 is a distance $d_1$ from the surface 645 of the inertial igniter structure 641, then the mass 642 would never travel more than the distance $d_1$ away the surface 645. This can be shown to be the case as follows. Let the acceleration of the inertial igniter in the direction of the arrow 644 be give as a, then the distance traveled by the mass 642 towards the surface 645 of the inertial igniter and its velocity V as a function of time t are given by the following equations:

$$d = (0.5)\,a\,t^2 \tag{1}$$

$$V = a\,t \tag{2}$$

Thus, for the indicated initial mass 642 distance of $d_1$ from the surface 645, FIG. 24, the time $t_1$ taken for the mass 642 to reach the surface 645 is calculated from equation (1) to be:

$$t_1 = \sqrt{(2\,d_1)/a} \tag{3}$$

And the velocity $V_1$ of the mass 642 at the time of impact with the surface 645 is calculated from the equation (2) to be:

$$V_1 = a\,t_1 \tag{4}$$

Now with the aforementioned assumptions, and assuming that impact process if fully elastic and takes a negligible amount of time, then the rebound velocity of the mass 642 relative to the inertial igniter surface 645 will have the same magnitude of $V_1$, but will be in the opposite direction, i.e., away from the surface 645 of the inertial igniter. From this point on, the inertial igniter surface 645 will be accelerating toward the mass 642. If the acceleration of the inertial igniter continues, the inertial igniter surface 645 will begin to close its gap with the mass 642, and after certain amount of time it reaches the mass 642.

It is appreciated that with the above no impact and friction energy loss assumption, the inertial igniter surface 645 takes the same amount of time $t_1$ to reach the mass 642. In the presence of such losses, the rebound velocity is less than the impact velocity $V_1$, therefore the inertial igniter surface 645 reaches the mass 642 in less time than $t_1$. Once the inertial igniter surface 645 has reached the mass 642, considering negligible motion perturbations (assuming that for the applied acceleration and the mass of the mass 642 the reaction force of the spring is overcome), the mass 642 stays in contact with the inertial igniter surface as long as the applied acceleration continues.

On the other hand, if the aforementioned accidental acceleration ceases before the inertial igniter surface 645 reaches the mass 642, then the mass 642 will continue to move with its remaining velocity relative to the inertial igniter surface 645. From that moment on, in the absence of the upper motion limiting surface 646, the mass 642 and spring 643 will vibrate and eventually come to rest due to unavoidable friction and spring damping and other similar losses. In the presence of the motion limiting surface, the mass 642 may impact it depending on its velocity following the ceasing of the inertial igniter surface 645 acceleration and its distance from it at that moment and the stiffness of the spring 643. The mass 642 will eventually after this or possibly more impacts with the limiting surface 646 (and less likely impact with the inertial igniter surface 645) will eventually come to rest due to unavoidable friction and spring damping and other similar losses.

The present method for the design of inertial igniters that can satisfy the aforementioned very high G (e.g., several thousands of G) but short duration (usually a fraction of one msec) accidental accelerations while they can also satisfy all-fire low G (a few tens of G) but relatively long duration (tens of msec) firing accelerations is based on using the impact process to develop mechanisms for striker mass release mechanism actuation. In these inertial igniters, this method is used to design actuating mechanisms that are used to actuate mechanisms that release the striker mass of the inertial igniter. The striker mass of these inertial igniters are provided with stored potential energy in their preloaded spring elements (such as inertial igniter of the designs shown in the embodiments of FIGS. 6-12 and 17-18), which once release would accelerate the striker mass to the required kinetic energy to ignite the provided percussion primer of other provided pyrotechnic material of the inertial igniter. It is appreciated by those skilled in the art that the same actuation mechanisms may be used to design electrical impulse switches, such as designs of the embodiments of FIGS. 13-16 and 19, that would also satisfy the indicated high G but short duration no-fire accidental accelerations but that would activate once subjected to the indicated all-fire low G but relatively long duration accelerations.

Figure 25:
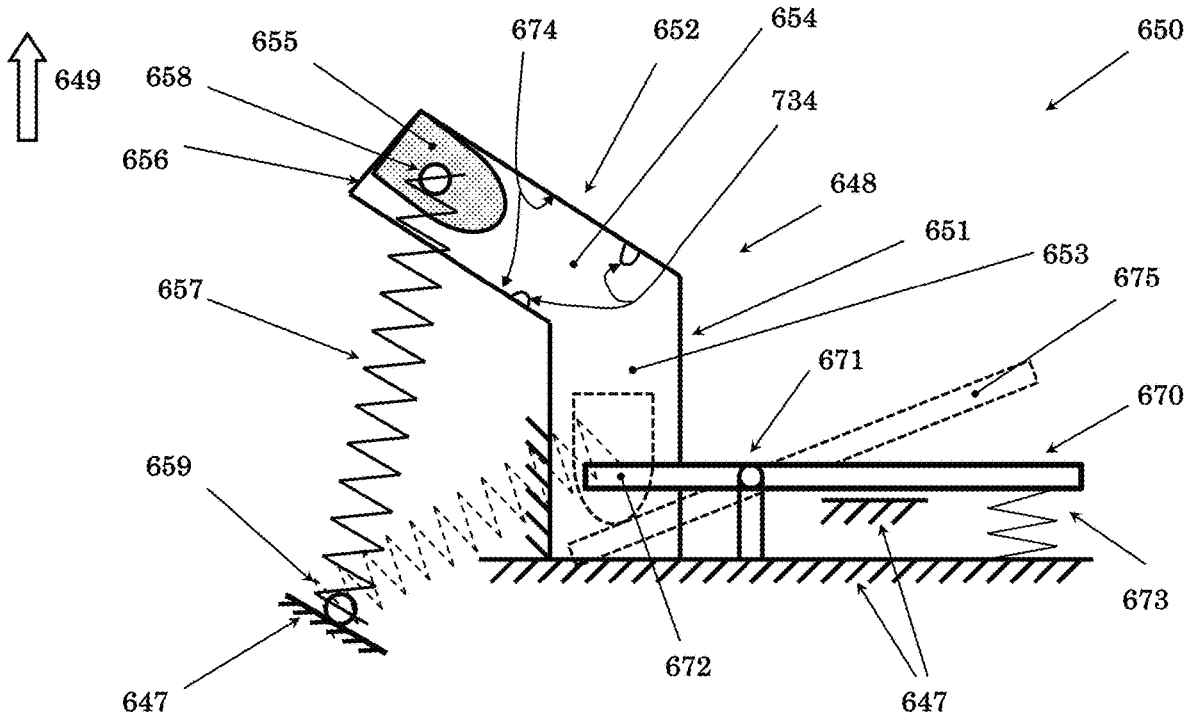
FIG. 25 illustrates a schematic of a cross-sectional view of a first embodiment of actuation mechanism.

The first embodiment 650 of the actuating mechanism that can be used to actuate striker mass release mechanisms (hereinafter referred to as the "actuation mechanism") is shown in the schematic of FIG. 25. The actuation mechanism 650 is considered to be part of an inertial igniter, the structure of which is indicated by the numeral 647, which is fixedly attached to the munitions structure that is subjected to an acceleration in the direction of the arrow 649 during the firing. The "actuation mechanism" 650 consists of a "passage" 648, which is provided in the structure 647 of the inertial igniter. The passage 648 consists of the section 651, which is directed in the direction of the firing acceleration as indicated by the arrow 649 and a relatively inclined section 652 as shown in the schematic of FIG. 25. The two sections 651 and 652 provide the passage sections 653 and 654, respectively, within which the mass element 655 can travel.

In the absence of an acceleration in the direction of the arrow 649, the mass element 655 is stationary and held against the back surface 656 and top surface of the inclined section 652 as shown in FIG. 25 by the force exerted by the compressively preloaded spring 657. The compressively preloaded spring 657 is attached to the mass element 655 on one end and to the structure 647 of the inertial igniter on the other end, preferably by the rotary joints 658 and 659, respectively. The mechanism 650 is also provided with an actuation lever 670, which is attached to the inertial igniter structure 647 by the rotary joint 671. The frontal section 672 of the lever 670 is extended into the portion of the passage 653. In the "actuation mechanism" 650, the counterclockwise rotation of the lever 670 is intended to provide the means of actuating the intended mechanism (in the case of inertial igniter, actuate the striker mass release mechanism of the inertial igniter) as described below. The lever 670 is biased to stay against the provided section of the structure 647 of the inertial igniter as shown in FIG. 25 by the spring 673, which is preloaded in tension.

In the "actuation mechanism" 650, the spring 657 is preloaded in compression such that well below the low all-fire acceleration level, the inertial force due to the mass of the mass element 655 would readily overcome its compressive forces. The tensile spring 673 is also lightly preloaded so that in the absence of any acceleration, the lever 670 is kept at rest against the structure 647 of the inertial igniter as shown in FIG. 25. The center of mass is also designed to be located at the rotary joint 671, so that acceleration of the inertial igniter in any direction would effectively prevent it from rotating relative to the structure 647 of the inertial igniter.

The "actuation mechanism" embodiment of 650 functions as follows. When the inertial igniter is subjected to an accidental high G but short duration acceleration in the direction of the arrow 649, as was previously described for the mass-spring system of FIG. 24, the mass element 655 is first accelerated down relative to the inertial igniter structure 647, impacting the lower surface 674 in the inclined section 652 of the passage 648, bounces back, and after several impacts with the up and down surfaces 674, when the accidental acceleration has ceased, it would be pushed back towards its upper corner position against the back surface 656 (directly or after a few up and down impacts due to the residual energy left in the mass element 655 and spring 657 system).

However, since the low firing accelerations have relatively long durations, for example 20-40 msec and sometimes longer, and since the spring 657 is very lightly preloaded in compression, for example less than an equivalent of 5-10 G over the entire range of motion of the mass element 655, therefore the mass element 655 would not bounce back and forth (if any) more than a fraction of one msec in the section 652 of the passage 648, and would slide down the passage towards the bottom surface of the passage 648 and engage and actuate the lever 670 by pressing down on its tip portion 672, thereby rotating it in the counterclockwise direction as shown by the dashed lines in FIG. 25. The upwards rotated end 675 of the lever 670 is then used as is described later in this disclosure to actuate the intended device.

It is appreciated by those skilled in the art that the angle of the inclined section 652 of the passage 648; the length of the inclined section 652; the clearance between the mass element 655 and the surfaces 674 of the inclined section 652; the material characteristics of the materials of the mass element 655 and the inertial igniter structure 647; the roughness of the surfaces 674 and the surface of the mass element 655; and the geometry of the mass element 655 play a role in the design of the "actuation mechanism" embodiment of 650.

As an example, let the clearance between the mass element 655 and the lower surface 674 be 1.0 mm. Then if the accidental high G acceleration in the direction of the arrow 649 is around 50,000 m/s$^2$ (around 5,000 G) for 0.4 msec, then from the equation (3), the time $t_1$ that takes for the mass element 655 to reach the lower surface 674 will be around:

$$t_1 = \left[(2)(0.001\ \text{mm})/(50000\ \text{m/s}^2)\right]^{1/2} = 0.2\ \text{msec}$$

At the time of impact, assuming no rotation, from the equation (4), the velocity of the mass element 655 will be:

$$V_1 = (50000\ \text{m/s}^2)(0.2\ X\ 10^{-3}\ \text{sec}) = 10\ \text{m/sec}$$

Then as was previously shown, assuming no losses and no mass element rotation and the slope of the section 652 of the passage 648, it will take the same amount of time of 0.2 msec for the mass element 655 to reach the upper surface 674, and since at this time the accidental acceleration has ceased, then the mass element comes to rest at this point, and is slowly pulled back to its rest position at the top corner of the passage 648 by the compressively preloaded spring 657.

It is appreciated by those skilled in the art that depending on the material characteristics of the materials of the mass element 655 and the inertial igniter structure 647, a portion of the kinetic energy of the mass element 655 is absorbed during the impact with the surface 674, thereby the above calculated rebound velocity would be smaller. In addition, due to unavoidable friction between the impacting surfaces and a slight sliding of the mass element 655 during the impact due to the inclination of the surfaces 674 and unavoidable induced rotational motion of the mass element 655 about an axis perpendicular to the plane of view of FIG. 25 and related impacts of the corners of the mass element 655 with the surfaces 674, the velocity of the mass element 655 relative to the inertial igniter structure 647 would be significantly less than the above calculated values. Thereby, once the accidental acceleration has ceased, the mass element 655 is expected to come to rest quickly relative to the inertial igniter structure 647.

It is also appreciated by those skilled in the art that by using materials that are more resilient and have higher internal damping (for example, the mass element 655 may be made with Teflon or very hard rubber), which includes appropriately designed structured materials for the mass element 655 and the inertial igniter structure 647, the impact energy loss levels can be significantly reduced, thereby allowing the design of significantly smaller inertial igniters.

It is also appreciated by those skilled in the art that over the surfaces 674 of the section 652 of the passage 648, relatively small irregularities such as small bumps 734 may be provided so that as the mass 655 impacts the surfaces 674 as a result of the high G accidental accelerations in the direction of the arrow 650 (and even in the right and left directions as seen in the view of FIG. 25), the mass element 655 subjected to more impacts to the surfaces 674 and the bumps 734 and to rotational motions so that its stay within the section 652 is prolonged and it is brought to rest more quickly following the accidental acceleration events.

In the "actuation mechanism" embodiment 650 of FIG. 25, the actuating member is shown to be a rotating lever 670, which is intended to actuate the striker mass release mechanism of the inertial igniter through its counterclockwise rotation as shown by dashed lines in FIG. 25. It is, however appreciated by those skilled in the art that the rotary actuating lever 670 may be replaced by a translating element such as shown in the schematic of FIG. 26.

Figure 26:
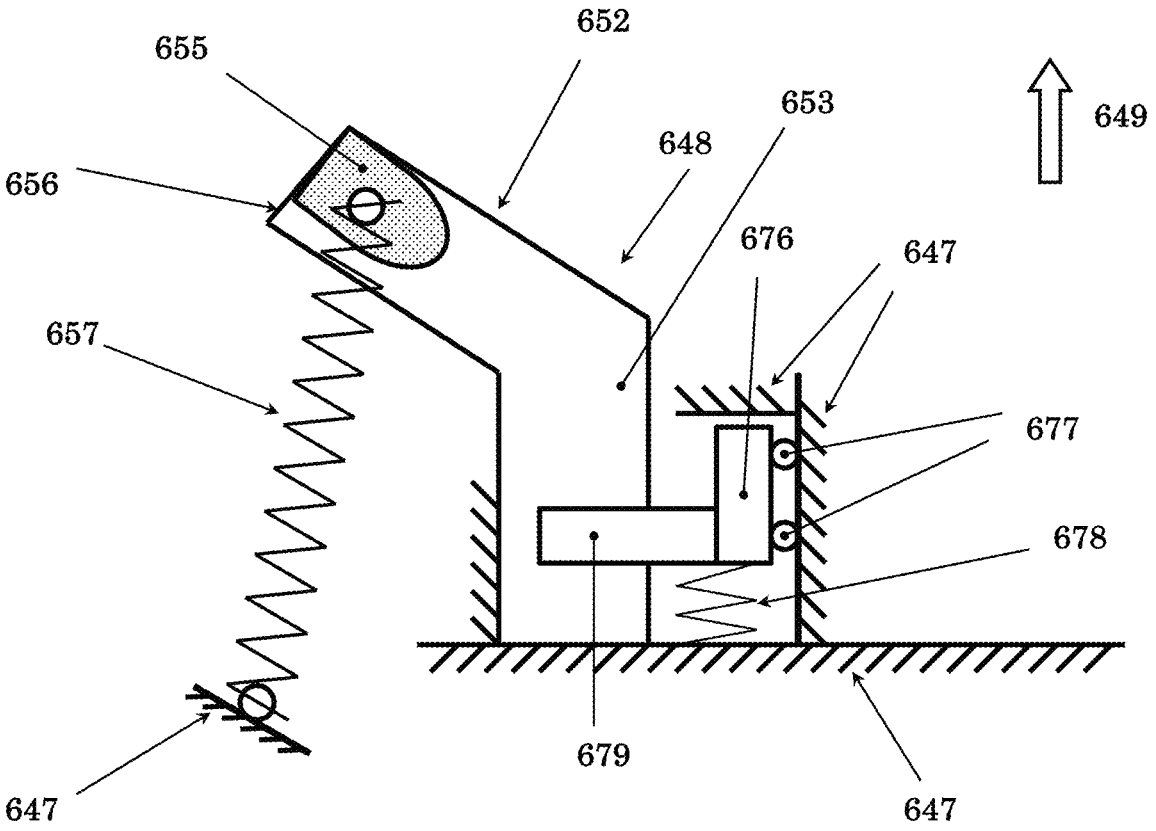
FIG. 26 illustrates a schematic of a cross-sectional view of the first embodiment of the striker mass release mechanism actuation mechanism with a sliding actuating mechanism.

In the alternative "actuation mechanism" embodiment of FIG. 26, the rotating actuating lever 570, FIG. 25, is replaced with the sliding member 676, which is free to slide along the vertical guide provided in the inertial igniter structure 647 as indicated by the rolling elements 677. The sliding member 676 is biased to stay against the provided section of the structure 647 of the inertial igniter as shown in FIG. 26 by the spring 678, which is preloaded in compression. The frontal section 679 of the sliding member 676 is extended into the portion of the passage 653. All other components of the "actuation mechanism" embodiment are identical to those of the embodiment 650 of FIG. 25

The "actuation mechanism" embodiment of FIG. 26 functions as was described for the embodiment 650 of FIG. 25. When the inertial igniter is subjected to an accidental high G but short duration acceleration in the direction of the arrow 649, the mass element 655 is first accelerated down relative to the inertial igniter structure 647, impacting the lower surface 674 in the inclined section 652 of the passage 648 (FIG. 25), bounces back, and after several impacts with the up and down surfaces 674, when the accidental acceleration has ceased, it would be pushed back towards its upper corner position against the back surface 656 (directly or after a few up and down impacts due to the residual energy left in the mass element 655 and spring 657 system).

Then as was described for the embodiment of FIG. 25, since the low firing accelerations have relatively long durations, for example 20-40 msec and sometimes longer, and since the spring 657 is very lightly preloaded in compression, for example less than an equivalent of 5-10 G over the entire range of motion of the mass element 655, therefore the mass element 655 would not bounce back and forth (if any) more than a fraction of one msec in the section 652 of the passage 648. The mass element would then slide down the passage towards the bottom surface of the passage 648 and engage the frontal section 679 of the sliding member 676 and slide it down towards the bottom surface of the passage 648 as was described for the embodiment of FIG. 25. The downward translation of the sliding member 676 is then used as is described later in this disclosure to actuate the intended device.

The most direct application of the "actuation mechanism" embodiments of FIGS. 25 and 26 is to the design of electrical impulse switches (normally open or closed and with or without latching capability) that do not activate when subjected to an accidental high G (of even several thousands of G) but short duration acceleration (for example a fraction of one msec). However, if the acceleration event that is desired to activate the electrical switch is relatively long in duration (for example several tens or hundreds of msec) and even very low in level (even a few tens of G), the electrical switch would activate.

Figure 27:
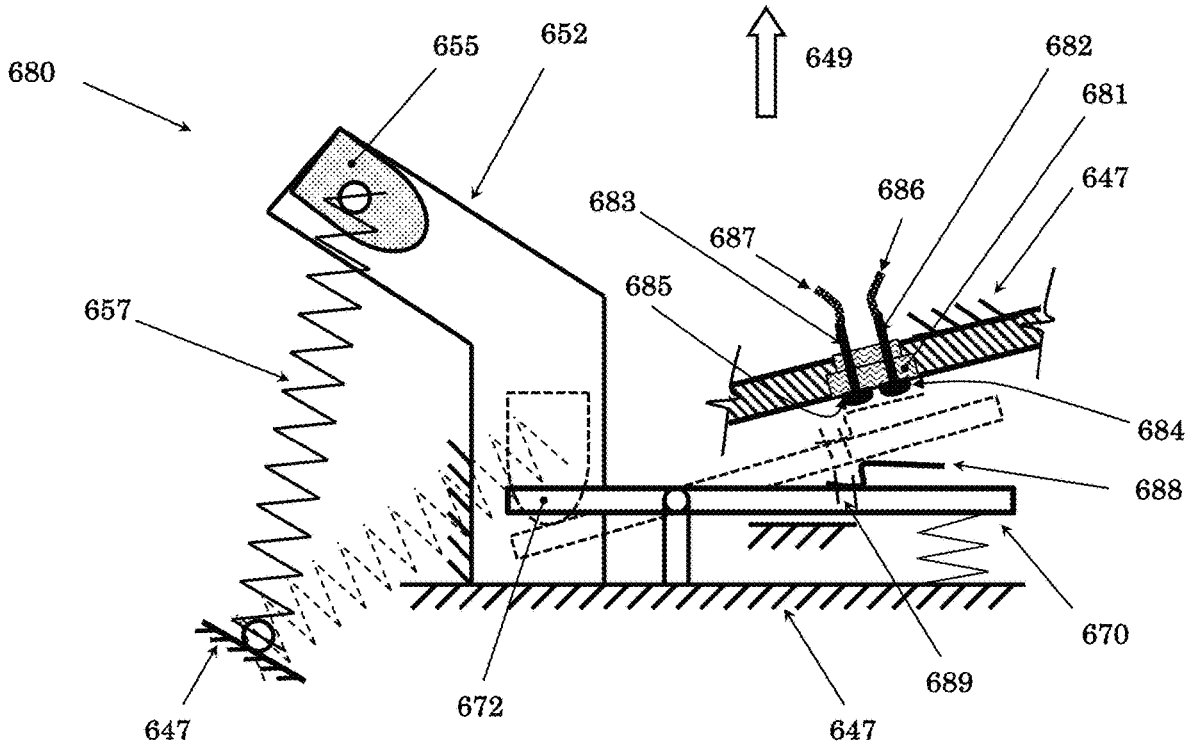
FIG. 27 illustrates a schematic of a cross-sectional view of a normally open impulse switch embodiment for closing electrical circuits when subjected to a prescribed all-fire or the like condition in its non-activated state.

The first embodiment 680 of the electrical impulse switch that uses the "actuation mechanism" of FIG. 25 is shown in the schematic of FIG. 27. The electrical impulse switch 680 of FIG. 27 is of a normally open and non-latching type. All components of the embodiment of FIG. 27 are identical to those of the embodiment of FIG. 26, except for the added switching components described below.

The "actuation mechanism" component 650, FIG. 25, which is used in the construction of the electrical impulse switch 680 of FIG. 27, operates as was previously described under high G but short duration accidental accelerations, i.e., its mass element 655 would be contained in the inclined section 652 of the passage 648 under all short duration but high G accidental accelerations in the direction of the arrow 649, but would slide down the passage to actuate the lever 670 and rotate it in the counterclockwise direction as shown by dashed lines in FIG. 25.

As can be seen in the schematic of FIG. 27, the electrical impulse switch 680 is provided with the electrical switching contacts and related elements described below to construct a normally open electrical impulse switch. In the impulse switch embodiment 680, an element 681, which is constructed of an electrically non-conductive material is fixedly attached to the structure 647 of the electrical impulse switch as shown in FIG. 27. The element 681 is provided with two electrically conductive elements 682 and 683 with electrically conductive contact ends 684 and 685, respectively. The electrically conductive elements 682 and 683 may be provided with the extended ends to form contact "pins" for direct insertion into provided holes in a circuit board or may alternatively be provided with wires 686 and 687 for connection to appropriate circuit junctions.

In the electrical impulse switch 680, the actuating lever 670 is provided with a flexible strip of electrically conductive material 688, which is fixedly attached to the surface of the lever 670 as shown in FIG. 27, for example, with fasteners 689 or by soldering or other methods known in the art.

The operation of the electrical impulse switch 680 of FIG. 27 is as follows. When the impulse switch is accelerated in the direction of the arrow 649, if the acceleration is due to accidental drops or the like that result in a high G but short duration acceleration pulse, then the mass element 655 stays in the inclined section 652 of the passage 648 as was previously described for the embodiment of FIG. 25. But if the acceleration in the direction of the arrow 649 corresponds to the prescribed low G but long duration acceleration event such as munitions firing or other similar events, then as was previously described, the mass element 655 would slide down the passage 648, engage the frontal section 672 of the lever 670 and push it down and rotate it in the counterclockwise direction as shown in dashed lines in FIG. 27, until the strip of the electrically conductive material 688 comes into contact with the contact ends 684 and 685, thereby closing the circuit to which the impulse switch 680 is connected (through the pins 682 and 683 or wires 686 and 687) as shown in the cross-sectional view of FIG. 27.

It is appreciated that in the electrical impulse switch embodiment 680 of FIG. 27, once the prescribed low G but long duration acceleration event such as munitions firing has ended, the compressively preloaded spring 657 will force the mass element 655 to return to its initial position shown with solid lines. The electrical impulse switch embodiment 680 is therefore of a non-latching and normally open type.

The electrical impulse switch embodiment 680 of FIG. 27 can also be modified to a latching and normally open type. The modification is achieved by ensuring that the mass element 655 and compressively preloaded spring 657 function together as a "toggle" type mechanism. This is readily accomplished by proper geometrical design of the electrical impulse switch as shown in the schematic of FIG. 28.

Figure 28:
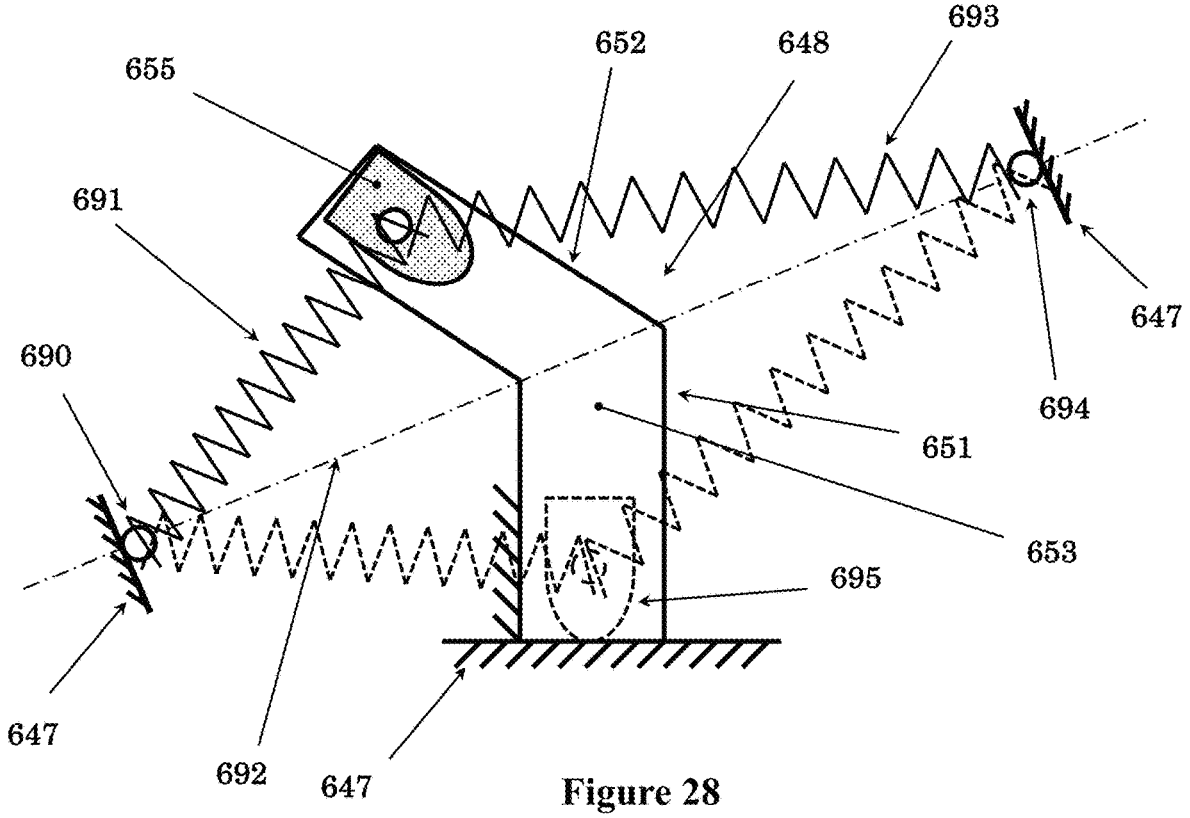
FIG. 28 illustrates a schematic of a modification of the actuation mechanism of the normally open electrical impulse switch of FIG. 27 that provides latching functionality to the normally open electrical impulse switch.

To make the mass element 655 and the tension preloaded spring 691 (657 in FIG. 27 but preloaded in tension in FIG. 28) function together as a "toggle" type mechanism, the potential energy of the tension preloaded spring 691 must be at its minima at its pre-activation position of the mass element 655 (shown with solid lines) and at its activated position shown with dashed lines and indicated by the numeral 695 in FIG. 28. This means that while at their minimum potential energy positions, any move from one minimum position (e.g., the pre-activation position shown in solid line) towards the other minimum potential energy position (shown in dashed lines) would require external force. This means that once the mass element 655 has been moved from (its pre-activation stable position) to its activated (its second stable) position 695 shown in dashed lines, it would stay at that position after the prescribed low G but long duration acceleration event such as munitions firing or other similar events has ended. Thereby, by constructing the electrical impulse switch of FIG. 27 with this arrangement of the spring 691, the switch becomes a normally open and latching type.

To ensure that the potential energy of the spring 691 is at its low points at positions corresponding to the pre-activation and post activation positions shown in solid and dashed lines, respectively, FIG. 28, the two sections 652 and 651 of the passage 648 must be inclined towards the fixed end 690 of the tension preloaded spring 691. For example, if we draw a line from the fixed end 690 of the spring 691 to the intersection of the two sections 652 and 651 as shown by the dashed line 692, since the two sections 652 and 651 are both inclined towards the spring end 690, the length of the spring 691 has to increase if the mass 655 is to be moved from its one of its stable positions (solid or dashed lines in FIG. 28) towards its other position. The mass element 655 and spring 691 assembly would therefore function as a "toggle" mechanism.

It is appreciated by those skilled in the art that the tension preloaded spring 691 may be replaced by a compression preloaded spring 693, which is attached to the structure of the electrical impulse switch at the pin joint 694 along or close to the dotted line 692, but on the opposite side of the passage 648 as shown in FIG. 28. The mass element 655 and the spring 693 would still function as a "toggle" type mechanism and their minimum (stable) potential energy positions would be those shown in FIG. 28 with solid (655) and dashed (695) lines. Thereby, by constructing the electrical impulse switch of FIG. 27 with this arrangement of the spring 693, the electrical impulse switch would also become a normally open and latching type.

It is also appreciated by those skilled in the art that the "latching" functionality of the embodiment of FIG. 28 for the electrical impulse switch embodiment of FIG. 27 may also be used to provide similar latching functionality for all applications of the "actuation mechanism" of FIGS. 25 and 26.

Figure 29:
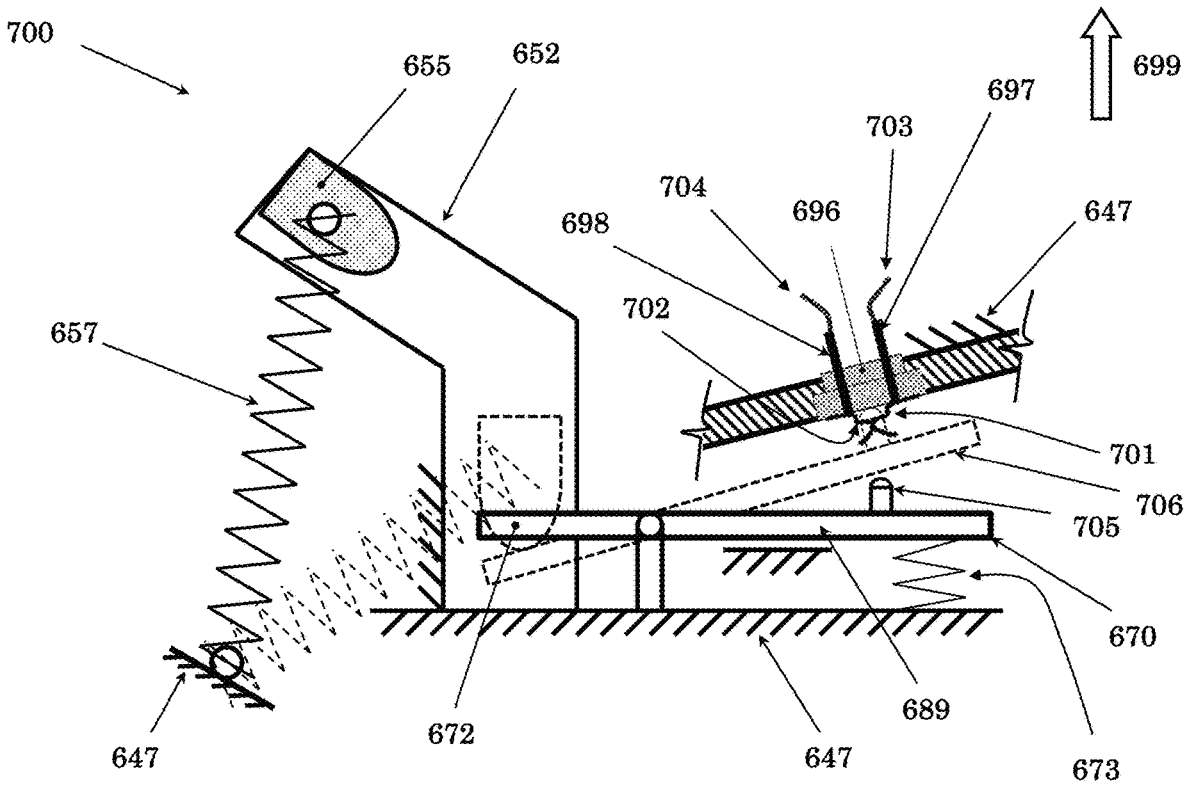
FIG. 29 illustrates a schematic of a cross-sectional view of a normally closed electrical impulse switch embodiment for opening electrical circuits when subjected to a prescribed all-fire or the like condition in its non-activated state.

The normally open electrical impulse switch 680 of FIG. 27 may also be modified to function as a normally closed electrical impulse switch. The schematic of such a normally closed impulse switch embodiment 700 is shown in FIG. 29. The basic design and operation of the electrical impulse switch 700 is identical to that of the normally open electrical impulse switch embodiment 680 of FIG. 27, except for its electrical switching contacts and related elements described below to convert it from a normally open to a normally closed impulse switch.

In the normally closed electrical impulse switch embodiment 700 of FIG. 29, like the normally open impulse switch 680 of FIG. 27, an element 696, which is constructed of an electrically non-conductive material is fixed to the electrical impulse switch structure 647. The electrically non-conductive element 696 may, for example, be attached to the electrical impulse switch structure 647 by fitting it into a provided hole or other methods known in the art. The element 696 is provided with two electrically conductive elements 697 and 698 with flexible contact ends 701 and 702 (446 and 445 in the embodiment of FIG. 15), respectively. The flexible electrically conductive contact ends 701 and 702 are biased to press against each other as seen in the schematic of FIG. 29. As a result, a circuit connected to the electrically conductive elements 697 and 698 is normally closed in the pre-activation state of the electrical impulse switch 700 as shown in the configuration of FIG. 29.

The electrically conductive elements 697 and 698 may be provided with the extended ends that form contact "pins" for direct insertion into provided holes in a circuit board or may alternatively be provided with wires 703 and 704 for connection to appropriate circuit junctions, in which case, the wires 703 and 704 may be desired to exit from the sides of the electrical impulse switch 700 (not shown).

The previously described actuation lever 670 is then provided with an electrically nonconductive wedge element 705, which is fixed to the surface of the lever 670 as shown in FIG. 29, for example, by an adhesive or using other methods known in the art.

The basic operation of the impulse switch 700 of FIG. 29 is very similar to that of the electrical impulse switch embodiment 680 of FIG. 27. When the impulse switch is accelerated in the direction of the arrow 699, if the acceleration is due to accidental drops or the like that result in a high G but short duration acceleration pulse, then the mass element 655 stays in the inclined section 652 of the passage 648, as was previously described for the embodiment of FIG. 25. But if the acceleration in the direction of the arrow 699 corresponds to the prescribed low G but long duration acceleration event such as munitions firing or other similar events, then as was previously described, the mass element 655 would slide down the passage 648, engage the frontal section 672 of the lever 670 and push it down and thereby rotate it in the counterclockwise direction as shown in dashed lines in FIG. 29, until the electrically nonconductive wedge element 705 is inserted between the contacting surfaces of the flexible electrically conductive contact ends 701 and 702 (as also shown for the embodiment of FIG. 16), thereby opening the circuit to which the electrical impulse switch 700 is connected (through the extended ends 697 and 698 or wires 703 and 704) as the lever 670 and the electrically nonconductive wedge element 705 are shown in the cross-sectional view of FIG. 29 with dashed lines and indicated by the numeral 706.

It is appreciated that in the electrical impulse switch embodiment 700 of FIG. 29, once the prescribed low G but long duration acceleration event such as munitions firing has ended, the compressively preloaded spring 657 will force the mass element 655 to return to its initial position shown with solid lines. At this point, the spring 673 is generally designed to overcome the friction forces between the flexible electrically conductive contact ends 701 and 702 and the electrically nonconductive wedge element 705, thereby pulling the lever 670 to its pre-activation position shown with solid lines, and re-establishing electrical contact between the flexible electrically conductive contact ends 701 and 702. The electrical impulse switch embodiment 700 is therefore of a non-latching and normally closed type.

It is appreciated by those skilled in the art that by constructing the electrical impulse switch embodiment 700 of FIG. 29 with this arrangement of the spring 691 or 693 shown in FIG. 28, the electrical impulse switch would become a normally closed and latching type.

In the electrical impulse switches of FIGS. 27 and 29, the "actuation mechanism" embodiment of FIG. 25 with the rotary actuating lever 670 is used in their construction. It is appreciated by those skilled in the art that the "actuation mechanism" embodiment of FIG. 26 with translating actuating member 676 may also be similarly used for the construction of such normally open and closed and latching and non-latching electrical impulse switches. As an example, the construction of a normally open and non-latching and latching electrical impulse switch with the "actuation mechanism" of FIG. 26 is described below as applied to the electrical impulse switch 680 of FIG. 27 to construct a normally open electrical impulse switch. It is appreciated by those skilled in the art that normally open and latching type may also be constructed as was described for the embodiment 680 of FIG. 27. In addition, normally closed electrical impulse switches of latching and non-latching type may also be similarly constructed with the "actuation mechanism" of FIG. 26 as was previously described for the embodiment 700 of FIG. 29.

Figure 30:
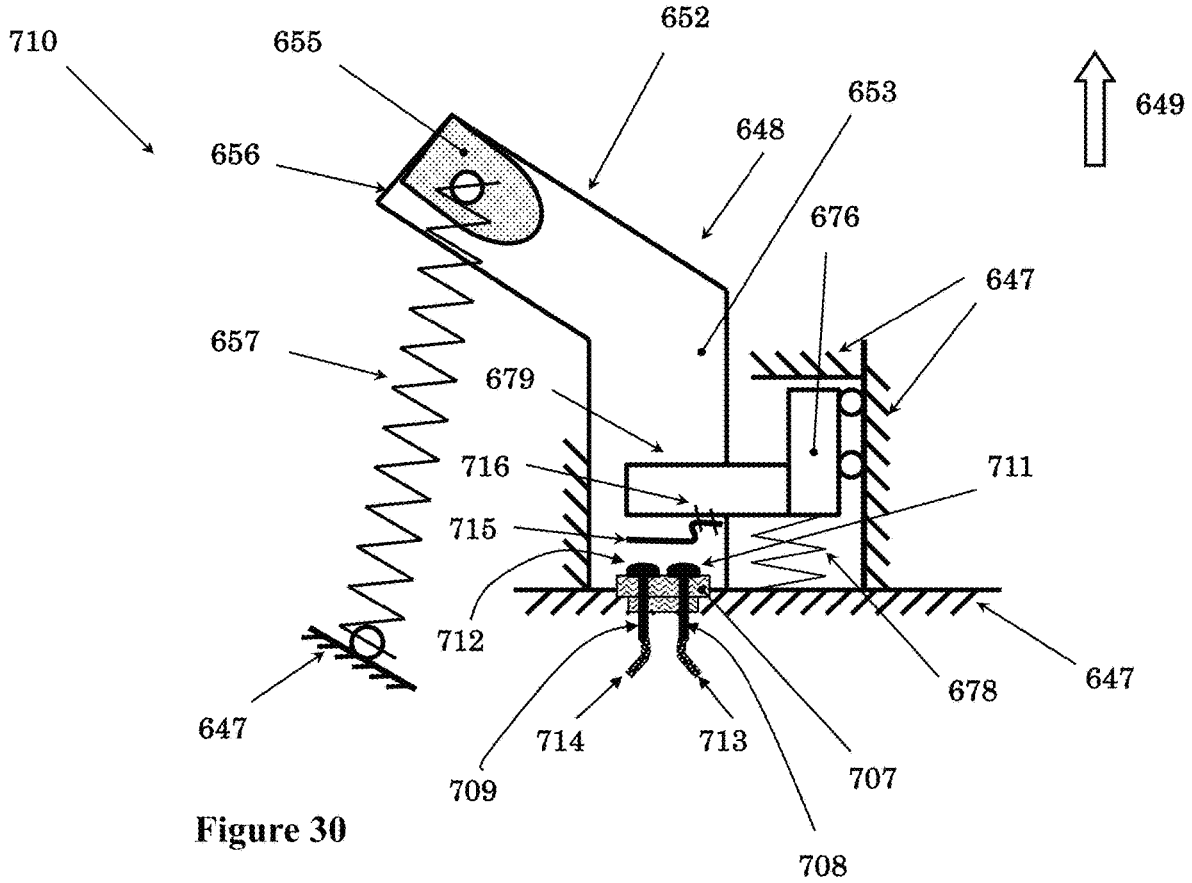
FIG. 30 illustrates a schematic of a cross-sectional view of a normally open electrical impulse switch embodiment constructed with the "actuation mechanism" of FIG. 26 for closing electrical circuits when subjected to a prescribed all-fire or the like condition in its non-activated state.

The construction of a normally open and non-latching electrical impulse switch with the "actuation mechanism" of FIG. 26 is illustrated in the schematic of FIG. 30 and indicated as the embodiment 710. To construct the electrical impulse switch 710, the element 707, which is constructed of an electrically non-conductive material is fixedly attached to the structure 647 of the electrical impulse switch as shown in FIG. 30. The element 707 is provided with two electrically conductive elements 708 and 709 with contact ends 711 and 712, respectively. The electrically conductive elements 708 and 709 may be provided with the extended ends to form contact "pins" (not shown) for direct insertion into provided holes in a circuit board or may alternatively be provided with wires 713 and 714, respectively, for connection to appropriate circuit junctions.

In the electrical impulse switch 710, the frontal section 679 of the sliding member 676 is provided with a flexible strip of electrically conductive material 715, which is fixedly attached to the surface of the frontal section 679 as shown in FIG. 30, for example, with fasteners 716 or by soldering or other methods known in the art.

The operation of the electrical impulse switch 710 is the same as that of the embodiment 680 of FIG. 27. When the impulse switch is accelerated in the direction of the arrow 649, if the acceleration is due to accidental drops or the like that result in a high G but short duration acceleration pulse, then the mass element 655 stays in the inclined section 652 of the passage 648 as was previously described for the embodiment of FIG. 25. But if the acceleration in the direction of the arrow 649 corresponds to the prescribed low G but long duration acceleration event such as munitions firing or other similar events, then as was previously described, the mass element 655 would slide down the passage 648, engage the frontal section 679 of the sliding member 676 and force it to slide down until the strip of the electrically conductive material 715 comes into contact with the contact ends 711 and 712, thereby closing the circuit to which the impulse switch 710 is connected (through the pins 708 and 709 or wires 713 and 714) as shown in the cross-sectional view of FIG. 30.

It is appreciated that in the electrical impulse switch embodiment 710 of FIG. 30, once the prescribed low G but long duration acceleration event such as munitions firing has ended, the compressively preloaded spring 657 will force the mass element 655 to return to its initial position shown with solid lines. The electrical impulse switch embodiment 710 is therefore of a non-latching and normally open type.

It is appreciated by those skilled in the art that the electrical impulse switch embodiment 710 of FIG. 30 may also be modified as was done for the embodiment 680 of FIG. 27 to convert it to a normally open latching type electrical impulse switch. The modification is achieved by ensuring that the mass element 655 and compressively preloaded spring 657 function together as a "toggle" type mechanism of illustrated in FIG. 28.

It is also appreciated by those skilled in the art that as was illustrated in the schematic of FIG. 30 and described above, the "actuation mechanism" embodiment of FIG. 26 may also be used to construct normally closed electrical impulse switches as was described for the embodiment 700 of FIG. 29. The resulting normally closed electrical impulse switch may also be modified as was done for the embodiment 680 of FIG. 27 to convert it to a normally closed latching type electrical impulse switch. The modification is similarly achieved by ensuring that the mass element 655 and compressively preloaded spring 657 function together as a "toggle" type mechanism of illustrated in FIG. 28.

It is appreciated by those skilled in the art that in the normally open and normally closed latching type electrical impulse switches of the embodiments of FIGS. 27, 29 and 30, the "actuation mechanism" of the type shown in FIG. 28 was used to achieve the latching functionality of the switches. When the "actuation mechanism" of the FIG. 28 type is used in electrical impulse switches or as is described later in this disclosure in inertial igniters, if the device using such impulse switches or inertial igniters is subjected to high levels of vibration or shock loading or the like, then the mass element 655 may at some point be driven to its starting stable position shown in solid lines to its activated position shown in dashed lines in FIG. 28. To avoid such an event, the "toggle" type "actuation mechanism" used in such devices may be provided with a "one-way" passage travel mechanism shown schematically in FIG. 31.

Figure 31:
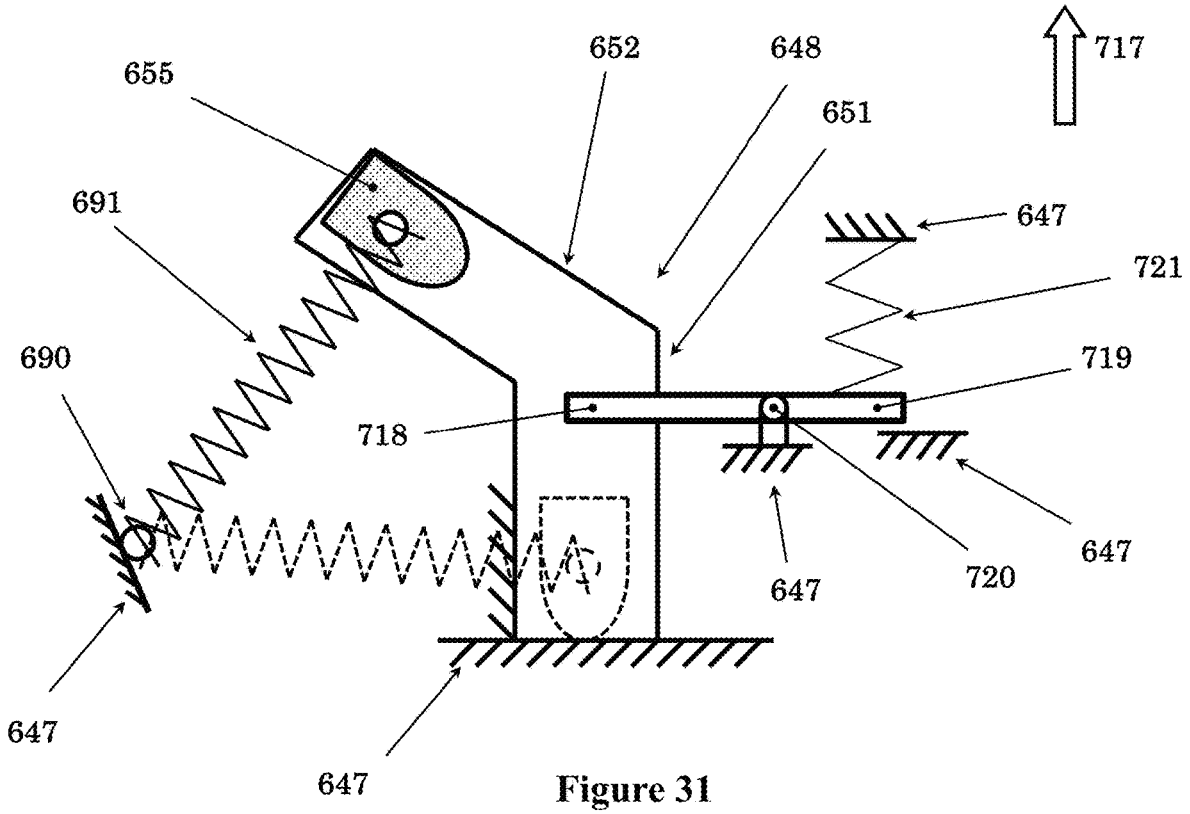
FIG. 31 illustrates a schematic of a modification of the actuation mechanisms of FIGS. 25 and 26 to provide a no-return mechanism to keep the mass element of the mechanism in an actuated state following mechanism actuation.

The operation of the "toggle" type "actuation mechanism" of FIG. 31 is as follows. When the actuation mechanism is accelerated in the direction of the arrow 717, if the acceleration is due to accidental drops or the like that result in a high G but short duration acceleration pulse, then the mass element 655 stays in the inclined section 652 of the passage 648 as was previously described for the embodiment of FIG. 25. But if the acceleration in the direction of the arrow 717 corresponds to a prescribed low G but long duration acceleration event such as munitions firing or other similar events, then as was previously described, the mass element 655 would slide down the passage 648. As the mass element 655 slides down 651 of the passage 648, it would actuate the lever 670 as was described for the embodiments of FIGS. 25, 27 and 29 or the frontal section 679 of the sliding member 676 of the embodiments of FIGS. 26 and 30 or other embodiments of inertial igniters to be described later in this disclosure that use the actuation mechanisms of FIG. 25 or 26 with or without the mass element 655 and spring 657 configurations of FIG. 28.

In the actuation mechanism embodiment of FIG. 31, as the mass element 655 slides down the passage 648 to perform its aforementioned actuation function, it presses on the tip 718 of the "one-way" mechanism lever 719. The lever 719 is attached to the structure 647 of the actuation mechanism as shown in FIG. 31. In its configuration shown in FIG. 31, the lever 719 is constrained from rotating in the clockwise direction by the structure of the actuation mechanism 647. The lever 719 can be forced to rotate in the counterclockwise direction, but is provided with a compressively preloaded spring 721, which biases it to stay at its configuration of FIG. 31.

Thus, as the mass element 655 slides down the passage 648, it would engage the tip 718 of the lever 719 and rotate it enough to allow it to pass the lever to the position shown in dashed lines in FIG. 31 (while actuating other aforementioned mechanisms—not shown in FIG. 31). Then once the mass element 655 has passed the tip 718, the lever 719 is forced to return to its position of FIG. 31. As a result, the mass element 655 is trapped in its position below the lever 719 and cannot be returned to its pre-actuation position shown in solid lines.

As it was previously indicated, the "actuation mechanism" embodiments of FIGS. 25 and 26, with or without the "toggle" type mechanisms of the embodiment of FIG. 28, may be used to actuate striker mass release mechanisms of many inertial igniter designs, such as inertial igniter designs shown in the embodiments of FIGS. 6-12 and 17-18. The resulting novel inertial igniters can then satisfy the aforementioned very high G (e.g., several thousands of G) but short duration (usually a fraction of one msec) accidental accelerations while they can also satisfy all-fire low G (a few tens of G) but relatively long duration (tens of msec) firing accelerations. Such inertial igniters satisfy the above highly restrictive no-activation (no-fire in munitions) and activation (all-fire in munitions) conditions by employing the previously described impact process to develop mechanisms for actuating their striker mass release mechanisms.

As stated above, in the present novel inertial igniters, the "actuation mechanism" embodiments of FIGS. 25 and 26, with or without the "toggle" type mechanisms of the embodiment of FIG. 28, are used to construct inertial igniter that can satisfy the above highly demanding all-fire and no-fire acceleration level and duration conditions. Here, the general method of using the above "actuation mechanism" types to construct such inertial igniters is described by their application to the inertial igniter embodiment 300 of FIGS. 6-10 to construct the inertial igniter embodiment 725 of FIG. 32.

Figure 32:
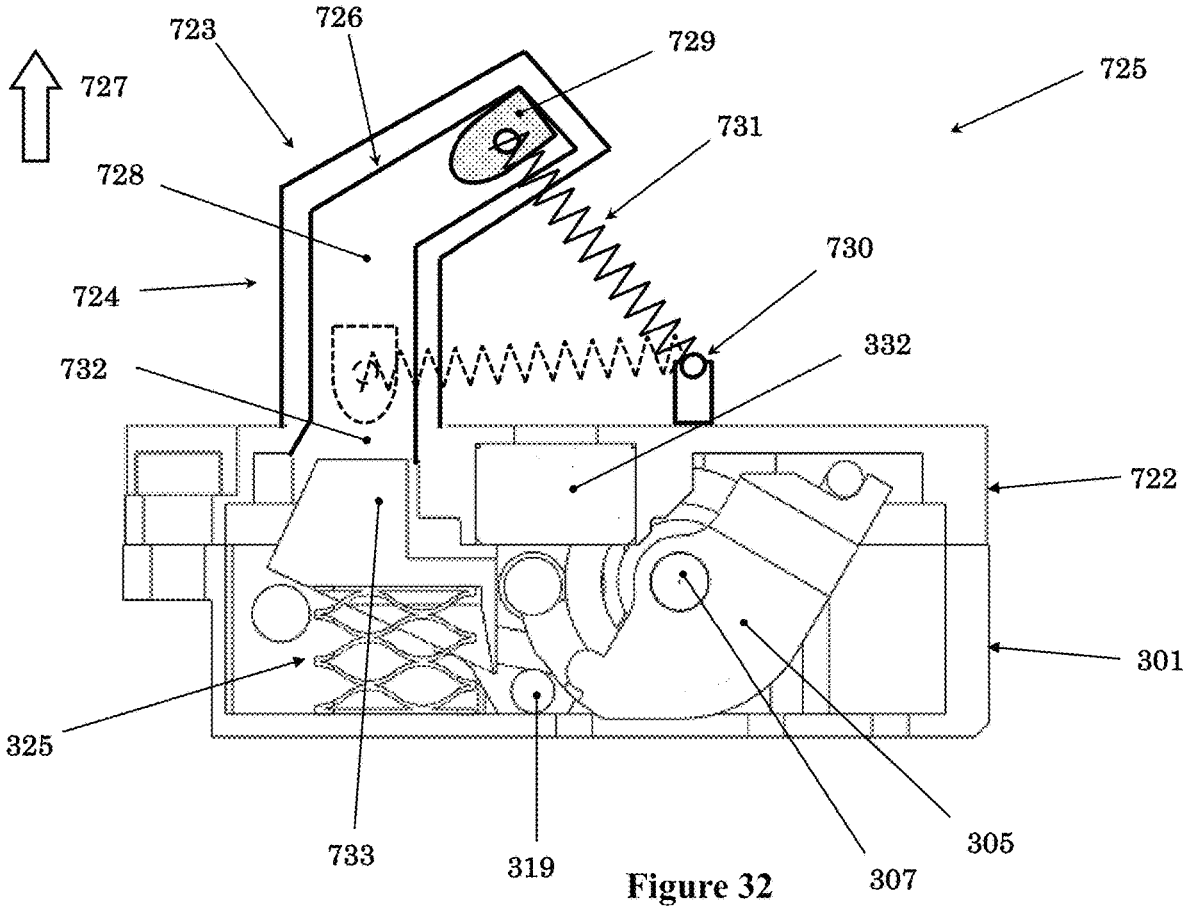
FIG. 32 illustrates a schematic of a cross-sectional view of the inertial igniter embodiment of FIGS. 6-10 with the striker mass release actuation mechanism of FIG. 28 to achieve very high G and short duration no-fire and low G and relatively long duration all-fire activation capability.

In the schematic of the inertial igniter embodiment 725 of FIG. 32, the cross-sectional view of the FIG. 8 of the embodiment 300 shown in the views of FIGS. 6-10 is shown as integrated with the "toggle" type actuation mechanism of FIG. 28 with its tension preloaded spring 691 configuration. All components of the inertial igniter 300 used in the embodiment of 725 remain the same and are indicated with the numerals except those that are modified as described below.

In the embodiment 725, the "toggle" type actuation mechanism of FIG. 28 is shown to be attached to the cap 722 (302 in FIG. 8) of the inertial igniter. The "passage" 723 structure (648 in FIG. 28) is fixedly attached to the cap 722 as shown in FIG. 32. Similar to "toggle" type actuation mechanism of FIG. 28, the "passage" 723 is provided with the section 724 (651 in FIG. 28), which is directed in the direction of the firing acceleration as indicated by the arrow 727 and a relatively inclined section 726 (652 in FIG. 28) as shown in the FIG. 32. The two sections 724 and 726 provide the passage (653 and 654 in FIG. 25) within which the mass element 729 (655 in FIG. 28) can travel. An opening 732 is also provided in the cap 722 under the passage section 724 to allow the mass element 729 to pass through and engage the release lever 733.

The tension preloaded spring 731 (691 in FIG. 28) connects the mass element 729 to the cap 722 at the point 730 (preferably a rotary or similar joint).

As was described for the actuation mechanism of FIG. 28, to ensure that the potential energy of the spring 731 is at its low points at positions corresponding to the pre-activation and post activation positions shown in solid and dashed lines, respectively, FIG. 32, the two sections 724 and 726 of the passage 723 must be inclined towards the fixed end 730 of the tension preloaded spring 731. The mass element 729 and spring 731 assembly would therefore function as a "toggle" mechanism. It is, however, appreciated that since following activation of the inertial igniter the mass element does not have to stay in the activated position shown by dashed lines, therefore the mass element 729 and spring 731 as configured as described for the "actuation mechanism" of the embodiment of FIG. 25 (with compressively preloaded spring) may also be used.

The inertial igniter embodiment of 725 of FIG. 32 functions as follows. When the inertial igniter is subjected to an accidental high G but short duration acceleration in the direction of the arrow 727, as was previously described for the mass-spring system of FIG. 25, the mass element 729 is first accelerated down relative to the inertial igniter structure, impacting and bouncing up and down the surfaces of the passage 726, and after several up and down impacts, when the accidental acceleration has ceased, it would be pushed back towards its upper corner position as shown by solid lines in FIG. 32.

However, since the low firing accelerations have relatively long durations, for example 20-40 msec and sometimes longer, and since the spring 731 will be very lightly preloaded in tension, for example less than an equivalent of 5-10 G over the entire range of motion of the mass element 729, therefore the mass element 729 would not bounce back and forth (if any) at most a few msec in the section 726 of the passage 723, and would slide down the passage towards the cap 722, pass through the opening 732 and engage the release lever 733 and force it down and cause it to rotate in the counterclockwise direction as viewed in FIG. 8, thereby releasing the striker mass 305 and allowing it to be accelerated rotationally in the clockwise direction and striking and igniting the primer 332 as was described for the embodiment 300 of FIGS. 6-10.

It is appreciated by those skilled in the art that in the embodiment 300 of FIGS. 6-10, the center of mass of the release lever 318 is positioned to the left of its rotary joint 319 as viewed in the cross-sectional view of the FIG. 8, so that the acceleration of the inertial igniter in the direction of the arrow 330 would act on the inertia of the release lever 318, generating a toque that would tend to rotate it in the counter-clockwise direction. Then as was previously described for the inertial igniter 300, when the acceleration level is high enough and is applied long enough corresponding to the all-fire condition of the inertial igniter, then the generated inertial torque overcomes all described resisting forces and rotate the release lever in the counter-clockwise direction far enough to release the striker mass and allow it to strike the primer 332 and ignite it.

In the embodiment 725 of FIG. 32, however, the center of mass of the release lever 733 is positioned close to the rotary joint 319 and slightly to its right as viewed in the cross-sectional view of the FIG. 32, so that the acceleration of the inertial igniter in the direction of the arrow 727 would act on the inertia of the release lever 733, generating a very small toque that would tend to rotate it in the clockwise direction. Then unlike the inertial igniter 300, acceleration in the direction of the arrow 727 (330 in FIG. 8) alone cannot rotate the release lever 733 in the counter-clockwise direction and release the striker mass 305 as was previously described for the embodiment 300. Thus, the release lever 733 of the inertial igniter embodiment 725 can only be rotated in the counter-clockwise direction by the engaging mass element 729 as shown in FIG. 32 by dashed lines as a result of low G and relatively long duration all-fire accelerations as was described above and release the striker mass to initiate the primer 332.

It is appreciated by those skilled in the art that the inertial igniter embodiment 725 of FIG. 32 is also capable of satisfying the previously indicated high G and short duration accidental accelerations that it is subjected to from any direction. This feature is essential in munitions since dropping on hard surfaces may occur in any direction, therefore the inertial igniter used in the munition may experience such accidental high G loading from almost any direction. An examination of the inertial igniter embodiment 725 shown in FIG. 32 clearly shows that if the inertial igniter is subjected to accidental acceleration in the direction perpendicular to the view of FIG. 32, the mass element 729 will not be forced to move down the passage 723. If the accidental acceleration is in the right or left direction in the view of FIG. 32, then it may cause the mass element 729 to impact the inner surfaces of the section 726 of the passage 723, and eventually come to rest in its initial (stable) position shown in solid lines due to the short duration of such accidental accelerations as was previously described for the accidental acceleration in the direction of the arrow 727.

It is appreciated by those skilled in the art that the actuation mechanism embodiment 650 of FIG. 25 and the embodiments of FIG. 28 perform their high G and short duration function by the described "trapping" of the mass element 655 in the inclined section 652 of the passage 648 and that the inclined section 652 and the vertical section 653 of the passage allows the mass element 655 to slide down relatively slowly under the significantly longer duration but low G acceleration in the direction of the arrow 649, FIG. 25. The basic geometry of the above actuation mechanisms that enables its impacting mass element "trapping" functionality can be achieved using passages (648 in FIGS. 25 and 28) of many other geometries. One such basic geometry is obtained by "wrapping" the inclined section 652 of the passage 648 over the internal surface of a cylindrical tube, i.e., forming a helical "nut". The mass element 655 must then be shaped with matching fitting "threads" with enough radial clearance to allow free play. The threads must also provide enough axial clearance to allow axial impacts similar between the mass element 655 and inner surfaces 674 of the section 652, FIG. 25. This "screw" type "actuation mechanisms" are best illustrated by the embodiment 740 in the schematic of FIG. 33.

Figure 33:
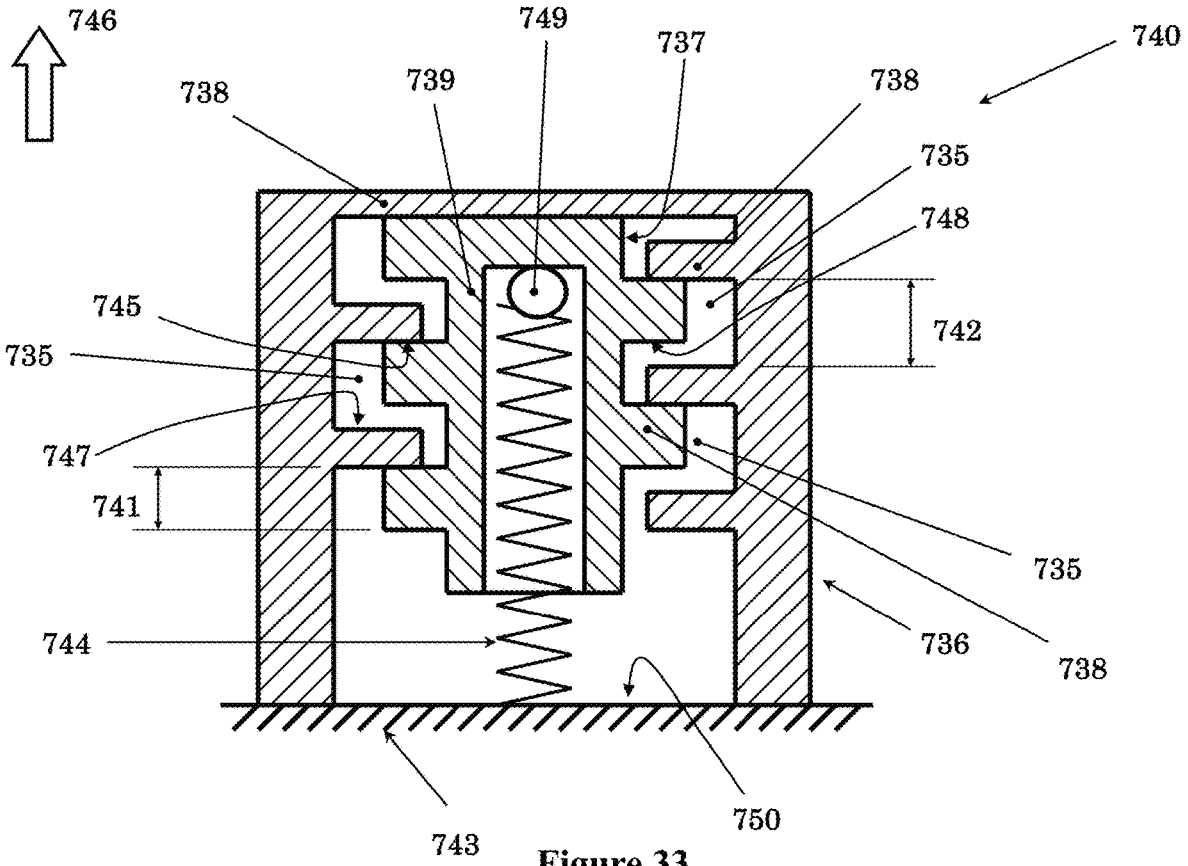
FIG. 33 illustrates a process of using impact to reduce the velocity of a mass constructed with a helical groove, such as a screw, and supported by a soft spring and positioned in a solid element with loosely mating helical band that is attached to an accelerating platform.

The cross-sectional view of the "screw" type "actuation mechanism" embodiment 740 is shown in the schematic of FIG. 33. The embodiment 740 is shown to be constructed with the cylindrical body 736, which is provided with the aforementioned "helical" "nut" shaped groove 735 inside the cylinder body as shown in FIG. 33. The groove 735 may be continuously formed or may be constructed in segments with certain ranges missing to reduce the total surface area of the helix. The embodiment 740 may be provided with one or multiple "helical" strands as is common in lead screws. In the schematic of FIG. 33, the groove profile is shown to be square in shape, but it is appreciated that different profiles may also be used and would provide different actuation device performance, a few of which are discussed later in this disclosure.

In the "screw" type "actuation mechanism" embodiment 740, the "screw" element 737 (corresponding to the mass element 655 in the actuation mechanism embodiment 650 of FIG. 25) is provided with mating helical "thread" 738, which is seen around the body 739 of the "screw" element 737. Similar to the grooves 735, the helical thread 738 may be continuously formed or may be constructed in segments with certain ranges missing to reduce the total surface area of the helix. When multiple strands of the grooves 735 are provided on the body 736 of the actuation device 740, matching multiple strand of threads 738 are provided on the body 739 of the "screw" element 737. The profile of the threads 738 may or may not match to match those of the grooves 735 to ensure surface to surface contact.

The width 741 of the "threads" 738 are made to be less than the width 742 of the grooves 735. The cylindrical body 736 of the actuation mechanism 740 is fixedly attached to the base 743 of the device using the actuation mechanism. A compressively preloaded spring 744 is provided to bias the upper surface 745 of the "threads" 738 of the "screw" element 737 to stay in contact with the upper surfaces of the grooves 735 in resting conditions as shown in FIG. 33.

The "actuation mechanism" embodiment of 740 functions similarly to the embodiment 650 of FIG. 25 as follows. When the inertial igniter in which the "actuation mechanism" 740 is used for striker mass release mechanism actuation is subjected to an accidental high G but short duration acceleration in the direction of the arrow 746, as was previously described for the mass-spring system of FIG. 24, the "screw" element 737 (corresponding to the mass element 655 in the embodiment 650 of FIG. 25) is first accelerated down relative to the cylindrical body 736 and the base 743 of the actuation mechanism. The bottom surface 748 of the "threads" 738 of the "screw" element 737 will then impact the lower surface 747 of the grooves 735, bounces back, and after several impacts with the up and down surfaces of the grooves 735, when the accidental acceleration has ceased, the "screw" element will be pushed back towards its upper most position by the preloaded compressive spring 744 against the top surface of the cylindrical body 736 as shown in FIG. 33.

However, since the low firing accelerations have relatively long durations, for example 20-40 msec and sometimes longer, and since the spring 744 is very lightly preloaded in compression, for example less than an equivalent of 5-10 G over the entire range of downward motion of the "screw" element 737, therefore the "screw" element 737 would not bounce up and down much (if any) more than a few msec or even a fraction of one msec, and would rotate and slide down the (as a screw in a nut-similar to the mass element 655 in the inclined passage 654 in the embodiment 650 of FIG. 25) towards the bottom surface 750 of the device. It is appreciated that if the "actuation mechanism" 740 is also provided with an actuation lever such as the lever 670 of the embodiment 650 of FIG. 25, then as the "screw" element 737 moves down, it would similarly engage and actuate the lever 670 by pressing down on its tip portion 672.

It is appreciated that as the "screw" element 737 rotates and travel downward in the cylindrical body 736, its contact surface with the top end of the spring 744 slides against the spring end. To minimize friction forces between the sliding surfaces, a ball 749 or a trust bearing may be provided between the spring 744 and the surface of the "screw" element 737 as shown in FIG. 33.

It is appreciated by those skilled in the art that the profiles of the impacting surfaces of the "threads" 738 of the "screw" element 737 and the grooves 735 may be shaped to increase or decrease the energy losses during each impact and vary the direction of bouncing of the "screw" element 737 to vary the rate of downward travel when subjected to aforementioned high G short duration accelerations in the direction of the arrow 746. The pitch and the number of thread strands of the "screw" element may also be varied to achieve the desired rate of downward travel. The methods described for the "actuation mechanism" of FIG. 26, such as the use of materials or contact surfaces that are more resilient or have higher internal damping and the like may also be used to increase the energy dissipation rate during each impact between the surfaces of the "threads" 738 of the "screw" element 737 and the grooves 735.

It is appreciated by those skilled in the art that similar to the inertial igniter embodiment 725 of FIG. 32, the "actuation mechanism" embodiment 740 of FIG. 33 may be used to construct an inertial igniter that can satisfy the aforementioned highly demanding all-fire and no-fire acceleration level and duration conditions. Here again, the general method of using the type of "actuation mechanism" of the embodiment 740 of FIG. 33 to construct such inertial igniters is described by its application to the inertial igniter embodiment 300 of FIGS. 6-10 to construct the inertial igniter embodiment 755 of FIG. 34.

Figure 34:
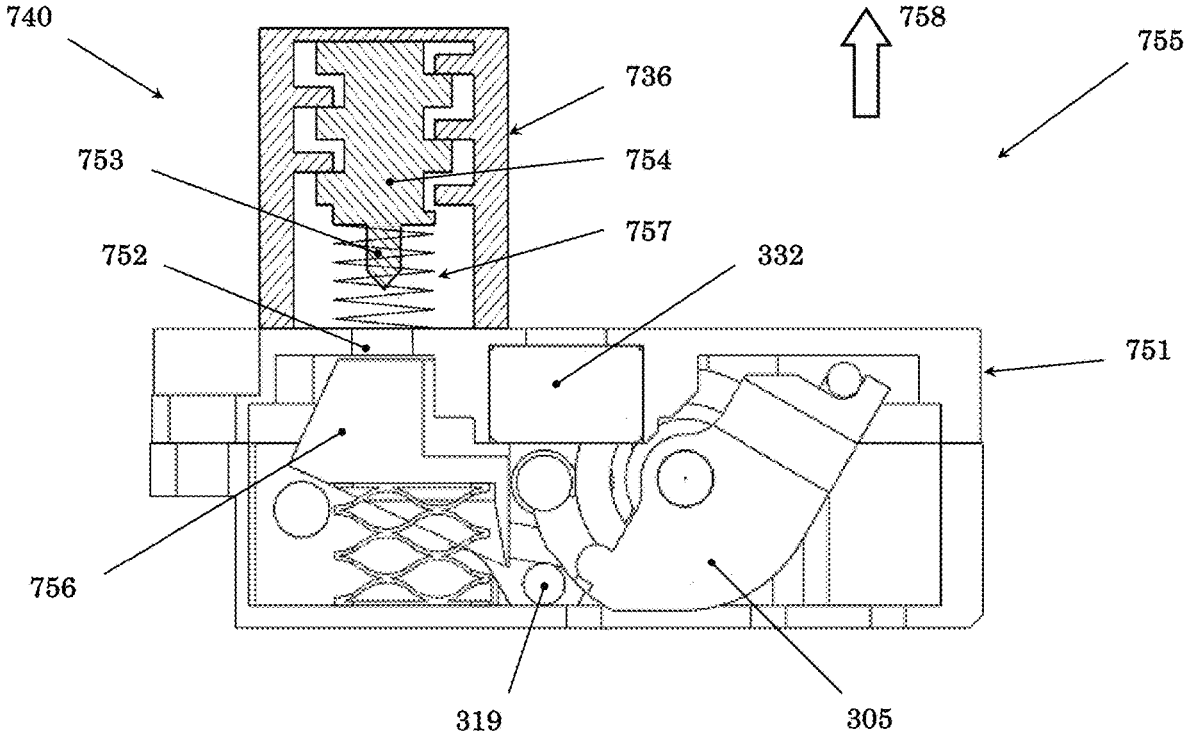
FIG. 34 illustrates a schematic of a cross-sectional view of the inertial igniter embodiment of FIGS. 6-10 with the striker mass release actuation mechanism of FIG. 33 to achieve very high G and short duration no-fire and low G and relatively long duration all-fire activation capability.

In the schematic of the inertial igniter embodiment 755 of FIG. 34, the cross-sectional view of the FIG. 8 of the embodiment 300 shown in the views of FIGS. 6-10 is shown as integrated with the "screw" type "actuation mechanism" embodiment 740 of FIG. 33. All components of the inertial igniter 300 used in the embodiment of 725 remain the same and are indicated with the same numerals except those that are modified as described below.

In the inertial igniter embodiment 755 of FIG. 34, the "screw" type "actuation mechanism" embodiment 740 of FIG. 33 is shown to be attached to the cap 751 (302 in FIG. 8) of the inertial igniter embodiment 300, FIG. 8. The cylindrical body 736 of the "actuation mechanism" is fixedly attached to the cap 751 as shown in FIG. 34. An opening 752 is provided in the cap 751 under the cylindrical body 736 of the "actuation mechanism" to allow the actuating tip 753 of the "screw" element 754 (737 in FIG. 33) to pass through and engage the release lever 756 (318 in the embodiment 330 of FIG. 8). The preloaded compressive spring 744, FIG. 33, is replaced by the preloaded compressive spring 757 to allow for the provision of the actuating tip 753 on the "screw" element 754. The inner space for the preloaded compressive spring 744 in the "screw" element 737 shown in FIG. 33 is thereby eliminated. The geometry of the "screw" element 754 is otherwise identical to that of the "screw" element 737 of FIG. 33.

The inertial igniter embodiment of 755 of FIG. 34 functions as follows. When the inertial igniter is subjected to an accidental high G but short duration acceleration in the direction of the arrow 758, as was previously described for the "actuation mechanism" of FIG. 33, the "screw" element 754 (737 in FIG. 33) is first accelerated down relative to the cylindrical body 736 towards the cap 751 of the inertial igniter. The bottom surface 748 of the "threads" 738 of the "screw" element 737 will then impact the lower surface 747 of the grooves 735, bounces back, and after several impacts with the up and down surfaces of the grooves 735, when the accidental acceleration has ceased, the "screw" element will be pushed back towards its upper most position by the preloaded compressive spring 757 against the top surface of the cylindrical body 736 as shown in FIG. 33.

However, since the low firing accelerations have relatively long durations, for example 20-40 msec and sometimes longer, and since the preloaded compressive spring 757 is relatively soft and is very lightly preloaded in compression, for example less than an equivalent of 5-10 G over the entire range of downward motion of the "screw" element 754, therefore the "screw" element 754 would not bounce up and down much (if any) a few msec or even a fraction of one msec, and would rotate and slide down the (as a screw in a nut-similar to the mass element 655 in the inclined passage 654 in the embodiment 650 of FIG. 25) towards the cap 751 of the inertial igniter. The tip 753 of the "screw" element 754 would then pass through the opening 752 and engage the release lever 756 and force it down and cause it to rotate in the counterclockwise direction as viewed in FIG. 34, thereby as was described for the embodiment 300 of FIGS. 6-10, releasing the striker mass 305 and allowing it to be accelerated rotationally in the clockwise direction as seen in the view of FIG. 34 and striking and igniting the primer 332, FIG. 8.

Similar to the inertial igniter embodiment 725 of FIG. 32, in the embodiment 755 of FIG. 34, the center of mass of the release lever 756 is positioned close to the rotary joint 319 and slightly to its right as viewed in the cross-sectional view of the FIG. 34, so that the acceleration of the inertial igniter in the direction of the arrow 758 would act on the inertia of the release lever 756, generating a very small toque that would tend to rotate it in the clockwise direction. Then unlike the inertial igniter 300, acceleration in the direction of the arrow 758 alone cannot rotate the release lever 756 in the counterclockwise direction and release the striker mass 305 as was previously described for the embodiment 300. Thus, the release lever 756 of the inertial igniter embodiment 755 can only be rotated in the counterclockwise direction by the engaging tip 753 of the "screw" element 754 through the opening 752 due to the low G but long duration all-fire accelerations. The release lever 756 is then forced down, causing it to rotate in the counterclockwise direction as viewed in FIG. 34, thereby as was described for the embodiment 300 of FIGS. 6-10, releasing the striker mass 305 and allowing it to be accelerated rotationally in the clockwise direction as seen in the view of FIG. 34, striking and igniting the primer 332.

It is appreciated by those skilled in the art that the inertial igniter embodiment 755 of FIG. 34 is also capable of satisfying the previously indicated high G and short duration accidental accelerations that it is subjected to from any direction. This feature is essential in munitions since dropping on hard surfaces may occur in any direction, therefore the inertial igniter used in the munition may experience such accidental high G loading from almost any direction. An examination of the inertial igniter embodiment 755 shown in FIG. 34 clearly shows that if the inertial igniter is subjected to accidental acceleration in the direction perpendicular to the view of FIG. 34, "screw" element 754 will not be forced to move down towards the cap 751. If the accidental acceleration is in the right or left direction in the view of FIG. 34, then it may cause the "screw" element 754 to impact the inner surfaces of the cylindrical body 736, and eventually come to rest in its initial uppermost position shown in FIG. 34.

It is appreciated by those skilled in the art that the "screw" type "actuation mechanism" embodiment 740 of FIG. 33 may also be used to construct normally open or closed electrical impulse switches of latching and non-latching types similar to those constructed with the "actuation mechanism" of FIGS. 25 and 26 as described below.

Figure 35:
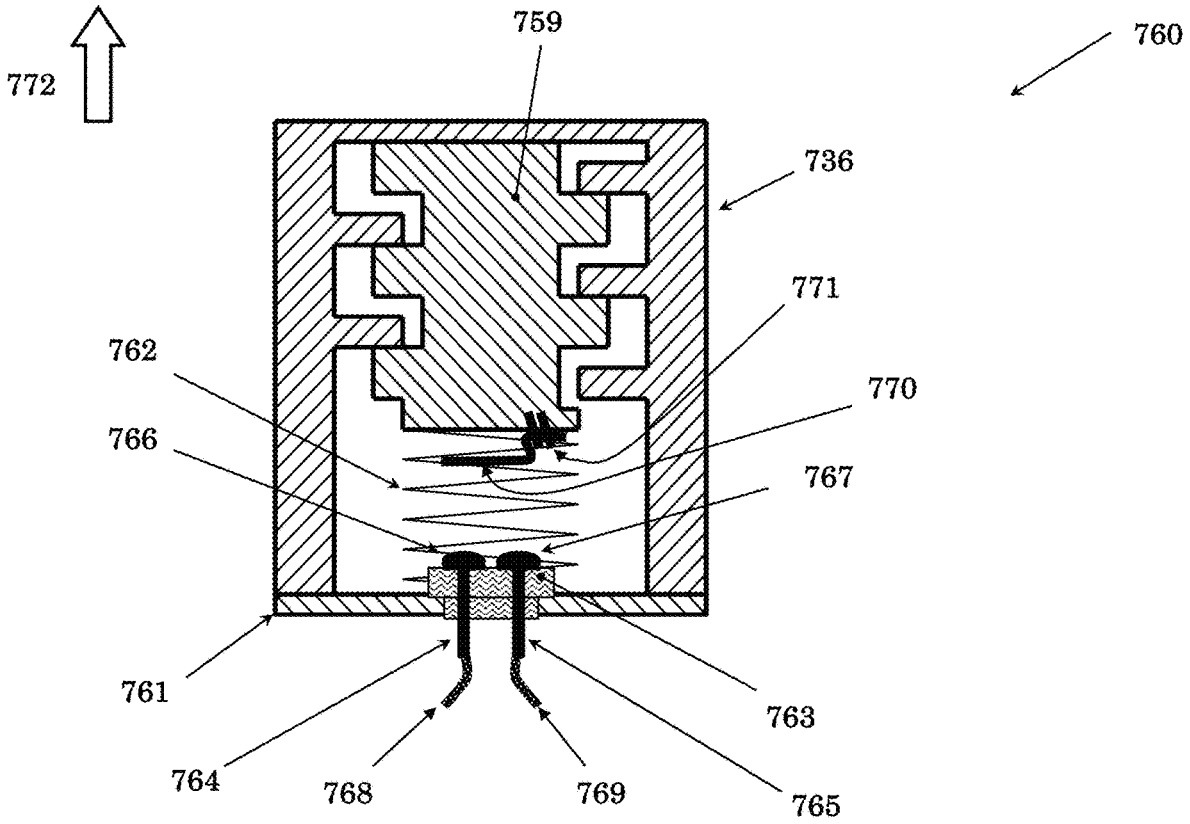
FIG. 35 illustrates a schematic of a cross-sectional view of a normally open and non-latching impulse switch embodiment for closing electrical circuits when subjected to a prescribed all-fire or the like condition in its non-activated state.

The embodiment 760 of the electrical impulse switch that that is constructed with the "screw" type "actuation mechanism" embodiment 740 of FIG. 33 is shown in the schematic of FIG. 35. The electrical impulse switch 760 is of a normally open and non-latching type. All components of the embodiment of FIG. 35 are identical to those of the embodiment of FIG. 33, except for the "screw" element 754 and the added switching components described below.

The "actuation mechanism" component 740, FIG. 33, which is used in the construction of the electrical impulse switch 760 of FIG. 35, operates as was previously described under high G but short duration accidental accelerations, i.e., the "screw" element 759 (737 in FIG. 33) is first accelerated down relative to the cylindrical body 736 and the base 761 of the electrical impulse switch. The bottom surface 748 of the "threads" 738 of the "screw" element 759 (737 in FIG. 33) will then impact the lower surface 747 of the grooves 735, bounces back, and after several impacts with the up and down surfaces of the grooves 735, when the accidental acceleration has ceased, the "screw" element will be pushed back towards its upper most position by the preloaded compressive spring 762 (744 in FIG. 33) against the top surface of the cylindrical body 736 as shown in FIG. 33.

As can be seen in the schematic of FIG. 35, the electrical impulse switch 760 is provided with the electrical switching contacts and related elements described below to construct a non-latching normally open electrical impulse switch. In the impulse switch embodiment 760, an element 763, which is constructed of an electrically non-conductive material is fixedly attached to the base 761 of the electrical impulse switch as shown in FIG. 35. The element 763 is provided with two electrically conductive elements 764 and 765 with electrically conductive contacts 766 and 767, respectively. The electrically conductive elements 764 and 765 may be provided with the extended ends to form contact "pins" for direct insertion into provided holes in a circuit board or may alternatively be provided with wires 768 and 769, respectively, for connection to appropriate circuit junctions.

In the electrical impulse switch 760, the "screw" element 759 is provided with a flexible strip of electrically conductive material 750, which is fixedly attached to the surface of the "screw" element 759 as shown in FIG. 35, for example, with fasteners 751 or by soldering or other methods known in the art.

The operation of the electrical impulse switch 760 of FIG. 35 is as follows. When the impulse switch is accelerated in the direction of the arrow 772, if the acceleration is due to accidental drops or the like that result in a high G but short duration acceleration pulses, then the thread surfaces of the "screw" element 759 impacts the up and down surfaces of the grooves in the cylindrical body 736 and turns slightly as a result as was described previously and eventually returns back to its initial position shown in FIG. 35. But if the acceleration in the direction of the arrow 772 corresponds to the prescribed low G but long duration acceleration event such as munitions firing or other similar events, then as was previously described, "screw" element 759 would turn and slide down until the strip of the electrically conductive material 770 comes into contact with the contact ends 766 and 767, thereby closing the circuit to which the impulse switch 760 is connected (through the pins 764 and 765 or wires 768 and 769) as shown in the cross-sectional view of FIG. 35.

It is appreciated that in the electrical impulse switch embodiment 760 of FIG. 35, once the prescribed low G but long duration acceleration event such as munitions firing has ended, the compressively preloaded spring 762 will force the "screw" element 759 to return to its initial position shown FIG. 35, thereby separating the strip of the electrically conductive material 770 from the contacts 766 and 767. The electrical impulse switch embodiment 760 is therefore of a non-latching and normally open type.

Figure 36:
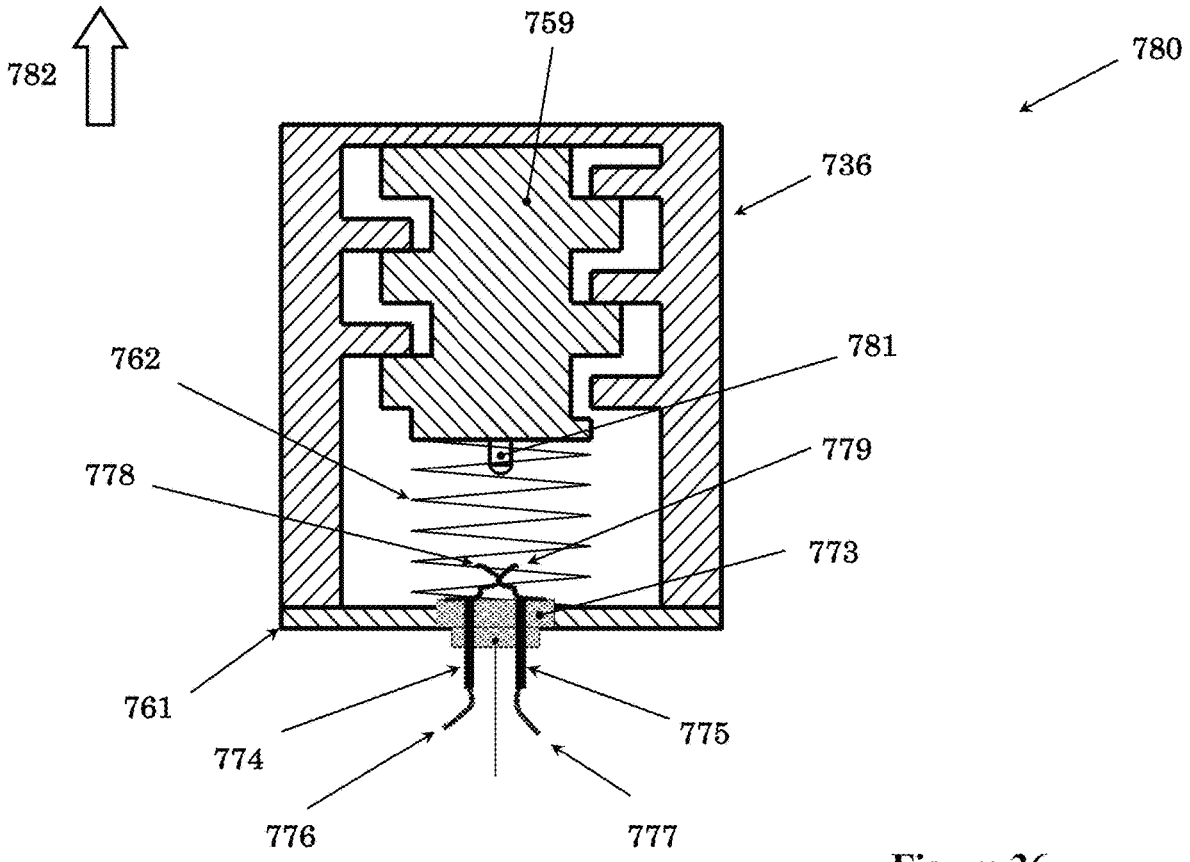
FIG. 36 illustrates a schematic of a cross-sectional view of a normally closed electrical impulse switch embodiment for opening electrical circuits when subjected to a prescribed all-fire or the like condition in its non-activated state.

The normally open electrical impulse switch 760 of FIG. 35 may also be modified to function as a normally closed electrical impulse switch. The schematic of such a normally closed impulse switch embodiment 780 is shown in FIG. 36. The basic design and operation of the electrical impulse switch 780 is identical to that of the normally open electrical impulse switch embodiment 760 of FIG. 35, except for its electrical switching contacts and related elements described below to convert it from a normally open to a normally closed impulse switch.

In the normally closed electrical impulse switch embodiment 780 of FIG. 36, like the normally open impulse switch 760 of FIG. 35, an element 773, which is constructed of an electrically non-conductive material is fixed to the electrical impulse switch base 761. The electrically non-conductive element 773 may, for example, be attached to the electrical impulse switch base 761 by fitting it into a provided hole or other methods known in the art. The element 773 is provided with two electrically conductive elements 774 and 775 with flexible contact ends 778 and 779 (446 and 445 in the embodiment of FIG. 15), respectively. The flexible electrically conductive contact ends 778 and 779 are biased to press against each other as seen in the schematic of FIG. 36. As a result, a circuit connected to the electrically conductive elements 774 and 775 is normally closed in the pre-activation state of the electrical impulse switch 780 as shown in the configuration of FIG. 36.

The electrically conductive elements 774 and 775 may be provided with the extended ends that form contact "pins" for direct insertion into provided holes in a circuit board or may alternatively be provided with wires 776 and 777 for connection to appropriate circuit junctions, in which case, the wires 776 and 777 may be desired to exit from the sides of the electrical impulse switch 780 (not shown).

The previously described "screw" element 759 is then provided with an electrically nonconductive wedge element 781, which is fixed to the lower surface of the "screw" element 759 as shown in FIG. 36, for example, by an adhesive or using other methods known in the art.

The basic operation of the impulse switch 780 of FIG. 36 is very similar to that of the electrical impulse switch embodiment 760 of FIG. 35. When the electrical impulse switch is accelerated in the direction of the arrow 782, if the acceleration is due to accidental drops or the like that result in a high G but short duration acceleration pulses, then the thread surfaces of the "screw" element 759 impacts the up and down surfaces of the grooves in the cylindrical body 736 and turns slightly as a result as was described previously and eventually returns back to its initial position shown in FIG. 36. But if the acceleration in the direction of the arrow 782 corresponds to the prescribed low G but long duration acceleration event such as munitions firing or other similar events, then as was previously described, "screw" element 759 would turn and slide down until the electrically nonconductive wedge element 781 is inserted between the contacting surfaces of the flexible electrically conductive contact ends 778 and 779, thereby opening the circuit to which the electrical impulse switch 780 is connected (through the extended ends 774 and 775 or wires 776 and 777).

It is appreciated that in the electrical impulse switch embodiment 780 of FIG. 36, once the prescribed low G but long duration acceleration event such as munitions firing has ended, the compressively preloaded spring 762 will force the "screw" element 759 to return to its initial position shown in FIG. 36. At this point, the spring 762 is generally designed to overcome the friction forces between the flexible electrically conductive contact ends 778 and 779 and the electrically nonconductive wedge element 781, thereby allowing the "screw" element 759 to return to its initial position and re-establishing electrical contact between the flexible electrically conductive contact ends 778 and 779. The electrical impulse switch embodiment 780 is therefore of a non-latching and normally closed type.

The normally open embodiment 760 and normally closed embodiment 780 electrical impulse switches of FIGS. 35 and 36, respectively, may also be modified to become of latching switch type. In general, the following two basic methods may be used to convert the electrical impulse switched of FIGS. 35 and 36 to latching types.

In the first method, the cylindrical body 736 is provided with a "one-way" mechanism such as the lever 719 type shown in the "actuation mechanism" of FIG. 31 or any other type known in the art so that once the "screw" element 737, FIGS. 35 and 36, has performed the indicated circuit closing or opening action, respectively, it is prevented from returning to it pre-activation state.

The second method consists of using one of the currently available packaged and self-contained push-button or the like electrical switches in place of the previously described electrical switching contacts and related elements (for example in the embodiments of FIGS. 27 and 29), and the "actuation mechanisms" (for example the "actuation mechanisms" of FIG. 25 or 26 or 33) would actuate the push-button switches to open or close the intended circuits as were previously described. Such miniature normally open and closed electrical switch units of latching and non-latching are widely available and used in numerous products. As an example, Digi-Key Electronics provides normally open and non-latching switch (part number B3F-1000 by Omron), normally open and latching switch (part number 15451 from APEM), normally closed and non-latching switch (part number 5GTH935NCNO by APEM), and normally closed and latching switch (part number TL2201EEZA by E-Switch).

It is appreciated by those skilled in the art that the actuation mechanisms embodiment 650 and 740 of FIGS. 25 and 33 perform their high G and short duration non-actuation functions by the described "trapping" of the mass element 655 and the "screw" element 737 and preventing them from traveling and engaging the intended device, for example to actuate the striker mass release lever 733 and 756 of the inertial igniter embodiments 725 and 755 of FIGS. 32 and 34, respectively. The travel of the mass element 655 and the "screw" element 737 to actuate the intended device is however unimpeded under significantly longer duration but low G accelerations. Another basic geometrical design of the "actuation mechanisms" that enables similar impacting mass element "trapping" functionality is obtained by using two impacting masses with a configuration of the type shown in the schematic of FIG. 37 and identified by the numeral 790.

Figure 37:
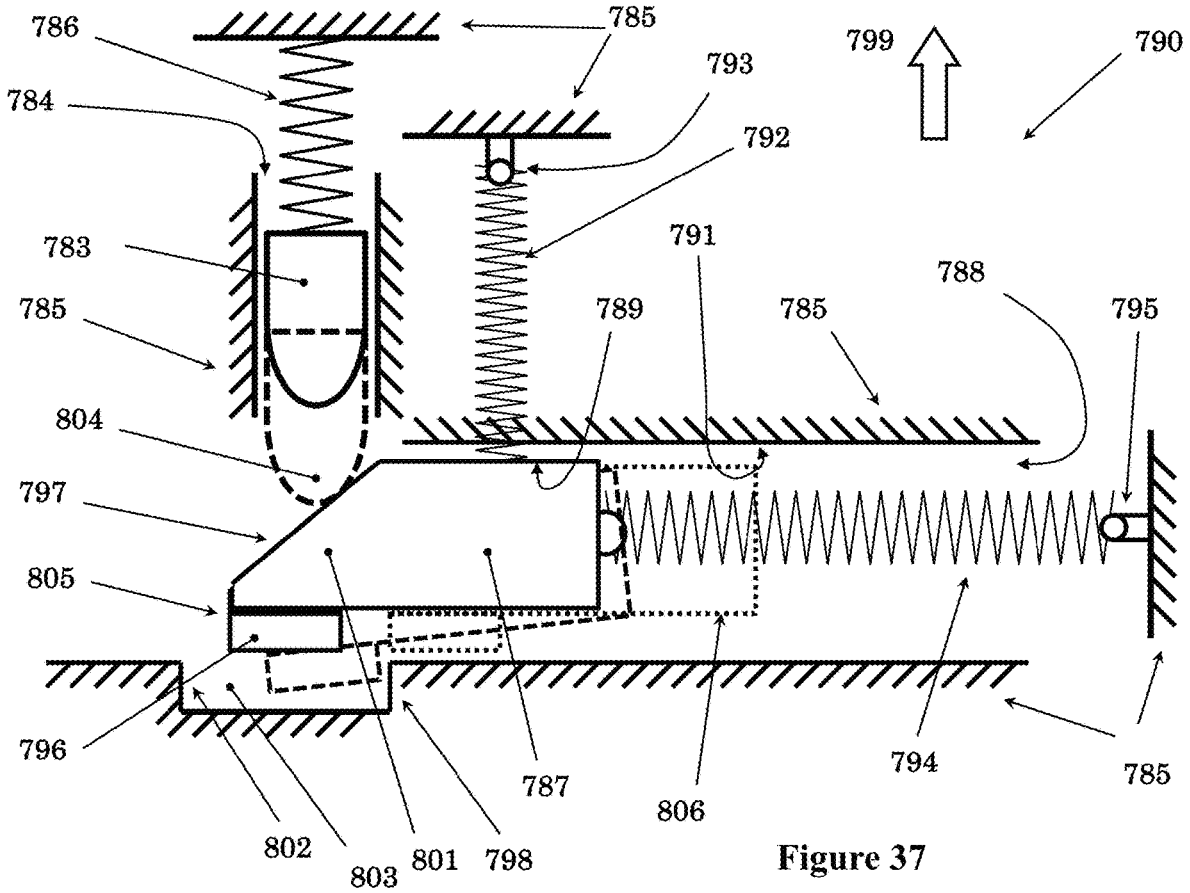
FIG. 37 illustrates another embodiment of an "actuation mechanism" that uses the process of impact to prevent actuation when subjected to high G but short duration acceleration pulses.

The "actuation mechanism" embodiment 790 shown in the schematic of FIG. 37 consists of a mass element 783, which is positioned in the guide 784 provided in the structure 785 of the "actuation mechanism" 790. The mass element 783 is attached to the structure of the "actuation mechanism" 790 by the spring 786 as shown in its unloaded condition in FIG. 37.

The device is also proved with the "actuating" element 787, which can travel in the guide 788 that is provided in the "actuation mechanism" structure 785. While stationary, the top surfaces 789 of the actuating element 787 is held against the top surface 791 of the guide 788 by the lightly preloaded tensile spring 792. The spring 792 is attached to the actuating element 787 on one end and to the structure of the "actuation mechanism" 785 on the other end, preferably by a pin joint 793. While stationary, the actuating element 787 is held in the position shown with solid lines in FIG. 37 by the spring 794. The spring 794 is attached to the back of the actuating element 787 on one end and to the "actuation mechanism" structure 785 on the other end, preferably by pin joint 795.

The "actuating" element 787 is provided with the step 796 under the element body, which under stationary conditions is positioned past the step 798 in the "actuation mechanism" structure 785 as shown in the schematic of FIG. 37. The frontal surface of the actuating element 787 has an inclined surface profile 797, which under stationary conditions is positioned under the mass element 783. The inclined surface 797 may have a curved profile (not shown) as viewed in the cross-sectional view of FIG. 37 to achieve a varying rate of lateral displacement of the actuating element 787 for a constant speed of the mass element while engaging the surface 797.

The "actuation mechanism" embodiment of 790 functions as follows. When the inertial igniter in which the "actuation mechanism" 790 is used for striker mass release mechanism actuation is subjected to an accidental high G but short duration acceleration in the direction of the arrow 799, as was previously described for the mass-spring system of FIG. 24, mass element 783 (corresponding to the mass element 655 in the embodiment 650 of FIG. 25) is first accelerated down in the guide 784 towards the inclined surface 797 of the actuating element 787. The mass element 783 will then impact the inclined surface 797 of the actuating element 787, transferring part of its momentum to the actuating element 787, causing the frontal section 801 of the actuating element 787 to begin to move down with the imparted velocity, while the actuating element is also forced to simultaneously begin to move to the right as viewed in the schematic of FIG. 37 with certain velocity due to the inclination of the impacting surface 797. It is also appreciated that since the center of mass of the actuating element 787 is to the right of the point of impact, the actuating element 787 is also forced to begin to rotate counterclockwise after the impact as shown by dashed lines in FIG. 37.

Following mass element 783 impact with the inclined surface 797 of the actuating element 787, the actuating element begins to move down, to the right and rotate in the counterclockwise direction as shown by the dashed lines in FIG. 37. However, as the actuating element moves to the right, its step 796, having been pushed downward, would impact the side of the step 798 in the "actuation mechanism" structure 785 and bounce back to the left, and if its leftward velocity is high enough, would impact the step 802 on the left.

In general, the mass element 783 either bounces back after impacting the surface 797 and if the high G acceleration has not ended, would accelerate back and impacts the surface 797 again, thereby keeping the step 796 with the space 803, i.e., between the steps 798 and 802, forcing the step 796 to keep impacting the sides 796 and 803, thereby constraining lateral motion of the actuating element 787 within its bounds.

However, since the low firing accelerations have significantly long durations, for example 20-40 msec and sometimes much longer, and since the spring 794 is selected to be very soft and the spring 792 is not selected to be very soft, therefore the actuating element 787 would not bounce downward to get the step 796 trapped inside the space 803 between the steps 798 and 802, and will travel to the right as long as the tip 804 of the mass element 783 is in contact with the surface 797 and the side 805 of the actuating element 787 and as shown by dotted lines in FIG. 37. This rightward motion of the actuating element 787 is then used by a device designer to actuate a certain element, for example, for the case of an inertial igniter of the type shown in the embodiments of FIGS. 6-10, the actuate the striker mass release mechanism 318. Alternatively, the motion of the mass element 783 past the actuating element 787 and past through the space 803 may be used to perform the actuation function of the "actuation mechanism" 790.

Another basic method of "trapping" the actuating element (similar to the mass element 655 in the "actuation mechanism" 650 of FIG. 25 or the "screw" element 737 of the "actuation mechanism" embodiment 740 of FIG. 33) during the previously described high G short duration acceleration pulses while allowing actuation functionality at low G and significantly longer duration acceleration events such as firing acceleration in munitions is now described by the "actuation mechanism" embodiment 800 of FIG. 38. Hereinafter, "actuation mechanisms" that are designed using the present method are referred to as "actuator blocking" type "actuator mechanisms".

Figure 38B:
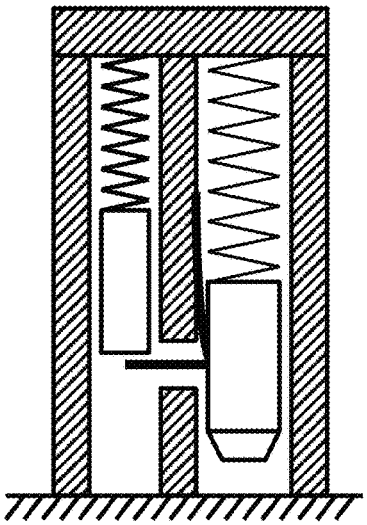
FIGS. 38A and 38B illustrates another method of "trapping" the actuating element of an "actuation mechanism" when subjected to high G short duration accidental accelerations while allowing low G but longer duration actuation action.
Figure 38A:
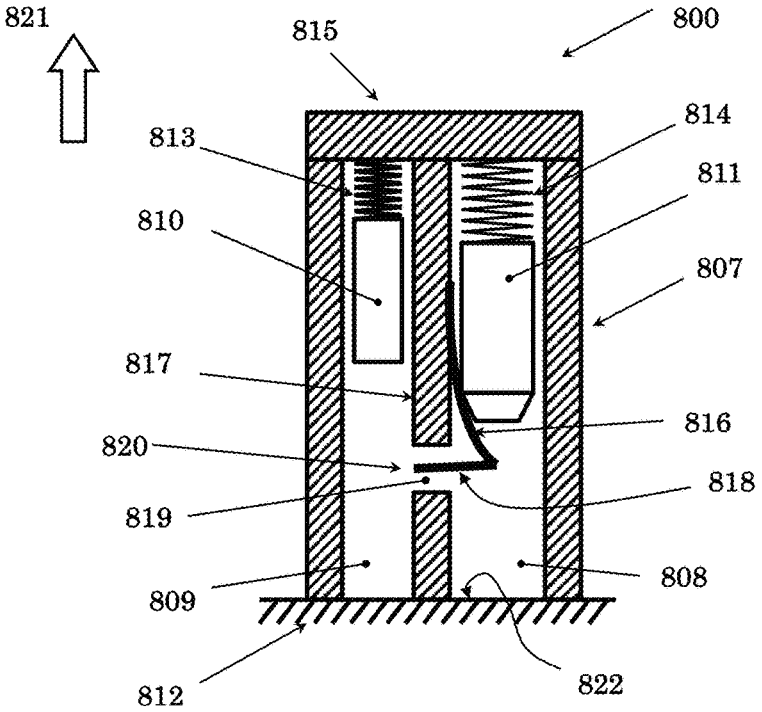

The cross-sectional view of the "actuator blocking" type "actuation mechanism" embodiment 800 in its pre-activation state is shown in the schematic of FIG. 38A. The embodiment 800 is shown to be constructed with the body 807, within which two passages 808 and 809 are provided, within which the actuating element 810 and the blocking member actuating element 811 can freely slide as shown in FIG. 38A. The passages 808 and 809 and the elements 810 and 811 may have any cross-sectional shape (as viewed in a plane perpendicular to the plane of the view of FIG. 38A). For example, they may all have circular cross-sectional areas. However, if the intended application demands, they may have cross-sectional shapes that would prevent one or both members from spinning relative to the body 807.

The body 807 of the "actuation mechanism" 800 is fixedly attached to the base 812 of the device using the actuation mechanism. The compressively preloaded springs 813 and 814 are used to keep the actuating element 810 and the blocking member actuating element 811, respectively, in the positions shown in FIG. 38A. The compressively preloaded spring 813 is attached to the actuating element 810 on one end and to the top structure 815 of the body 807 of the "actuation mechanism" on the other end. The compressively preloaded spring 814 is similarly attached to the actuating element 811 on one end and to the top structure 815 of the body 807 of the "actuation mechanism" on the other end.

A flexible "L" shape flexible element 816 shown in FIG. 38A is also provided in the blocking member actuating element 811 passage 808. The long and curved section of the flexible element 816 is fixedly attached to the passage 808 side of the "wall" 817 of the "actuation mechanism" body 807 using any one of the methods known in the art, such as by fasteners or via welding or the like. The free end 818 of the flexible element 816 is bent (forming the indicated "L" shape), a portion of the bent section being positioned inside an access port 819 through the "wall" 817 as shown in FIG. 38A. In the pre-activation state of the "actuation mechanism" 800 shown in FIG. 38A, the tip 820 of the free end 818 of the flexible element 816 is at or close to the inner space of the passage 809 in the access port 819.

The "actuation mechanism" embodiment of 800 functions as follows. When the inertial igniter in which the "actuation mechanism" 800 is used for striker mass release mechanism actuation is subjected to an accidental high G but short duration acceleration in the direction of the arrow 821, FIG. 38A, the actuating element 810 and the blocking member actuating element 811 will both begin to move down in their respective passages 808 and 809, respectively. The blocking member actuating element 811, however, being in contact or very close to the flexible element 816, would quickly push the free end 818 of the flexible element 816 through the access port 819 into the passage 809 as shown in FIG. 38B, thereby blocking the movement of the actuating element 810 passed the access port 819.

It is appreciated by those skilled in the art that the compressively preloaded spring 814 of the blocking member actuating element 811 must be preloaded to the required level that would prevent it from sliding down the passage 808 before (and in many cases slightly above) the previously described prescribed low G but long duration (all-fire in the case of munitions) acceleration level has been reached. As a result, the free end 818 of the flexible element 816 is pushed into the passage 809 only if the "actuation mechanism" 800 is accelerated in the direction of the arrow 821 when the acceleration level is above the prescribed activation acceleration (all-fire in munitions) level, i.e., if the said acceleration is due to accidental high G accelerations of the "actuation mechanism". Then when the accidental acceleration has ceased, the blocking member actuating element 811 is pulled back to its initial position shown in FIG. 38A by the preloaded compressive spring 814. The free end 818 of the flexible element 816 is then pulled back out of the passage 809 and the "actuation mechanism" 800 is ready to respond to the next acceleration event. The compressive preloading of the spring 813 of the actuating element 810 is generally very low, usually a small fraction of the prescribed activation acceleration level and is used mainly for stability purposes.

It is also appreciated by those skilled in the art that the "actuation mechanism" embodiment 800 of FIG. 34A is also capable of withstanding any lateral accidental accelerations, even if very high G, since such accelerations would not displace the actuating element 810 downwards to perform its actuation function as is later described.

It is also appreciated by those skilled in the art that total length of downward travel that is provided for the blocking member actuating element 811 in the passage 808 (during which the body of the element 811 is still in contact with the free end 818 of the flexible element 816 to keep the passage 809 blocked) is selected such that the blocking member actuating element 811 would reach the end 822 of the passage after the accidental high G acceleration has ceased. As a result, there is no chance that the blocking member actuating element 811 would bounce back and allow the free end 818 of the flexible element 816 to be pulled back from its blocking position in the passage 809. Any mechanical energy left in the spring 813 as the accidental high G acceleration is ceased would also bound any vibratory motion of the actuating mass 810 to the area of the passage above the access port 819.

However, since the prescribe low activation accelerations (all-fire setback acceleration in munitions) have relatively long durations, for example 20-40 msec and sometimes longer, and since the compressive preloading of the spring 813 is very, for example less than an equivalent of 5-10 G over the entire range of downward motion of the actuating element 810, and since the spring rate of the spring 813 is also very low, therefore the actuating element 810 would start and continue to move downward and gain speed until it reaches the mechanism that it is intended to actuate, for example, the release lever 318 of the inertial igniter embodiment 300 of FIGS. 6-10. The actuating member may also be used to function as a striker element in an inertial igniter to ignite a percussion primer or other provided pyrotechnic material, for example, function as the striker 205 of the prior art inertial igniter embodiment 200 of FIG. 2 to impact the pyrotechnic compound 215 (and the tip of the protrusion 217) or a percussion primer that is provided in place of the pyrotechnic compound 215 with the required impact energy to initiate the pyrotechnic compound or the provided percussion primer, the basic embodiments of which are presented later in this disclosure.

It is appreciated by those skilled in the art that similar to the inertial igniter embodiment 755 of FIG. 34, the "actuation mechanism" embodiment 800 of FIG. 38A may be used to construct an inertial igniter that can satisfy the aforementioned highly demanding all-fire and no-fire acceleration level and duration conditions. Here again, the general method of using the "trapping" type of "actuation mechanism" of the embodiment 800 of FIG. 38A to construct such inertial igniters is described by its application to the inertial igniter embodiment 300 of FIGS. 6-10 to construct the inertial igniter embodiment 825 of FIG. 39.

Figure 39:
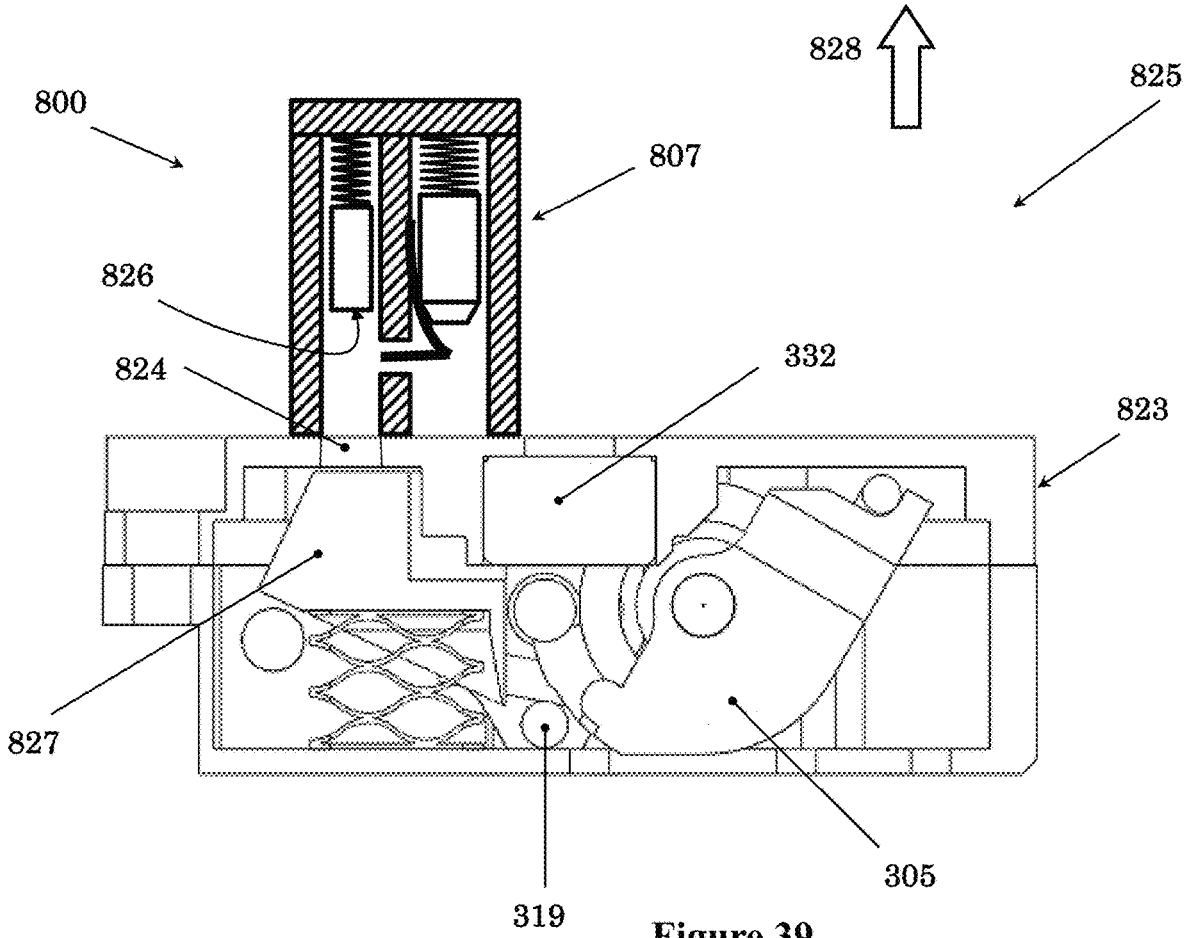
FIG. 39 illustrates a schematic of a cross-sectional view of the inertial igniter embodiment of FIGS. 6-10 with the striker mass release actuation mechanism of FIG. 38 to achieve very high G and short duration no-fire and low G and relatively long duration all-fire activation capability.

In the schematic of the inertial igniter embodiment 825 of FIG. 39, the cross-sectional view of the FIG. 8 of the embodiment 300 shown in the views of FIGS. 6-10 is shown as integrated with the "actuator blocking" type "actuation mechanism" embodiment 800 of FIG. 38A. All components of the inertial igniter 300 used in the embodiment of 825 remain the same and are indicated with the same numerals except those that are modified as described below.

In the inertial igniter embodiment 825 of FIG. 39, the "actuator blocking" type "actuation mechanism" embodiment 800 of FIG. 38A is shown to be attached to the cap 823 (302 in FIG. 8) of the inertial igniter embodiment 300, FIG. 8. The body 807 of the "actuation mechanism" is fixedly attached to the cap 823 as shown in FIG. 39. An opening 824 is provided in the cap 823 under the body 807 of the "actuation mechanism" to allow the actuating tip 826 of the actuating element 810, FIG. 38A, to pass through and engage the release lever 827 (318 in the embodiment 330 of FIG. 8).

The inertial igniter embodiment of 825 of FIG. 39 functions as follows. When the inertial igniter is subjected to an accidental high G but short duration acceleration in the direction of the arrow 828, as was previously described for the "actuation mechanism" of FIG. 38A, the blocking member actuating element 811, being in contact or very close to the flexible element 816, would quickly push the free end 818 of the flexible element 816 through the access port 819 into the passage 809 as shown in FIG. 38B, thereby blocking the movement of the actuating element 810 passed the access port 819.

However, since the spring 814 is preloaded in compression to prevent downward displacement of the blocking member actuating element 811, FIG. 38A, under the low activation acceleration (all-fire setback acceleration in munitions) levels in the direction of the arrow 828, FIG. 39, and since the preloaded compressive spring 813 is relatively soft and is very lightly preloaded in compression, for example less than an equivalent of 5-10 G over the entire range of downward motion of the actuating element 810, therefore the actuating element 810 would slide down the passage 809 towards the cap 823 of the inertial igniter. The tip 826 of the actuating element 810 would then pass through the opening 824 and engage the release lever 827 and force it down and cause it to rotate in the counterclockwise direction as viewed in FIG. 39, thereby as was described for the embodiment 300 of FIGS. 6-10, releasing the striker mass 305 and allowing it to be accelerated rotationally in the clockwise direction as seen in the view of FIG. 39 and striking and igniting the primer 332, FIG. 8.

Similar to the inertial igniter embodiment 725 of FIG. 32, in the embodiment 825 of FIG. 39, the center of mass of the release lever 827 is positioned close to the rotary joint 319 and slightly to its right as viewed in the cross-sectional view of the FIG. 39, so that the acceleration of the inertial igniter in the direction of the arrow 828 would act on the inertia of the release lever 827, generating a very small toque that would tend to rotate it in the clockwise direction. Then unlike the inertial igniter 300, acceleration in the direction of the arrow 828 alone cannot rotate the release lever 827 in the counterclockwise direction and release the striker mass 305 as was previously described for the embodiment 300. Thus, the release lever 827 of the inertial igniter embodiment 825 can only be rotated in the counterclockwise direction by the engaging tip 826 of the actuating element 810 through the opening 824 due to the low G but long duration all-fire accelerations. The release lever 827 is then forced down, causing it to rotate in the counterclockwise direction as viewed in FIG. 39, thereby as was described for the embodiment 300 of FIGS. 6-10, releasing the striker mass 305 and allowing it to be accelerated rotationally in the clockwise direction as seen in the view of FIG. 39, striking and igniting the primer 332.

It is appreciated by those skilled in the art that the inertial igniter embodiment 825 of FIG. 39 is also capable of satisfying the previously indicated high G and short duration accidental accelerations that it is subjected to from any direction. This feature is essential in munitions since dropping on hard surfaces may occur in any direction, therefore the inertial igniter used in the munition may experience such accidental high G loading from almost any direction. An examination of the inertial igniter embodiment 825 shown in FIG. 39 clearly shows that if the inertial igniter is subjected to accidental acceleration in the direction perpendicular to the view of FIG. 39 or in the right or left direction in the view of FIG. 39, the actuating element 810 will not be forced to move down towards the cap 823.

It is appreciated by those skilled in the art that in some applications, following a high G accidental drop, the device, such as a munition, using the inertial igniter embodiment 825 of FIG. 39 may be required to stay non-operational. For such applications, the passage 808, FIG. 38A, is provided with a "one-way" mechanism such as the lever 719 type shown in the "actuation mechanism" of FIG. 31 or any other type known in the art so that once the blocking member actuating element 811 has pushed the free end 818 of the flexible element 816 through the access port 819 into the passage 809 as shown in FIG. 38B, the blocking member actuating element 811 is prevented from returning to it pre-activation state, thereby permanently blocking the actuating element 810 from performing it actuation function and initiate the inertial igniter, FIG. 39.

It is appreciated that the "actuation mechanism" embodiment 800 of FIG. 38A may also be used directly to construct an inertial igniter that can satisfy the aforementioned highly demanding all-fire and no-fire acceleration level and duration conditions. Here again, the general method of using the "trapping" type "actuation mechanism" of the embodiment 800 of FIG. 38A to construct such inertial igniters is described by its application to construct the inertial igniter embodiment 830 of FIG. 40.

Figure 40:
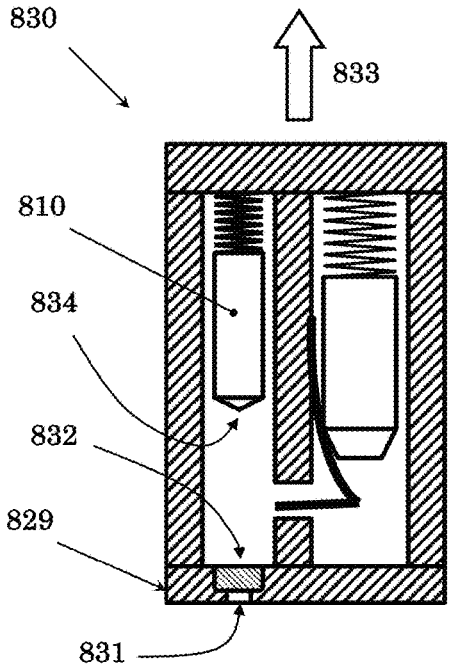
FIG. 40 illustrates a schematic of a cross-sectional view of an inertial igniter embodiment constructed with the "trapping" type "actuation mechanism" of FIG. 38 to achieve no-activation by very high G but short duration acceleration pulses and activation when subjected to low G and relatively long duration accelerations.

In the schematic of the inertial igniter embodiment 830 of FIG. 40, the "trapping" type "actuation mechanism" embodiment 800 of FIG. 38A is shown to be provided with the base cap 829, to which it is fixedly attached. All other components of the inertial igniter are identical to those of the "actuation mechanism" embodiment 800 and are identified by the same numerals, except that the actuator element 810 is provided with the pointed tip 834 for initiating percussion primers or directly applied pyrotechnic materials as is later described. An opening 831 is provided in the base cap 829 under the percussion primer 832, which is assembled into the provided space in cap 829 as shown in FIG. 40.

The inertial igniter embodiment of 830 of FIG. 40 functions as follows. When the inertial igniter is subjected to an accidental high G but short duration acceleration in the direction of the arrow 833, as was previously described for the "actuation mechanism" of FIG. 38A, the blocking member actuating element 811, being in contact or very close to the flexible element 816, would quickly push the free end 818 of the flexible element 816 through the access port 819 into the passage 809 as shown in FIG. 38B, thereby blocking the movement of the actuating element 810 passed the access port 819. The inertial igniter embodiment 830 is therefore prevented from being initiated.

However, since the spring 814 is preloaded in compression to prevent downward displacement of the blocking member actuating element 811, FIG. 38A, under the low activation acceleration (all-fire setback acceleration in munitions) levels in the direction of the arrow 833, FIG. 40, and since the preloaded compressive spring 813 is relatively soft and is very lightly preloaded in compression, for example less than an equivalent of 5-10 G over the entire range of downward motion of the actuating element 810, therefore the actuating element 810 would slide down the passage 809 towards the cap 829 of the inertial igniter and gain speed due to the aforementioned activation acceleration. The tip 834 of the actuating element 810 would then impact the percussion primer and initiate it, with the generated flame and sparks being exited through the opening 831 in the base cap 829, FIG. 40.

It is appreciated by those skilled in the art that the inertial igniter embodiment 830 of FIG. 40 is also capable of satisfying the previously indicated high G and short duration accidental accelerations that it is subjected to from any direction. This feature is essential in munitions since dropping on hard surfaces may occur in any direction, therefore the inertial igniter used in the munition may experience such accidental high G loading from almost any direction. An examination of the inertial igniter embodiment 830 shown in FIG. 40 clearly shows that if the inertial igniter is subjected to accidental acceleration in the direction perpendicular to the view of FIG. 40 or in the right or left direction in the view of FIG. 40, the actuating element 810 will not be forced to move down towards the cap 829.

It is appreciated by those skilled in the art that the "trapping" type "actuation mechanism" embodiment 800 of FIG. 38 may also be used to construct normally open or closed electrical impulse switches of latching and non-latching types similar to those constructed with the "actuation mechanism" of FIGS. 25 and 26 as described below.

Figure 41:
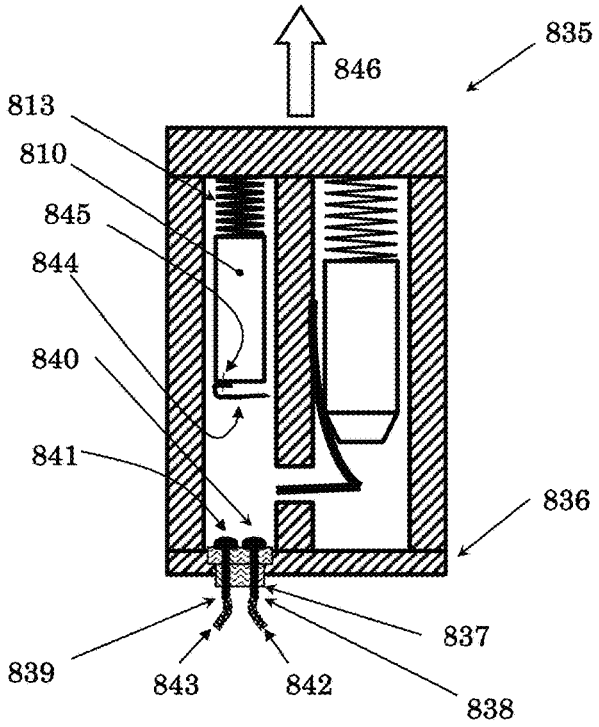
FIG. 41 illustrates a schematic of the cross-sectional view of a normally open and non-latching impulse switch embodiment for closing electrical circuits when subjected to a prescribed all-fire or the like condition in its non-activated state constructed with the "actuation mechanism" embodiment of FIG. 38.

The embodiment 835 of the electrical impulse switch that that is constructed with the "trapping" type "actuation mechanism" embodiment 800 of FIG. 38 is shown in the schematic of FIG. 41. The electrical impulse switch 835 is of a normally open and non-latching type. All components of the embodiment of FIG. 41 are identical to those of the embodiment of FIG. 38, except for the addition of the base cap 836 and the switching components described below.

The electrical impulse switch 835 is provided with the electrical switching contacts and related elements described below to construct a non-latching normally open electrical impulse switch. An element 837, which is constructed of an electrically non-conductive material is fixedly attached to the base 836 of the electrical impulse switch as shown in FIG. 41. The element 837 is provided with two electrically conductive elements 839 and 839 with electrically conductive contacts 840 and 841, respectively. The electrically conductive elements 839 and 839 may be provided with the extended ends to form contact "pins" for direct insertion into provided holes in a circuit board or may alternatively be provided with wires 842 and 843, respectively, for connection to appropriate circuit junctions.

In the electrical impulse switch 835, the actuating element 810 is provided with a flexible strip of electrically conductive material 844, which is fixedly attached to the surface of the actuating element 810 as shown in FIG. 41, for example, with fasteners 845 or by soldering or other methods known in the art.

The "actuation mechanism" component 800, FIG. 38, which is used in the construction of the electrical impulse switch 835 of FIG. 41, operates as was previously described under high G but short duration accidental accelerations in the direction of the arrow 846, i.e., the blocking member actuating element 811, being in contact or very close to the flexible element 816, would quickly push the free end 818 of the flexible element 816 through the access port 819 into the passage 809 as shown in FIG. 38B, thereby blocking the movement of the actuating element 810 passed the access port 819. The impulse switch 835 is thereby prevented from activating. But if the acceleration in the direction of the arrow 846 corresponds to the prescribed low G but long duration acceleration event such as munitions firing or other similar events, then as was previously described, the actuating element 810 would slide down until the strip of the electrically conductive material 844 comes into contact with the contact ends 840 and 841, thereby closing the circuit to which the impulse switch 835 is connected (through the pins 838 and 839 or wires 842 and 843).

It is appreciated that in the electrical impulse switch embodiment 835 of FIG. 41, once the prescribed low G but long duration acceleration event such as munitions firing has ended, the compressively preloaded spring 813 will force the actuating element 810 to return to its initial position, thereby separating the strip of the electrically conductive material 844 from the contacts 840 and 841. The electrical impulse switch embodiment 835 is therefore of a non-latching and normally open type.

Figure 42:
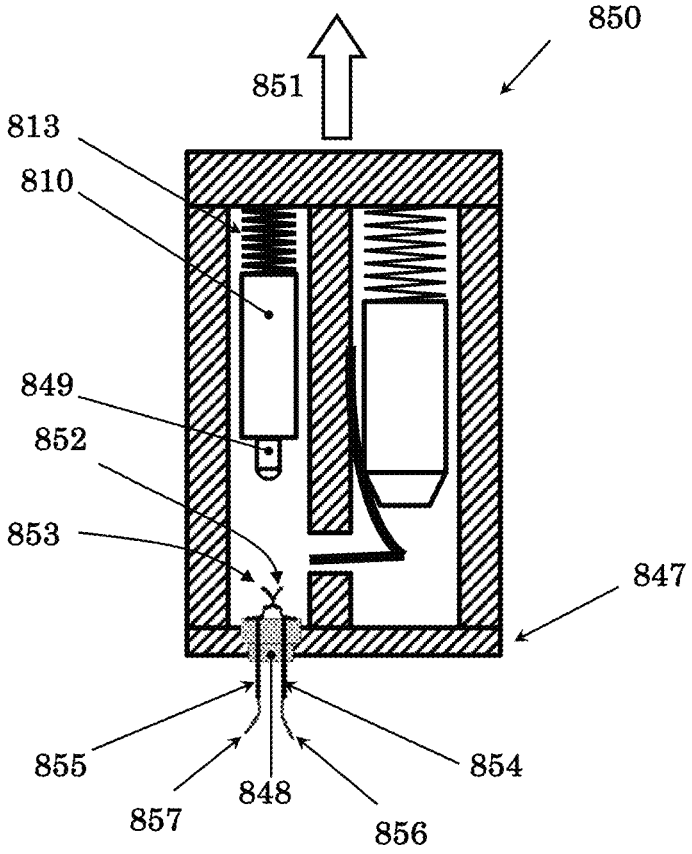
FIG. 42 illustrates a schematic of a cross-sectional view of a normally closed and non-latching impulse switch embodiment for opening electrical circuits when subjected to a prescribed all-fire or the like condition in its non-activated state constructed with the "actuation mechanism" embodiment of FIG. 38.

The normally open electrical impulse switch 835 of FIG. 41 may also be modified to function as a normally closed electrical impulse switch. The schematic of such a normally closed impulse switch embodiment 850 is shown in FIG. 42. The basic design and operation of the electrical impulse switch 850 is identical to that of the normally open electrical impulse switch embodiment 835 of FIG. 40, except for its electrical switching contacts and related elements described below to convert it from a normally open to a normally closed impulse switch.

In the normally closed electrical impulse switch embodiment 850 of FIG. 42, like the normally open impulse switch 835 of FIG. 41, an element 848, which is constructed of an electrically non-conductive material is fixed to the electrical impulse switch base 847. The electrically non-conductive element 848 may, for example, be attached to the electrical impulse switch base 847 by fitting it into a provided hole or other methods known in the art. The element 848 is provided with two electrically conductive elements 854 and 855 with flexible contact ends 852 and 853, respectively. The flexible electrically conductive contact ends 852 and 853 are biased to press against each other as seen in the schematic of FIG. 42. As a result, a circuit connected to the electrically conductive elements 854 and 855 is normally closed in the pre-activation state of the electrical impulse switch as shown in the configuration of FIG. 42. The electrically conductive elements 854 and 855 may be provided with the extended ends that form contact "pins" for direct insertion into provided holes in a circuit board or may alternatively be provided with wires 856 and 857 for connection to appropriate circuit junctions, in which case, the wires 856 and 857 may be desired to exit from the sides of the electrical impulse switch 850 (not shown).

The previously described actuating element 810 is then provided with an electrically nonconductive wedge element 849, which is fixed to the lower surface of the actuating element 810 as shown in FIG. 41, for example, by an adhesive or using other methods known in the art.

The basic operation of the impulse switch 850 of FIG. 42 is very similar to that of the electrical impulse switch embodiment 835 of FIG. 41. When the electrical impulse switch is accelerated in the direction of the arrow 851, if the acceleration is due to accidental drops or the like that result in a high G but short duration acceleration pulses, the blocking member actuating element 811, being in contact or very close to the flexible element 816, would quickly push the free end 818 of the flexible element 816 through the access port 819 into the passage 809 as shown in FIG. 38B, thereby blocking the movement of the actuating element 810 passed the access port 819. The impulse switch 850 is thereby prevented from activating. But if the acceleration in the direction of the arrow 851 corresponds to the prescribed low G but long duration acceleration event such as munitions firing or other similar events, then as was previously described, the actuating element 810 would slide down until the electrically nonconductive wedge element 849 is inserted between the contacting surfaces of the flexible electrically conductive contact ends 852 and 853, thereby opening the circuit to which the electrical impulse switch 850 is connected (through the extended ends 854 and 855 or wires 856 and 857).

It is appreciated that in the electrical impulse switch embodiment 850 of FIG. 42, once the prescribed low G but long duration acceleration event such as munitions firing has ended, the compressively preloaded spring 813 will force the actuating element 810 to return to its initial position shown in FIG. 42. At this point, the spring 813 is generally designed to overcome the friction forces between the flexible electrically conductive contact ends 852 and 853 and the electrically nonconductive wedge element 849, thereby allowing the actuating element 810 to return to its initial position, re-establishing electrical contact between the flexible electrically conductive contact ends 852 and 853. The electrical impulse switch embodiment 850 is therefore of a non-latching and normally closed type.

The normally open embodiment 835 and normally closed embodiment 850 electrical impulse switches of FIGS. 41 and 42, respectively, may also be modified to become of latching switch type. In general, the following two basic methods may be used to convert these electrical impulses switched to latching types.

In the first method, the passage 809, FIG. 38A, is provided with a "one-way" mechanism such as the lever 719 type shown in the "actuation mechanism" of FIG. 31 or any other type known in the art so that once the actuating element 810, FIGS. 41 and 42, has performed the indicated circuit closing or opening action, respectively, it is prevented from returning to it pre-activation state.

The second method consists of using one of the currently available packaged and self-contained push-button or the like electrical switches in place of the electrical switching contacts and related elements of FIGS. 41 and 42 so that the their actuating elements 810 would actuate the push-button switches to open or close the intended circuits as were previously described. Such miniature normally open and closed electrical switch units of latching and non-latching are widely available and used in numerous products. As an example, Digi-Key Electronics provides normally open and non-latching switch (part number B3F-1000 by Omron), normally open and latching switch (part number 15451 from APEM), normally closed and non-latching switch (part number 5GTH935NCNO by APEM), and normally closed and latching switch (part number TL2201EEZA by E-Switch).

In the first method, the passage 809, FIG. 38A, is provided with a "one-way" mechanism such as the lever 719 type shown in the "actuation mechanism" of FIG. 31 or any other type known in the art so that once the actuating element 810, FIGS. 41 and 42, has performed the indicated circuit closing or opening action, respectively, it is prevented from returning to it pre-activation state.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. An actuating mechanism for actuating a device, the actuating mechanism comprising:

a base having a helically shaped passage;

a movable mass having a helically shaped projection, a first surface of the helically shaped projection mating with a corresponding second surface of the helically shaped passage; and a spring for biasing the first surface of the helically shaped projection of the movable mass against the second surface of the helically shaped passage when the base is not being accelerated;

wherein the helically shaped passage, the helically shaped projection and the spring are configured to maintain the helically shaped projection in a first portion of the helically shaped passage upon the base experiencing a first acceleration profile having a first magnitude and a first duration and allow the mass to move to a second portion of the helically shaped passage upon the base experiencing a second acceleration profile having a second acceleration lower than the first acceleration and a second duration greater than the first duration.

2. The actuating mechanism of claim 1, wherein the movable mass having a portion configured to actuate the device when the helically shaped projection moves to the second portion.

3. The actuating mechanism of claim 2, wherein the movable mass moves to actuate the device when the helically shaped projection moves to the second portion, the device being one of an inertial igniter, a normally open latching electrical circuit, a normally open non-latching electrical circuit, a normally closed latching electrical circuit or a normally closed non-latching electrical circuit.

* * * * *